United States Patent [19]

Hirose et al.

[11] Patent Number: 4,840,878

[45] Date of Patent: Jun. 20, 1989

[54] METHOD OF COLOR IMAGE FORMATION USING A HIGH CHLORIDE EMULSION AND A DEVELOPER FREE OF BENZYL ALCOHOL

[75] Inventors: Takeshi Hirose; Nobuo Furutachi; Kozo Aoki; Kiyoshi Nakazyo; Genichi Furusawa, all of Kanagawa, Japan

[73] Assignee: Fuji Photo Film Co., Ltd., Kanagawa, Japan

[21] Appl. No.: 251,932

[22] Filed: Sep. 30, 1988

Related U.S. Application Data

[63] Continuation of Ser. No. 6,511, Jan. 23, 1987, abandoned.

[30] Foreign Application Priority Data

Jan. 23, 1986 [JP] Japan ..... 61-13416
Mar. 19, 1986 [JP] Japan ..... 61-61211
Jul. 25, 1986 [JP] Japan ..... 61-175233

[51] Int. Cl.[4] ..... G03C 5/24; G03C 5/38; G03C 7/30; G03C 7/32

[52] U.S. Cl. ..... 430/380; 430/372; 430/377; 430/383; 430/393; 430/464; 430/467; 430/432; 430/505; 430/546; 430/551; 430/553; 430/558

[58] Field of Search ..... 430/372, 377, 380, 383, 430/464, 467, 432, 393, 505, 546, 551, 553, 558

[56] References Cited

U.S. PATENT DOCUMENTS

| | | | |
|---|---|---|---|
| 4,035,188 | 7/1977 | Yabata et al. | 430/467 |
| 4,269,927 | 5/1981 | Atwell | 430/567 |
| 4,299,914 | 11/1981 | Fujumastu et al. | 430/552 |
| 4,304,844 | 12/1981 | Fujumastu et al. | 430/552 |
| 4,443,536 | 4/1984 | Lestina | 430/552 |
| 4,524,132 | 6/1985 | Aoki et al. | 430/552 |
| 4,526,861 | 7/1985 | Ichijima et al. | 430/385 |
| 4,529,690 | 7/1985 | Ohbayashi et al. | 430/551 |
| 4,564,590 | 1/1986 | Sasaki et al. | 430/552 |
| 4,564,591 | 1/1986 | Tanaka et al. | 430/567 |
| 4,565,777 | 1/1986 | Ogawa et al. | 430/552 |
| 4,590,155 | 5/1986 | Klotzer | 430/567 |

FOREIGN PATENT DOCUMENTS

| | | |
|---|---|---|
| 211437 | 2/1987 | European Pat. Off. . |
| 29461 | 8/1974 | Japan . |
| 52058 | 4/1980 | Japan . |
| 200037 | 12/1982 | Japan . |
| 31334 | 2/1983 | Japan . |
| 42045 | 3/1983 | Japan . |
| 50536 | 3/1983 | Japan . |
| 48755 | 3/1984 | Japan . |
| 174836 | 10/1984 | Japan . |
| 177553 | 10/1984 | Japan . |
| 177554 | 10/1984 | Japan . |
| 177555 | 10/1984 | Japan . |
| 177556 | 10/1984 | Japan . |
| 177557 | 10/1984 | Japan . |
| 178459 | 10/1984 | Japan . |
| 19140 | 1/1985 | Japan . |
| 26338 | 2/1985 | Japan . |
| 26339 | 2/1985 | Japan . |
| 158444 | 8/1985 | Japan . |
| 162256 | 8/1985 | Japan . |
| 172042 | 9/1985 | Japan . |
| 70552 | 4/1986 | Japan . |
| 830250 | 2/1987 | Japan . |
| 8704534 | 7/1987 | PCT Int'l Appl. . |

*Primary Examiner*—Paul R. Michl
*Assistant Examiner*—Patrick Doody
*Attorney, Agent, or Firm*—Sughrue, Mion, Zinn, Macpeak, and Seas

[57] ABSTRACT

A method for forming a color image is disclosed, which comprises imagewise exposing a multi-layer silver halide color photographic material comprising a reflective support having provided thereon at least three silver halide emulsion layers different in color sensitivity, each of which separately contains at least one coupler selected from a specific combination of cyan, magenta, and yellow couplers, and processing the exposed material with a color developing solution containing substantially no benzyl alcohol for a period of not more than 2 minutes and a half. A color image excellent in color reproducibility and preservability can be obtained rapidly without using benzyl alcohol.

22 Claims, No Drawings

METHOD OF COLOR IMAGE FORMATION USING A HIGH CHLORIDE EMULSION AND A DEVELOPER FREE OF BENZYL ALCOHOL

This is a continuation, of application Ser. No. 07/006,511 filed Jan. 23, 1987, now abandoned.

FIELD OF THE INVENTION

This invention relates to a method of color image formation using a silver halide color light-sensitive material. More particularly, it relates to a method of color image formation by which a color image can be formed in a reduced processing time without using benzyl alcohol by using a specific combination of color couplers.

BACKGROUND OF THE INVENTION

Silver halide color photographic materials generally comprise a support having provided thereon at least three silver halide emulsion layers, each of which is selectively sensitized so as to be sensitive to one of blue light, green light, and red light, respectively. For example, so-called color papers usually comprise a support having coated thereon a blue-sensitive emulsion layer, a green-sensitive emulsion layer, and a red-sensitive emulsion layer in this order, with auxiliary layers, e.g., intermediate layers, protective layers, etc., being further provided, for example, between light-sensitive layers for prevention of color mixing, ultraviolet absorption, or the like purpose.

In these color photographic materials, a color image is formed by exposing the material containing yellow, magnta, and cyan couplers in the respective light-sensitive layer and subjecting the exposed material to color development processing with an aromatic primary amine developing agent. By the color development processing, a coupling reaction takes place between an oxidation product of the developing agent and each of the couplers to develop the respective color. It is desired that the couplers to be used have a coupling rate as high as possible and exhibit satisfactory color developability so as to provide high color densities within a limited development time. It is also demanded that the developed colors be distinct cyan, magenta, and yellow colors with reduced side absorptions so as to provide a color photographic image exhibiting satisfactory color reproducibility.

Further, the color photographic image formed is required to have satisfactory preservability under various conditions. In order to meet this requirement, it is important that the developed colors of different hues are retarded from discoloration or color change and that the rates of discoloration are uniform as possible over the entire image area so that the color balance of the remaining color image may not be destroyed.

In an attempt to solve these problems, so-called oil-soluble couplers have been proposed, which are incorporated into emulsion layers by dissolving in high-boiling or low-boiling organic solvents and emulsifying the solution. Use of the oil-soluble couplers is associated with a disadvantage that a color developing agent, because of its low lipophilic properties, hardly penetrates into oil droplets having dispersed therein the coupler, resulting in reduction of color density. Hence, various development accelerators which accelerate penetration of a developing agent into the oil droplets have hitherto been developed. Of these, benzyl alcohol produces a great effect to accelerate color development when added to a color developing solution and is currently employed widely for processing of color photographic light-sensitive materials, in particular color papers.

Use of benzyl alcohol in a color developing solution needs solvents therefor, such as diethylene glycol, triethylene glycol, alkanolamines, etc., due to its poor water solubility. However, since these solvents as well as benzyl alcohol per se have a high BOD or COD indicative of a pollution load, it is preferred to reduce the pollution load by eliminting benzyl alcohol.

Besides, it takes time to dissolve benzyl alcohol even with the aid of the solvent. Therefore, in view of reduction of time and labor involved for the preparation of a color developing solution, exclusion of benzyl alcohol is desirable.

Further, if benzyl alcohol is carried with light-sensitive materials into a bleaching bath or a bleach-fixing bath subsequent to the developing bath, the carried-over benzyl alcohol not only causes formation of a leuco dye from a cyan coupler, which leads to reduction in color density, but also retards removal of developer components by washing, sometimes giving adverse influences on image preservability of the processed light-sensitive materials. From all these considerations, it is preferable to use no benzyl alcohol.

On the other hand, while color development has conventionally been completed within 3 to 4 minutes, it has been demanded to shorten the processing time to cope with the recent users' need or rationalization in photofinishing laboratories. However, it is apparent that removal of benzyl alcohol as a development accelerator, combined with reduction of development time would bring about serious reduction of color density.

In order to solve this problem, efforts have been made by using a combination of various known color development accelerators, such as those disclosed in U.S. Pat. Nos. 2,950,970, 2,515,147, 2,496,903, 2,304,925, 4,038,075, and 4,119,642, British Patents 1,430,998 and 1,455,413, Japanese Patent Application (OPI) Nos. 15831/78, 62450/80, 62451/80, 62452/80, 62453/80, 50536/83, and 162256/85 (the term "OPI" as used herein means "unexamined published application"), and Japanese Patent Publication Nos. 12422/76 and 49728/80. None of these efforts, however, succeeded to attain sufficient color densities.

Methods of incorporating a color developing agent into color photographic light-sensitive materials are known, as described, e.g., in U.S. Pat. Nos. 3,719,492, 3,342,559, and 3,342,597, and Japanese Patent Application (OPI) Nos. 6235/81, 16133/81, 97531/82, and 83565/82. However, these methods are not suitable as causing retardation of color development of fog formation.

Methods of using a silver chloride emulsion, as disclosed in Japanese Patent Application (OPI) Nos. 95345/83, 232342/84, and 19140/85, are also unsuitable because gradation control is difficult.

Various methods for not adding at all benzyl alcohol to a color developing solution or greatly reducing the amount of benzyl alcohol to be added to a color developing solution have been proposed. For example, Japanese Patent Application (OPI) Nos. 200037/82, 50536/83, 487555/84, 174836/84, 177553/84, 162256/85, 158444/85, 158446/85, 26338/85, 26339/85, 172042/85, and 31334/83 and Japanese Patent Publication No. 29461/74 disclose that a multi-layer color light-sensitive material comprising a reflective support having provided thereon blue-sensitive, green-sensitive and red-sensitive silver halide emulsion layers having a yellow coupler, a magenta coupler, and a cyan coupler, respectively is processed with a color developing solution containing no benzyl alcohol or a small amount of benzyl alcohol. However, these prior art references merely describe that when processed with a color developing solution, the light-sensitive material must be processed for a developing time longer than two minutes and a half or that when processed within two minutes and a half, the light-sensitive material must be processed with a color developing solution containing a certain amount of benzyl alcohol.

As set forth above, there has not been established a method of obtaining a satisfactory color image in a short time of not more than two minutes and a half by using a color developing solution at a pH of 12 or less, which contains substantially no benzyl alcohol.

SUMMARY OF THE INVENTION

One object of this invention is to provide a method of forming a color image, in which a color light-sensitive material containing oil-soluble couplers is processed with a color developing solution containing substantially no benzyl alcohol in a short processing time.

Another object of this invention is to provide a method of forming a color image having satisfactory color reproducibility and image preservability.

A further object of this invention is to provide a color image formation method which has a markedly reduced pollution load.

It has now been found that the objects can be accomplished by a method of forming a color image, which comprises imagewise exposing a multilayer silver halide color photographic material comprising a reflective support having provided thereon at last three silver halide emulsion layers different in color sensitivity, each of which separately contains at least one of couplers represented by formula (I) or (II) shown below, at least one of couplers represented by formula (III) or (IV) shown below, and at least one of couplers represented by formula (V) shown below, and processing the exposed material with a color developing solution containing substantially no benzyl alcohol for a period of not more than 2 minutes and a half.

Formula (I) is represented by

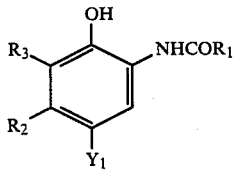

(I)

wherein $R_1$ represents an aliphatic group, an aromatic group, a heterocyclic group, an aromatic amino group, or a heterocyclic amino group; $R_2$ represents an aliphatic group; $R_3$ represents a hydrogen atom, a halogen atom, an aliphatic group, an aliphatic oxy group, or an acylamino group; and $Y_1$ represents a halogen atom or a group capable of being split off upon coupling with an oxidation product of a developing agent (such a group is hereinafter referred to as "split-off group").

Formula (II) is represented by

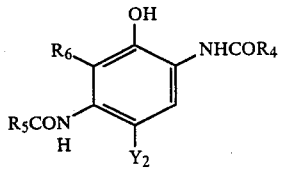

(II)

wherein $R_4$ and $R_5$ each represents an aliphatic group, an aromatic group, a heterocyclic group, an aromatic amino group, or a heterocyclic amino group; $R_6$ represents a hydogen atom, a halogen atom, an aliphatic group, an aliphatic oxy group, or an acylamino group; and $Y_2$ represents a halogen atom or a split-off group.

Formula (III) is represented by

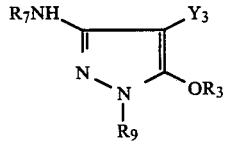

(III)

wherein $R_7$ and $R_9$ each represents a substituted or unsubstituted phenyl group; $R_8$ represents a hydrogen atom, an aliphatic or aromatic acyl group, or an aliphatic or aromatic sulfonyl group; and $Y_3$ represents a hydrogen atom or a split-off group.

Formula (IV) is represented by

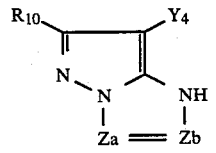

(IV)

wherein $R_{10}$ represents a hydrogen atom or a substituent; $Y_4$ represents a halogen atom or a split-off group; and Za and Zb each represents a methine group, a substituted methine group, or =N—.

Formula (V) is represented by

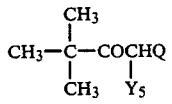

(V)

wherein $Y_5$ represents a split-off group; and Q represents a substituted or unsubstituted N-phenylcarbamoyl group.

$R_2$ and $R_3$ in formula (I) or $R_5$ and $R_6$ in formula (II) may be taken together to form a 5- to 7-membered ring, respectively.

$R_1$, $R_2$, $R_3$, or $Y_1$ in formula (I); $R_4$, $R_5$, $R_6$, or $Y_2$ in formula (II); $R_7$, $R_8$, $R_9$, or $Y_3$ in formula (III); $R_{10}$, Za, Zb, or $Y_4$ in formula (IV); and Q or $Y_5$ in formula (V) may form a polymer including a dimer.

The couplers are preferably dispersed together with at least one of high-boiling organic solvents represented by formulae (A) to (E) shown below and having a dielectric constant of 4.00 (25° C., 10 kHz) or more.

Formula (A) is represented by

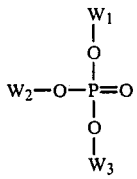

(A)

wherein $W_1$, $W_2$, and $W_3$ each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group.

Formula (B) is represented by $$W_1—COO—W_2 \quad (B)$$

wherein $W_1$ and $W_2$ are as defined above.

Formula (C) is represented by

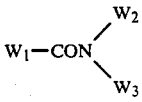

(C)

wherein $W_1$, $W_2$, and $W_3$ are as defined above.

Formula (D) is represented by

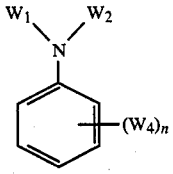

(D)

wherein $W_1$ and $W_2$ are as defined above; $W_4$ represents $W_1$, $OW_1$, or S-$W_1$; and n represents an integer of from 1 to 5; when n=2 or more, $W_4$'s may be the same or different.

Formula (E) is represented by $$W_1—O—W_2 \quad (E)$$

wherein $W_1$ and $W_2$ are as defined above, or $W_1$ and $W_2$ are taken together to form an condensed ring.

It is preferable that at least one of the couplers represented by formulae (I) to (V) contains at least one of a carboxyl group either in the form of a free acid or in the form of a salt, a substituted or unsubstituted sulfonamido group, a substituted or unsubstituted sulfamoyl group, and a substituted or unsubstituted hydroxylphenyl group in its non-diffusible group or split-off group. The carboxyl group or hydroxyphenyl group is contained as a monovalent group, and the sulfonamido group or sulfamoyl group is contained as a monovalent or divalent group. The substituents for the hydroxyphenyl, sulfonamido, and sulfamoyl groups include those for $R_1$ hereinafter described.

DETAILED DESCRIPTION OF THE INVENTION

The term "aliphatic group" as used herein means a straight chain or branched chain or cyclic, and saturated or unsaturated aliphatic hydrocarbon group and embraces an alkyl group, an alkenyl group, an alkynyl group, etc. Typical examples of the aliphatic group are methyl, ethyl, butyl, dodecyl, octadecyl, eicosenyl, isopropyl, t-butyl, t-octyl, t-dodecyl, cyclohexyl, cyclopentyl, allyl, vinyl, 2-hexadecenyl, and propargyl groups, etc.

In formulae (I) to (V), the coupling split-off group as represented by $Y_1$, $Y_2$, $Y_3$, $Y_4$, or $Y_5$ includes an aliphatic, aromatic, heterocyclic, aliphatic sulfonyl, aromatic sulfonyl, heterocyclic sulfonyl, aliphatic carbonyl, aromatic carbonyl, or heterocyclic carbonyl group that is bonded to the coupling active carbon atom via an oxygen, nitrogen, sulfur, or carbon atom; a nitrogen-containing heterocyclic group bonded to the coupling carbon atom via a nitrogen atom; a halogen atom; an aromatic azo group; and the like. The aliphatic, aromatic, or heterocyclic groups contained in these split-off groups are unsubstituted or substituted with one or more of groups (which may be the same or different) acceptable for $R_1$ as hereinafter described, which may be further substituted with the groups acceptable for $R_1$.

Specific examples of the coupling split-off groups include a halogen atom (e.g., a fluorine atom, a chlorine atom, a bromine atom, etc.), a substituted or unsubstitued alkoxy group (e.g., an ethoxy group, a dodecyloxy group, a methoxyethylcarbamoylmethoxy group, a 3-(methanesulfonamido)propyloxy group, a carboxypropyloxy group, a methylsulfonylethoxy group, etc.), a substituted or unsubstituted aryloxy group (e.g., a 4-chlorophenoxy group, a 4-methoxyphenoxy group, a 3-sulfonamidophenoxy group, a 4-(N,N'-diethylsulfamoyl)phenoxy group, a 4-carboxyphenoxy group, etc.), an acyloxy group (e.g., an acetoxy group, a tetradecanoyloxy group, a benzoyloxy group, etc.), an aliphatic or aromatic sulfonyloxy group (e.g., a methanesulfonyloxy group, a toluenesulfonyloxy group, etc.), an acylamino group (e.g., a dichloroacetylamino group, a heptafluorobutyrylamino group, etc.), an aliphatic or aromatic sulfonamido group (e.g., a methanesulfonamino group, a p-toluenesulfonamino group, etc.), a substituted or unsubstituted alkoxycarbonyloxy group (e.g., an ethoxycarbonyloxy group, a benzyloxycarbonyloxy group, etc.), a substituted or unsubstituted aryloxycarbonyloxy group (e.g., a phenoxycarbonyloxy group, etc.), an aliphatic, aromatic, or heterocyclic thio group (e.g., an ethylthio group, a phenylthio group, a tetrazolylthio group, etc.), a substituted or unsubstituted carbamoylamino group (e.g., an N-methylcarbamoylamino group, an N-phenylcarbamoylamino group, etc.), a substituted or unsubstituted 5-or 6-membered nitrogen-containing heterocyclic group (e.g., an imidazolyl group, a pyrazolyl group, a triazolyl group, a tetrazolyl group, a 1,2-dihydro-2-oxo-1-pyridyl group, etc.), a substituted or unsubstituted imido group (e.g., a succinimido group, a hydantoinyl group, etc.), an aromatic azo group (e.g., a phenylazo group, etc.), and the like.

Couplers containing a split-off group bonded via a carbon atom include bis-form couplers obtained by condensing 4-equivalent couplers using aldehydes or ketones. The split-off groups of the present invention may contain photographically useful moieties, such as a development inhibitor moiety, a development accelerator moiety, etc. Preferred combinations of split-off groups in each of the formulae (I) to (V) will be described later.

In formulae (I) and (II), $R_1$, $R_4$, and $R_5$ each preferably represents an aliphatic group having from 1 to 36 carbon atoms, an aromatic group having from 6 to 36 carbon atoms (e.g., a phenyl group, a naphthyl group, etc.), a heterocyclic group (e.g., a pyridyl group, a 2-furyl group, etc.), or an aromatic or heterocyclic amino group (e.g., an anilino group, a naphthylamino group, a 2-benzothiazolylamino group, a 2-pyridylamino group, etc.). Substituents for these groups include an alkyl group, an aryl group, a heterocyclic group, an alkoxy group (e.g., a methoxy group, a 2-methoxyethoxy group, etc.), an aryloxy group (e.g., a 2,4-di-t-amylphenoxy group, a 2-chlorophenoxy group, a 4-cyanophenoxy group, etc.), an alkenyloxy group (e.g., a 2-propenyloxy group, etc.), an acyl group (e.g., an acetyl group, a benzoyl group, etc.), an ester group (e.g., a butoxycarbonyl group, a phenoxycarbonyl group, an acetoxy group, a benzoyloxy group, a butoxysulfonyl group, a toluenesulfonyloxy group, etc.), an amido group (e.g., an acetylamino group, an ethylcarbamoyl group, a dimethylcarbamoyl group, a methanesulfonamido group, an N,N-dibutylsulfamoyl group, a 3-(2,4-di-t-amylphenoxy)propylsulfamoyl group, a benzenesulfonamido group, a 2-butoxy-5-t-octylbenzenesulfonamido group, a dodecanesulfonamido group, a butylsulfamoyl group, etc.), a sulfamido group (e.g., a dipropylsulfamoylamino group, etc.), an imido group (e.g., a succinimido group, a hydantoinyl group, etc.), a ureido group (e.g., a phenylureido group, a dimethylureido group, etc.), an aliphatic or aromatic sulfonyl group (e.g., a methansulfonyl group, a phenylsulfonyl group, a 2-butoxy-5-t-octyphenylsulfonyl group, etc.), an aliphatic or aromatic thio group (e.g., an ethylthio group, a phenylthio group, etc.), a hydroxyl group, a cyano group, a carboxyl group, a nitro group, a halogen atom, and so on.

In formula (I), $R_2$ preferably represents an aliphatic group having from 1 to 20 carbon atoms, which may be substituted with the groups acceptable for $R_1$.

In formulae (I) and (II), $R_3$ and $R_6$ each preferably represents a hydrogen atom, a halogen atom (e.g., a fluorine atom, a chlorine atom, a bromine atom, etc.), or an aliphatic group having from 1 to 20 carbon atoms, an aliphatic oxy group having from 1 to 20 carbon atoms, or an acylamino group having from 1 to 20 carbon atoms (e.g., an acetamido group, a benzamido group, a tetradecaneamino group, etc.), each of which groups may be substituted by those groups enumerated for $R_1$.

$R_2$ and $R_3$ in formula (I), or $R_5$ and $R_6$ in formula (II) may be taken together to form a 5- to 7-membered ring.

The compounds of formula (I) or (II) embrace polymeric couplers including dimers formed at either one of $R_1$, $R_2$, $R_3$, and $Y_1$ in formula (I) or either one of $R_4$, $R_5$, $R_6$, and $Y_2$ in formula (II). In the dimers, these groups are mere bonds or divalent linking groups, e.g., an alkylene group, an arylene group, an ether group, an ester group, an amido group, etc., and a combination thereof. In the oligomeric or polymeric couplers, these groups preferably constitute a polymer main chain or are bonded to a polymer main chain via a divalent linking groups as enumerated above for dimers. The polymeric coupler may be a homopolymer solely comprising a monomer having the moiety represented by formula (I) or (II) or a copolymer comprising such a monomer and a non-color forming ethylenically unsaturated monomer, e.g., acrylic acid, methacrylic acid, methyl acrylate, n-butylacrylamide, a $\beta$-hydroxymethacrylate, vinyl acetate, acrylonitrile, styrene, crotonic acid, maleic anhydride, N-vinylpyrrolidone, etc.

$R_1$ and $R_5$ each represents more preferably a substituted or unsubstituted alkyl or aryl group. Preferred substituents for the alkyl group include a substituted or unsubstituted phenoxy group and a halogen atom, with substituents for the phenoxy group preferably including an alkyl group, an alkoxy group, a halogen atom, a sulfonamido group, a sulfamoyl group, and a carboxyl group. Particularly preferred aryl groups are phenyl groups substituted with at least one of a halogen atom, an alkyl group, a sulfonamido group, a sulfamoyl group, a carboxyl group, and an acylamino group.

$R_4$ represents more preferably a substituted or unsubstituted alkyl or aryl group. Preferred substituents for the alkyl group are halogen atoms. Particularly preferred aryl group include a phenyl group and a phenyl group substituted with at least one of a halogen atom, a sulfonamido group, and a sulfamoyl group.

$R_2$ more preferably represents a substituted or unsubstituted alkyl group having from 1 to 20 carbon atoms. Substituents for the alkyl group preferably include an alkyloxy group, an aryloxy group, an acylamino group, an alkylthio group, an arylthio group, an imido group, a ureido group, an alkylsulfonyl group, and an arylsulfonyl group.

$R_3$ more preferably represents a hydrogen atom, a halogen atom (with a fluroine atom or a chlorine atom being particularly preferred), and an acylamino group, with a halogen atom being most preferred.

$R_6$ more preferably represents a hydrogen atom or an alkyl or alkenyl group having from 1 to 20 carbon atoms, with a hydrogen atom being most preferred.

As a cyan coupler, compounds represented by formula (II), wherein $R_5$ and $R_6$ are taken together to form a 5- or 6-membered nitrogen-containing heterocyclic ring, are preferred because a color image having high density, good reproducibility and high fastness can be obtained even when processed with a color developing solution containing substantially no benzyl alcohol for a period of not more than 2 minutes and a half.

$R_2$ most preferably represents an alkyl group having from 2 to 4 carbon atoms.

$Y_1$ and $Y_2$ each preferably represents a hydrogen atom, and more preferably a chlorine atom.

The above-described cyan couplers of formulae (I) and (II) may be used either individually or in combinations of two or more thereof.

In formula (III), when $R_8$ is a hydrogen atom, it is known in the art that the magenta couplers of formula (III) show keto-enol tautomerism as depicted below. Accordingly, the left-hand structure is equivalent to the right-hand structure.

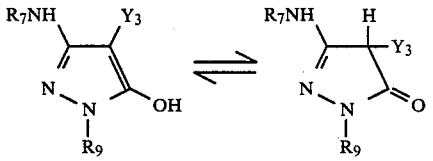

Substituents acceptable for $R_9$ and $R_7$ in formula (III) are the same as those enumerated for $R_1$. When $R_9$ or $R_7$ has two or more substituents, they may be the same or different.

$R_8$ preferably represents a hydrogen atom, an aliphatic acyl group, or an aliphatic sulfonyl group, and more preferably a hydrogen atom. $Y_3$ preferably represents a group capable of being split off at a sulfur, oxygen, or nitrogen atom, and more preferably a sulfur atom-releasing group.

As a magenta couplers, compounds represented by formula (IV) are preferred.

The compounds represented by formula (IV) are 5-membered ring condensed nitrogen-containing heterocyclic couplers. The color-forming nucleus exhibits aromaticity isoelectronic to naphthalene, and has a chemical structure usually called azapentalene. Of the compounds represented by formula (IV), preferred are 1H-imidazo[1,2-b]pyrazoles of the following formula (IV-1), 1H-pyrazolo[5,1-c][1,2,4]-triazoles of the following formula (IV-2), 1H-pyrazolo[1,5-b][1,2,4]-triazoles of the following formula (IV-3), and 1H-pyrazolo[1,5-d]tetrazoles of the following formula (IV-4), with 1H-pyrazolo[1,5-b][1,2,4]trazoles of the following formula (IV-3) being most preferred.

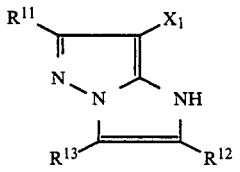
(IV-1)

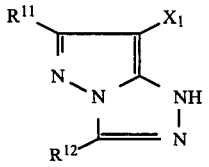
(IV-2)

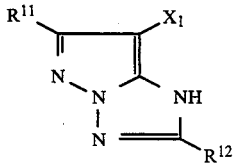
(IV-3)

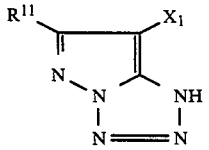
(IV-4)

In formulae (IV-1) to (IV-4), $R^{11}$, $R^{12}$, and $R^{13}$ each represents a hydrogen atom; a halogen atom; a cyano group, $R_1'$, $R_1'O$—, $R_1'C(=O)$—, $R_1'CO(=O)$—, $R_1'SO$—, $R_1'$—$SO_2$—, $R_1'SO_2NH$—, $R_1'C(=O)NH$—, $R_1'NH$—, $R_1$—S—, $R_1'N(H)$—$C(=O)$—NH—, $(R_1')_2N$—$C(=O)$—NH—, or $R_1'OC(=O)NH$—, wherein $R_1'$ represents an aliphatic, aromatic, or heterocyclic group as recited for $R_1$; a silyl group; a silyloxy group; a silylamino group; an imino group; a carbamoyl group; a sulfamoyl group; or a sulfamoylamino group. The nitrogen atom contained in these groups may have substituents as enumerated for $R_1$. $X_1$ has the same meaning as $Y_4$. $R^{11}$, $R^{12}$, $R^{13}$, or $X_1$ may be a divalent group, at which a bis-compound is formed, or a linking group via which a polymer chain and a coupler nucleus are linked.

$R^{11}$, $R^{12}$, and $R^{13}$ each preferably represents a hydrogen atom, a halogen atom, $R_1'$, $R_1'O$—, $R_1'CONH$—, $R_1'SO_2NH$—, $R_1'NH$—, $R_1'S$—, $R_1'NHCONH$—, $(R_1')_2N$—CONH—, or $R_1'OCONH$—. $X_1$ preferably represents a halogen atom, an acylamino group, an imido group, an aliphatic or aromatic sufonamido group, a 5- or 6-membered nitrogen-containing heterocyclic group bonded to the coupling site via a nitrogen atom, an aryloxy group, an alkoxy group, an arylthio group, or an alkylthio group.

In formula (V), the N-phenylcarbamoyl group as represented by Q may have the phenyl moiety substitutued with one or more of substituents (which may be the same or different) arbitrarily selected from the groups acceptable for the aromatic groups represented by $R_1$.

Preferred groups for Q are represented by formula (VA)

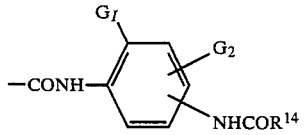
(VA)

wherein $G_1$ represents a halogen atom or an alkoxy group. $G_2$ represents a hydrogen atom, a halogen atom, or a substituted or unsubstituted alkoxy group; and $R^{14}$ represents a substituted or unsubstituted alkyl group.

Substituents for $G_2$ or $R^{14}$ in formula (VA) typically include an alkyl gorup, an alkoxy group, an aryl group, an aryloxy group, an amino group, a dialkylamino group, a heterocyclic group (e.g., an N-morpholino group, an N-piperidino group, a 2-furyl group, etc.), a halogen atom, a nitro group, a hydroxyl group, a carboxyl group, a sulfo group, a sulfonamido group, a sulfamoyl group, an alkoxycarbonyl group, etc.

The split-off group $Y_5$ of formula (V) preferably includes groups represented by formulae (X) to (XVI).

Formula (X) is represented by $$-CH(OR_{20})- \quad (X)$$

wherein $R_{20}$ represents a substituted or unsubstituted aryl group of a substituted or unsubstituted heterocyclic group.

Formulae (XI) and (XII) are represented by

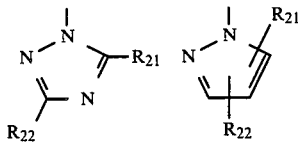

(XI) (XII)

respectively, wherein $R_{21}$ and $R_{22}$ (which may be the same or different) each represents a hydrogen atom, a halogen atom, a carboxylic ester group, an amino group, an alkyl group, an alkylthio group, an alkoxy group, an alkylsulfonyl group, an alklsulfonamido group, an arylsulfonamido group, a sulfamoyl group, an alkylsulfinyl group, a carboxyl group, a sulfo group, a substituted or unsubstituted phenyl group, or a substituted or unsubstituted heterocyclic ring.

Formula (XIII) is represented by (XIII)

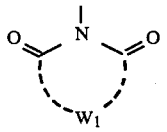

wherein $W_1$ represents a non-metallic atomic group forming a 4- to 6-membered ring together with the moiety

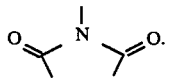

Of the groups represented by formula (XIII), preferred are those represented by formulae (XIV) to (XVI).

Formula (XIV) is represented by (XIV)

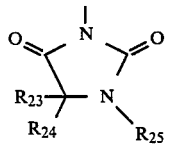

wherein $R_{23}$ and $R_{24}$ each represents a hydrogen atom, an alkyl gorup, an aryl group, an alkoxy group, a sulfonamido group, a sulfamoyl group, a carboxyl group, an aryloxy group, or a hydroxyl group; and $R_{25}$ represents a hydrogen atom, an alkyl group, an aryl gorup, an aralkyl group, or an acyl group.

Formula (XV) is represented by (XV)

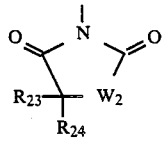

wherein $R_{23}$ and $R_{24}$ are as defined above; and $W_2$ represents an oxygen atom or a sulfur atom.

Formula (XVI) is represented by (XVI)

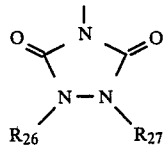

wherein $R_{26}$ and $R_{27}$ each represents a hydrogen atom, an alkyl group, an aryl group, an aralkyl group, or an acyl group, The cyan couplers of formulas (I) and (II) can be synthesized by known methods, such as the methods described in U.S. Pat. Nos. 2,423,730 and 3,772,002 for the cyan couplers of formula (I), and the methods described in U.S. Pat. Nos. 2,895,826, 4,333,999, and 4,327,173 for the cyan couplers of formula (II).

The magenta couplers of formula (III) can be synthesized by the methods described, e.g., in Japanese patent application (OPI) Nos. 74027/74 and 74028/74, Japanese Patent Publication Nos. 27930/73 and 33846/78, and U.S. Pat. No. 3,519,429. The magneta couplers of formulae (IV-1), (IV-2), (IV-3), and (IV-4) can be synthesized by the methods described in Japanese patent application (OPI) No. 162548/84. U.S. Pat. No. 3,725,067, Japanese patent application (OPI) No. 171956/84, and Japanese patent application (OPI) No. 33552/85, respectively.

The yellow couplers of formula (V) can by synthesized by the methods described, e.g., in Japanese patent application (OPI) No. 48541/79, Japanese Patent Publication No. 10739/83, U.S. Pat. No. 4,326,024, *Research Disclosure,* No. 18053, etc.

Preferred examples of the above-described cyan couplers of formulae (I) and (II); magenta couplers of formulae (III) and (IV); and yellow couplers of formula (V) are shown below for illustrative purposes only, with compound numbers headed by C for cyan couplers, M for magenta couplers, and Y for yellow couplers:

(C-1)

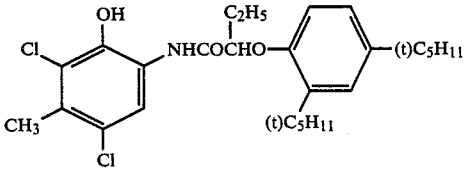

(C-2)

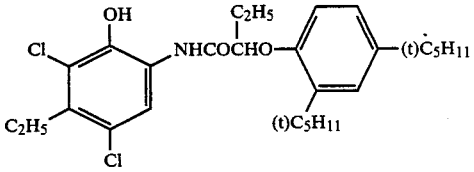

-continued
(C-3)
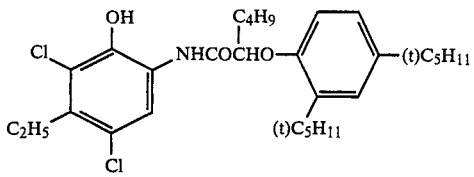
(C-4)
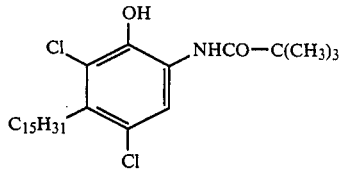
(C-5)
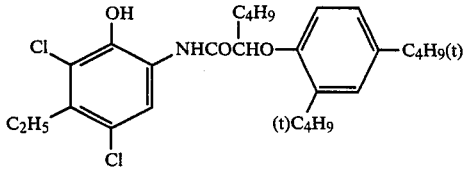
(C-6)
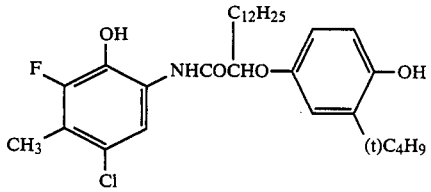
(C-7)
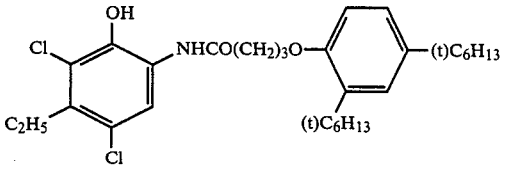
(C-8)
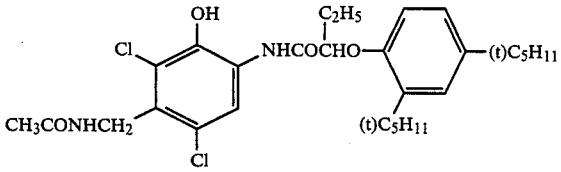
(C-9)
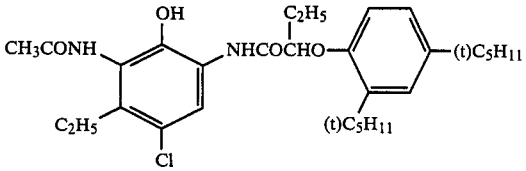
(C-10)
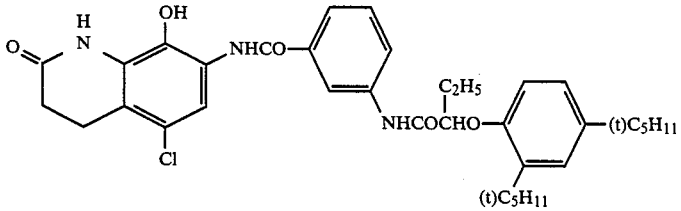
(C-11)
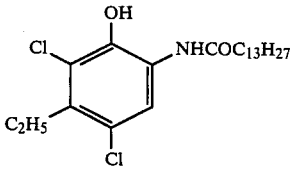
(C-12)
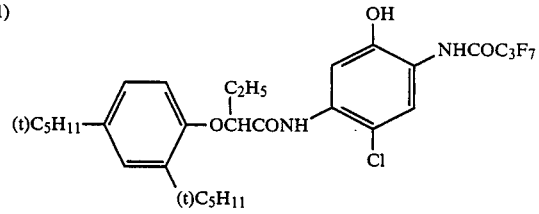
(C-13)
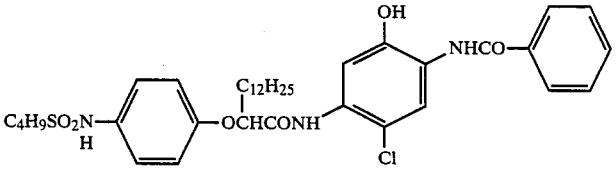

-continued
(C-14)
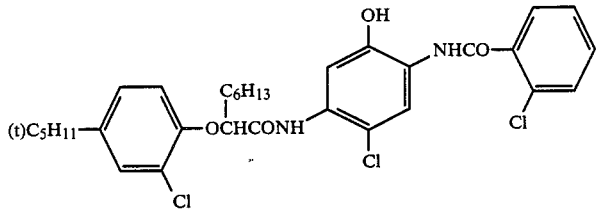
(C-15)
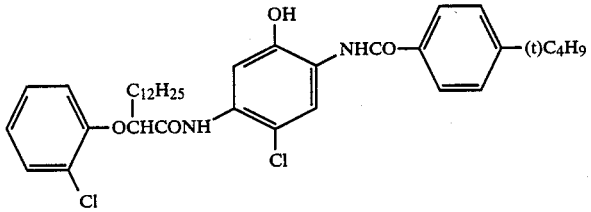
(C-16)
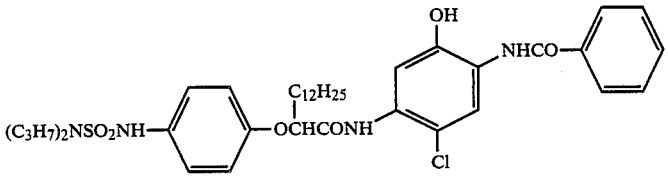
(C-17)
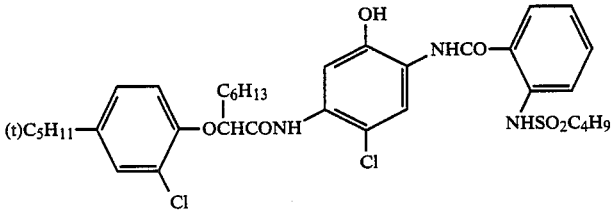
(C-18)
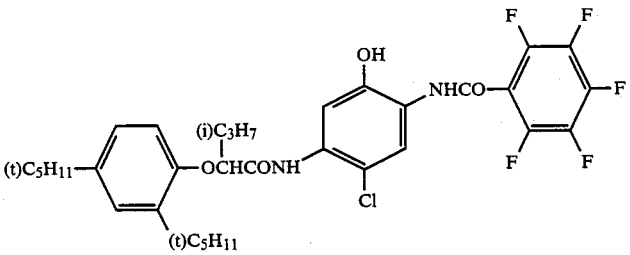
(C-19)
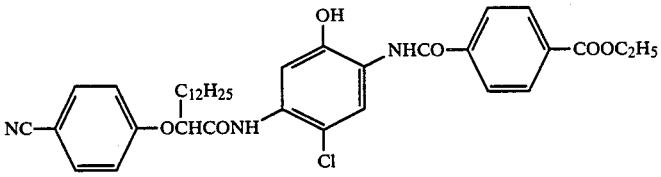
(C-20)
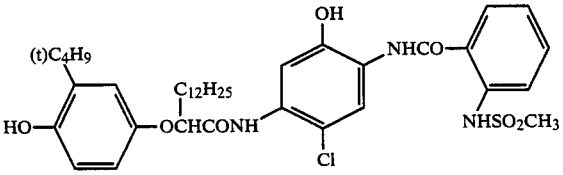

-continued
(C-21)
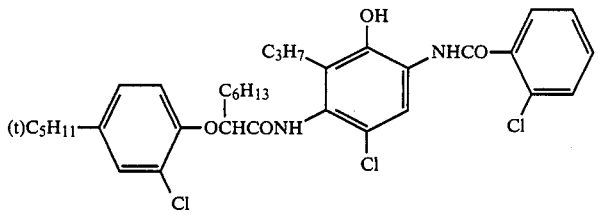
(C-22)
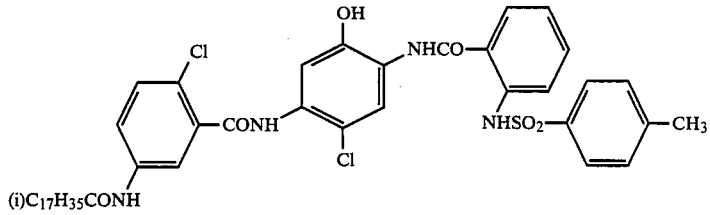
(C-23)
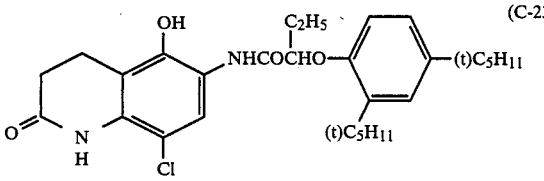
(C-24)
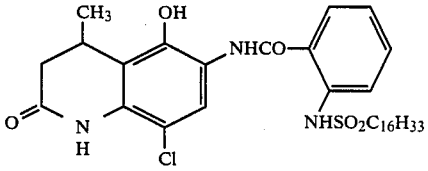
(C-25)
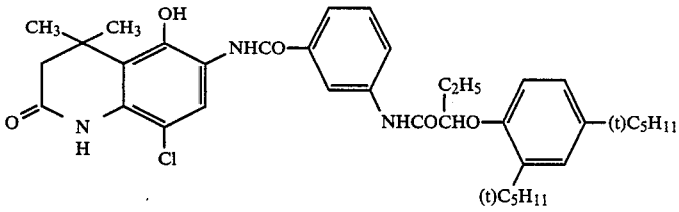
(C-26)
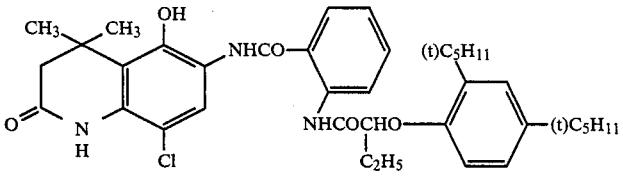
(C-27)
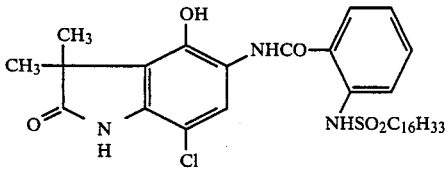
(C-28)
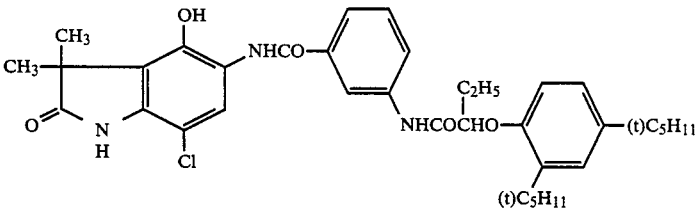
(C-29)
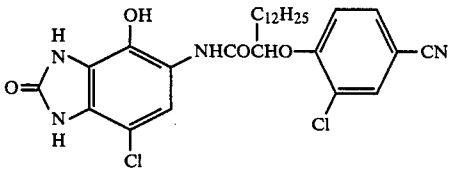
(C-30)
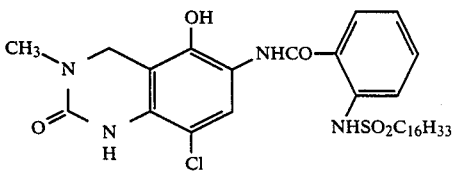

-continued
(C-31)
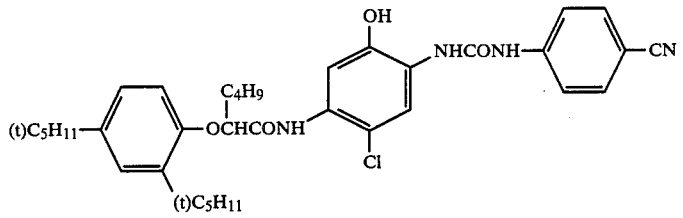
(C-32)
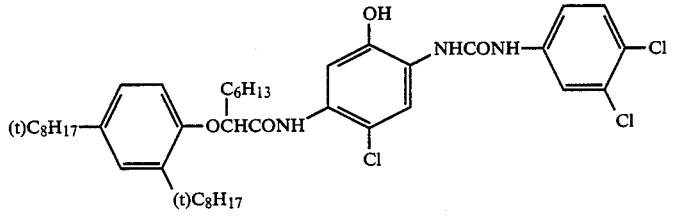
(C-33)
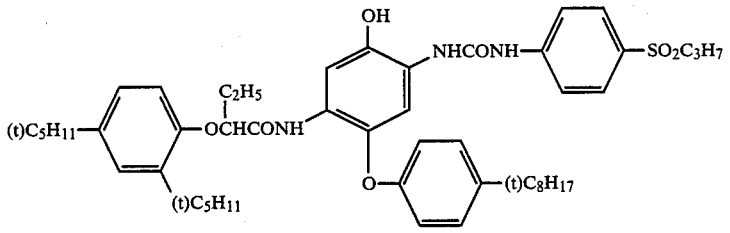
(C-34)
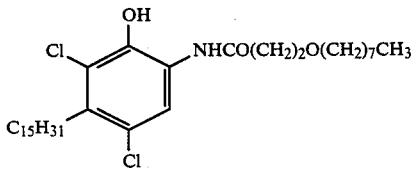
(C-35)
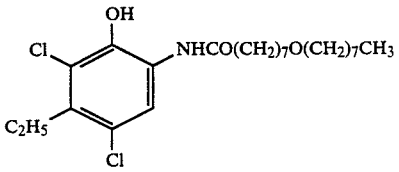
(C-36)
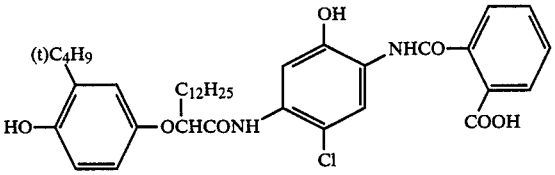
(C-37)
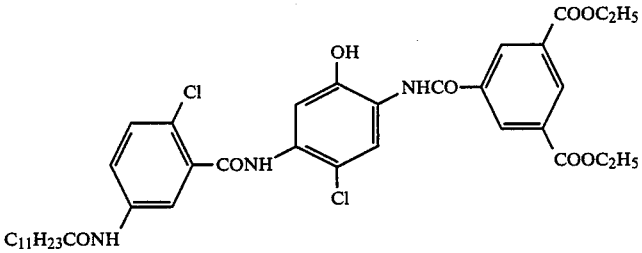
(C-38)
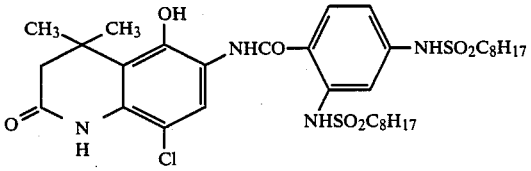

-continued
(C-39)
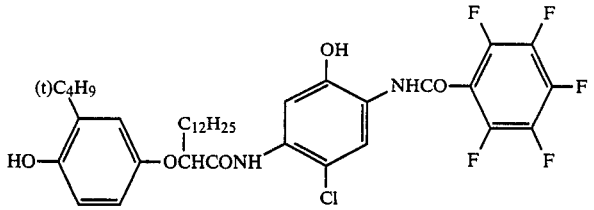
(C-40)
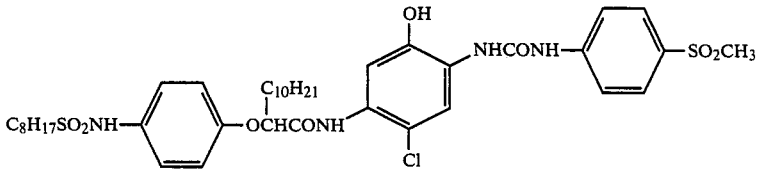
(M-1)
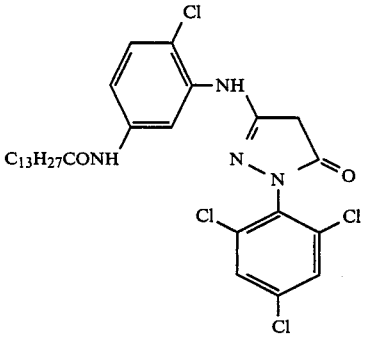
(M-2)
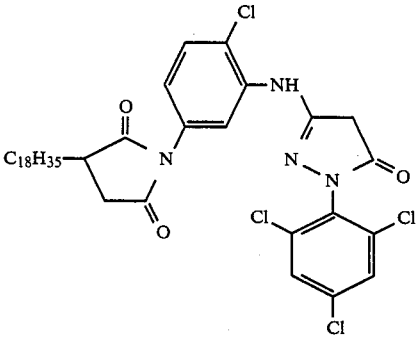
(M-3)
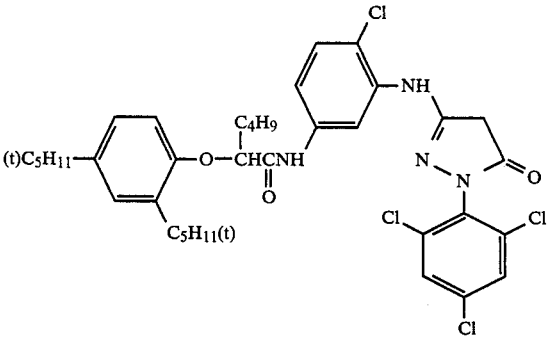

-continued
(M-4)
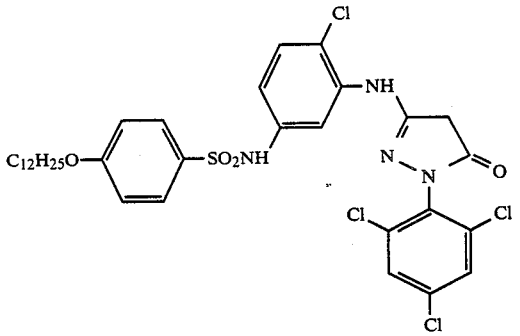
(M-5)
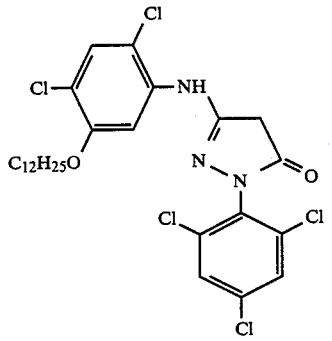
(M-6)
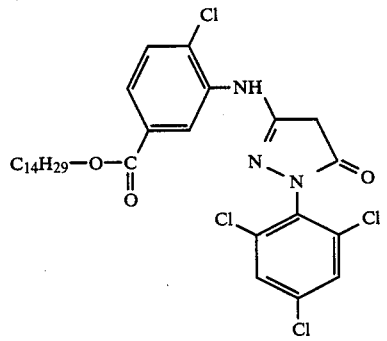
(M-7)
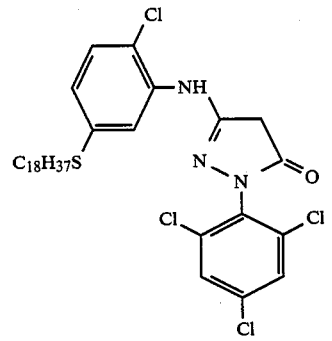
(M-8)
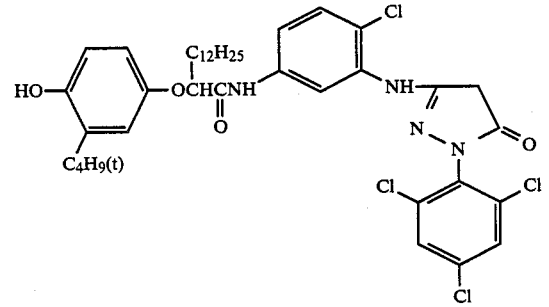

-continued
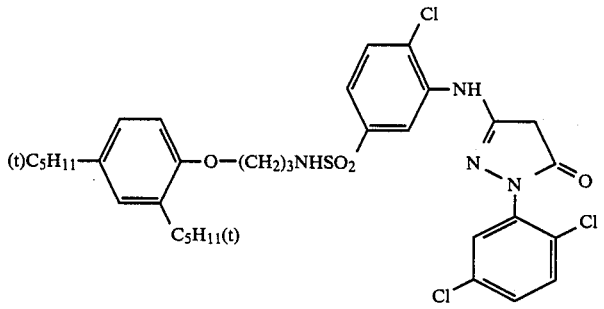
(M-9)
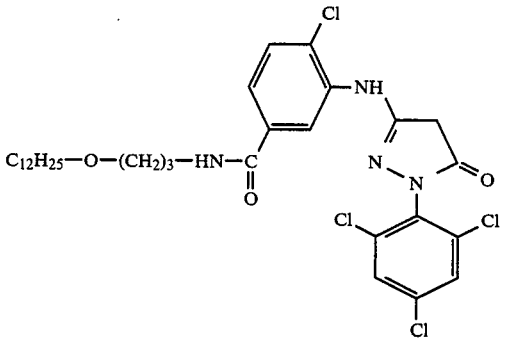
(M-10)
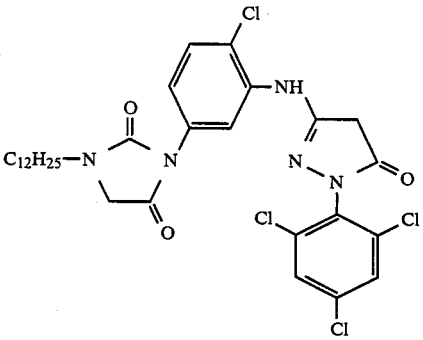
(M-11)
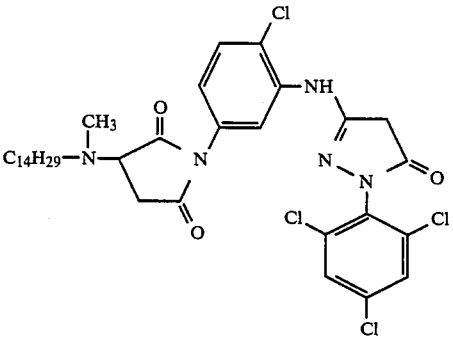
(M-12)

-continued
(M-13)
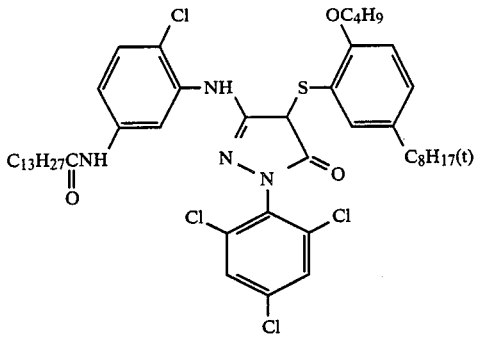
(M-14)
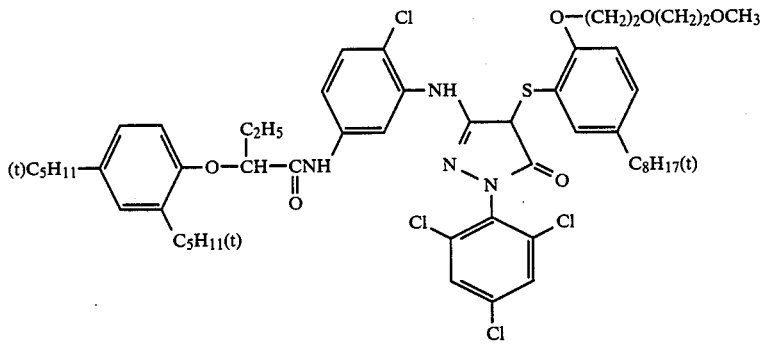
(M-15)
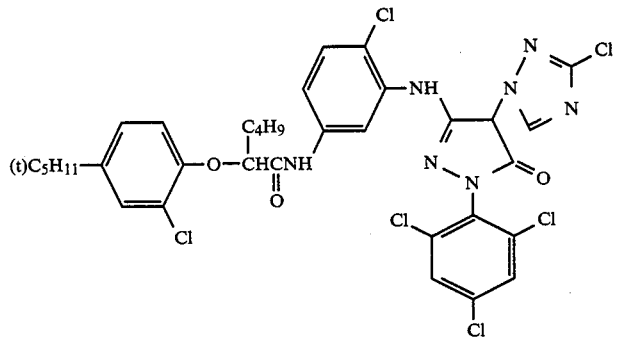
(M-16)
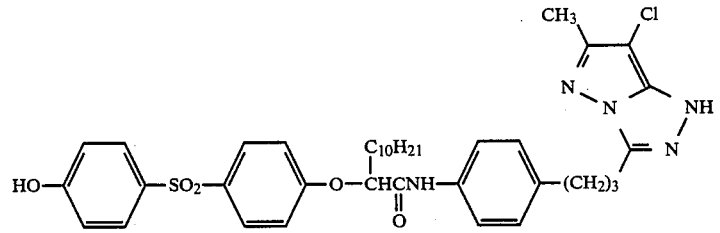
(M-17)
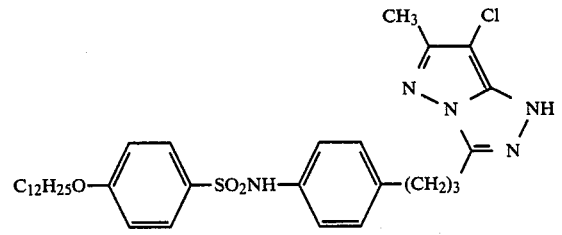

-continued
(M-18)
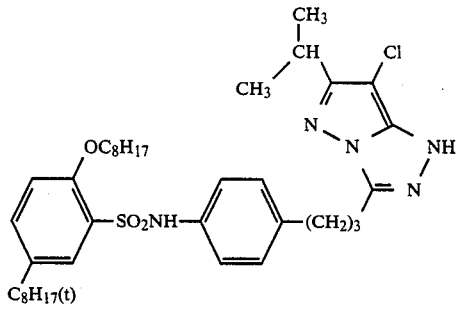
(M-19)
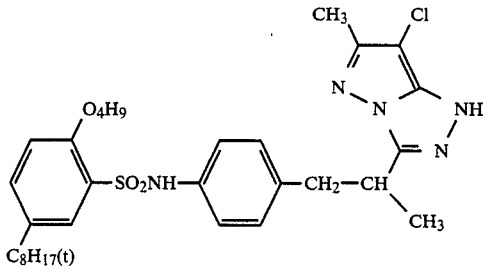
(M-20)
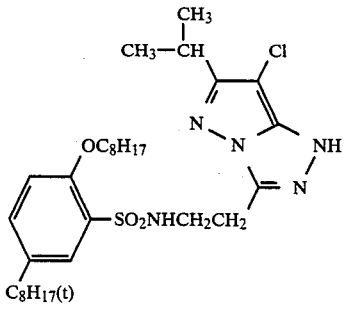
(M-21)
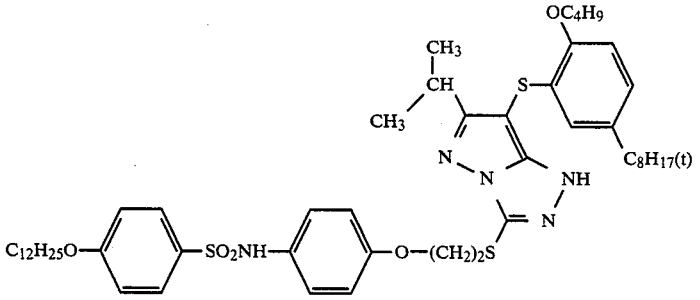
(M-22)
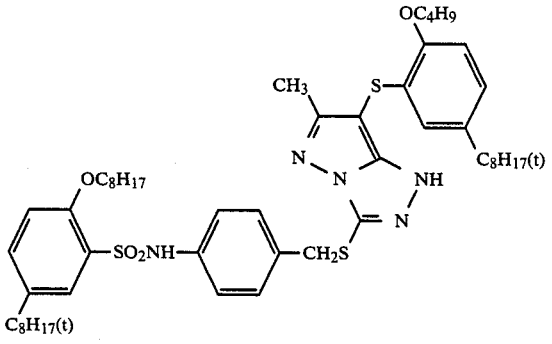

-continued
(M-23)
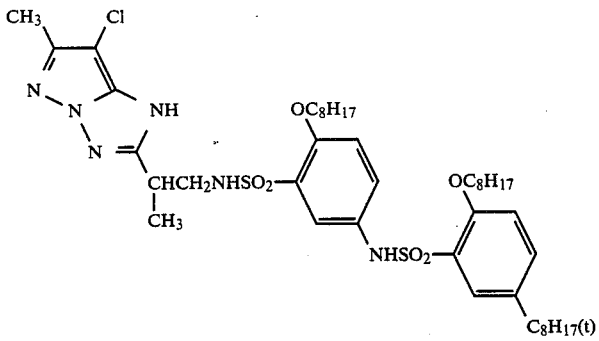
(M-24)
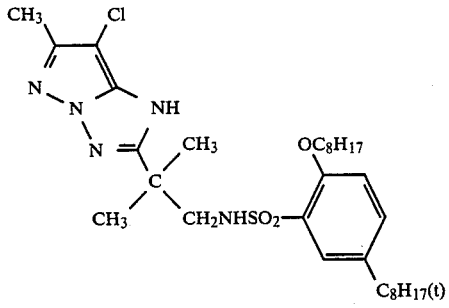
(M-25)
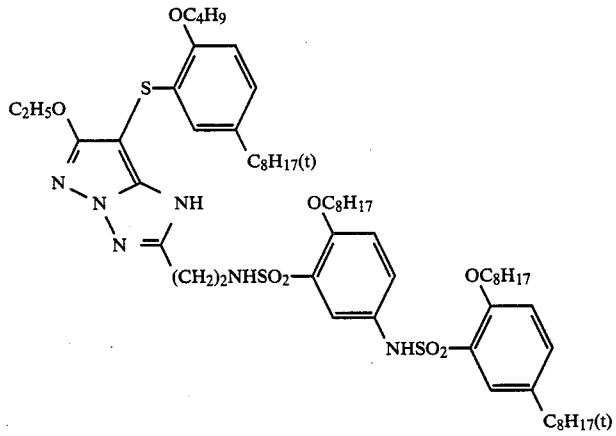
(M-26)
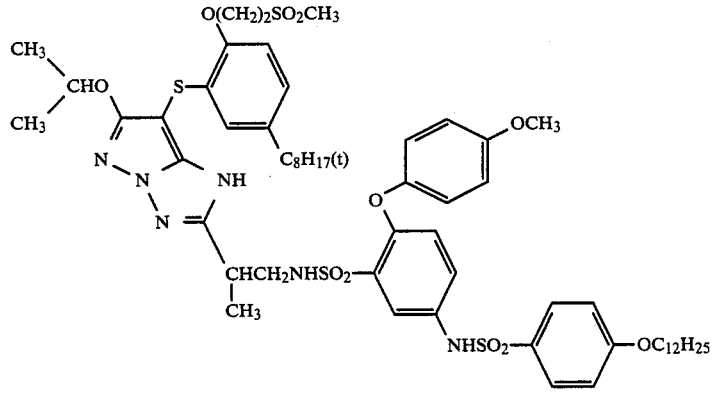

-continued
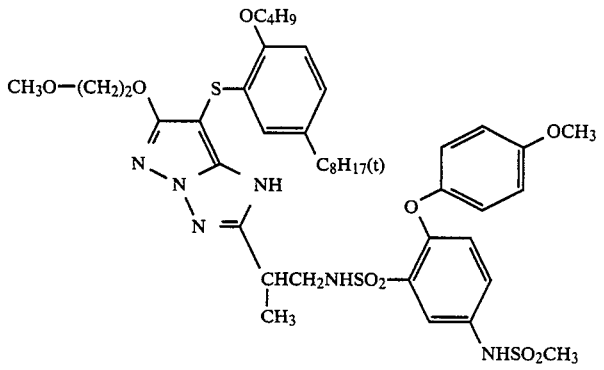
(M-27)
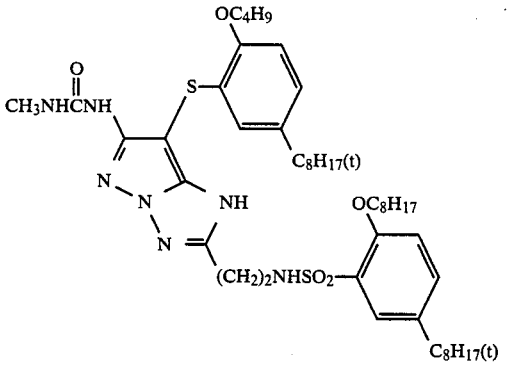
(M-28)
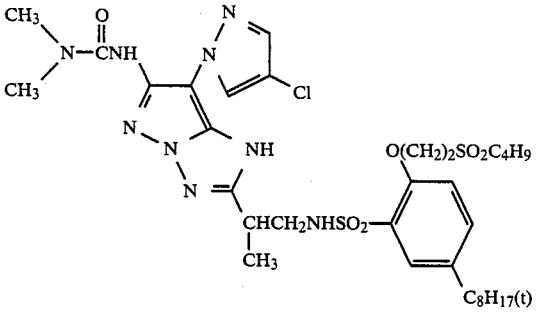
(M-29)
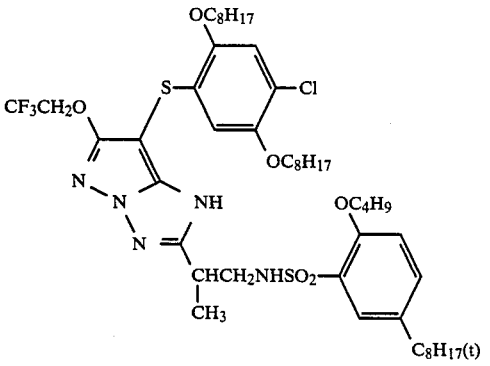
(M-30)

-continued
(M-31)
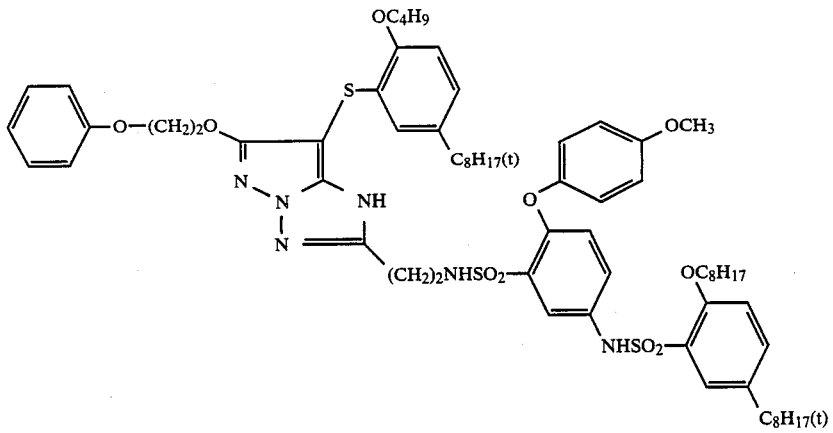
(M-32)
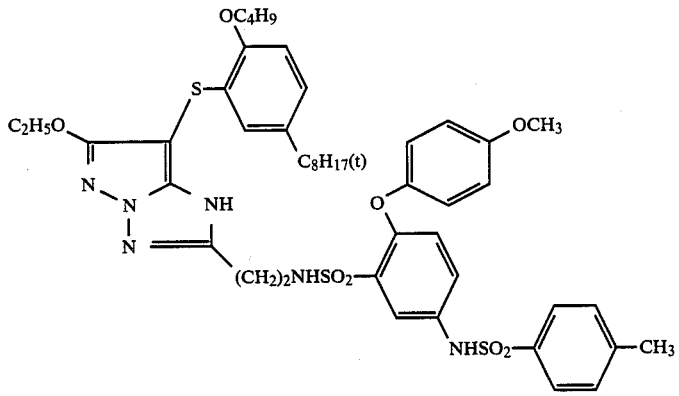
(M-33)
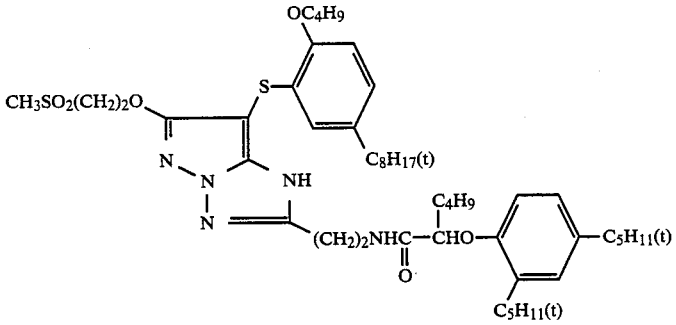
(M-34)
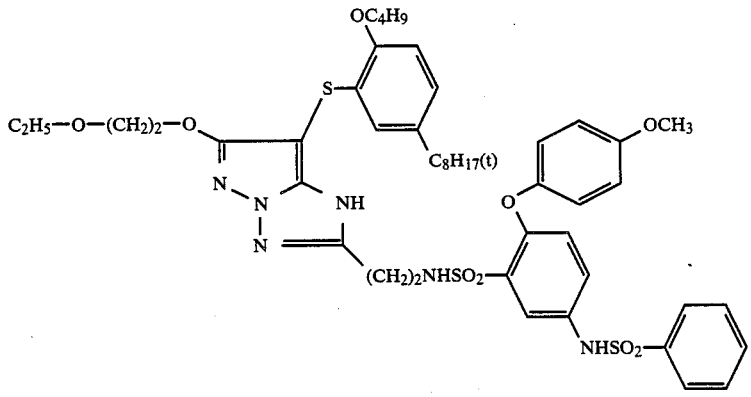

-continued
(M-35)
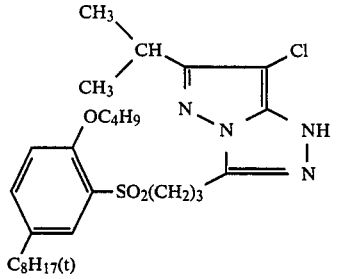
(M-36)
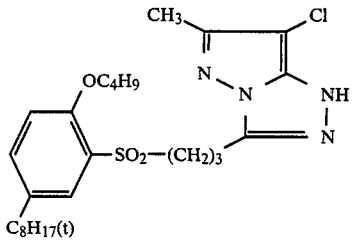
(M-37)
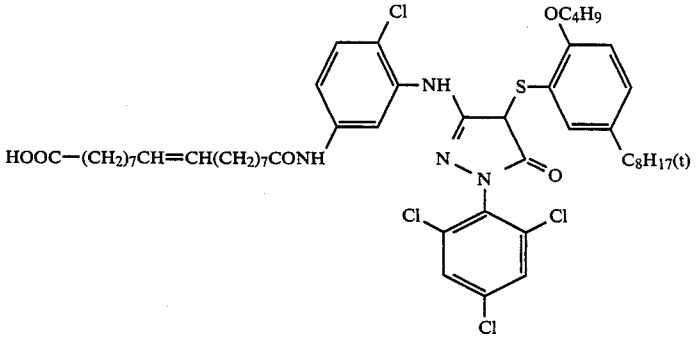
(M-38)
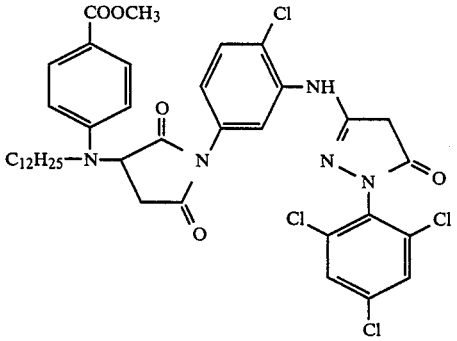
(M-39)
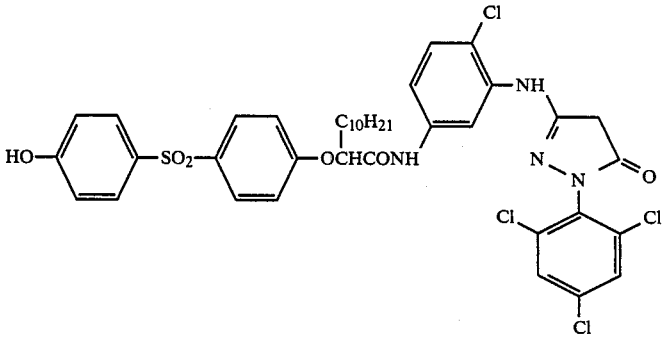

-continued
(M-40)
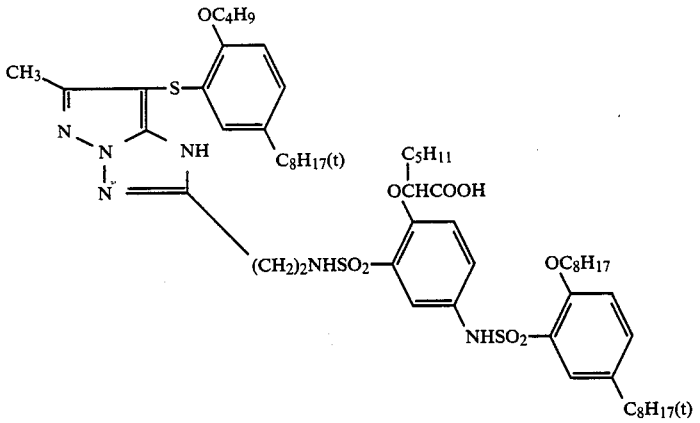
(M-41)
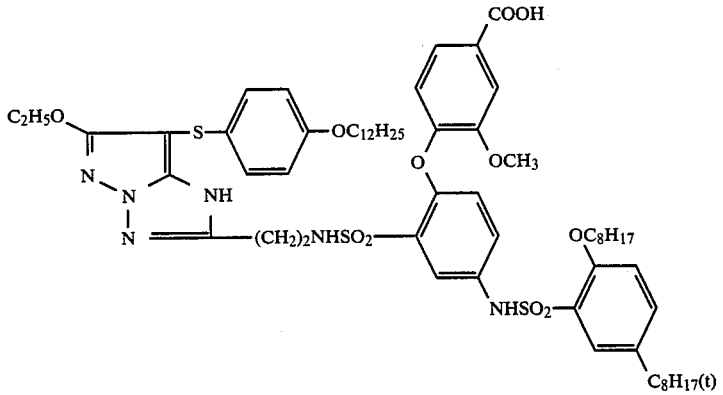
(M-42)
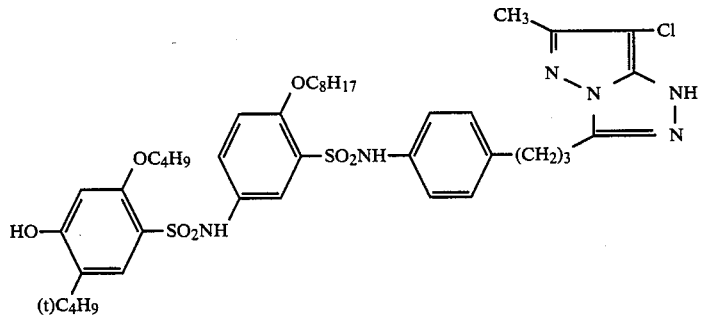
(Y-1)
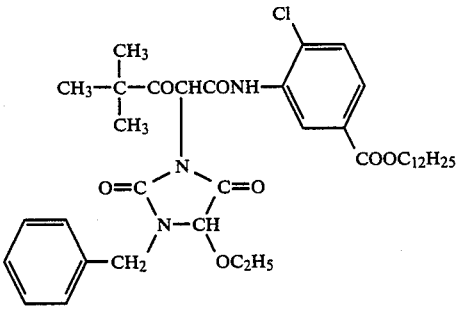

-continued
(Y-2)
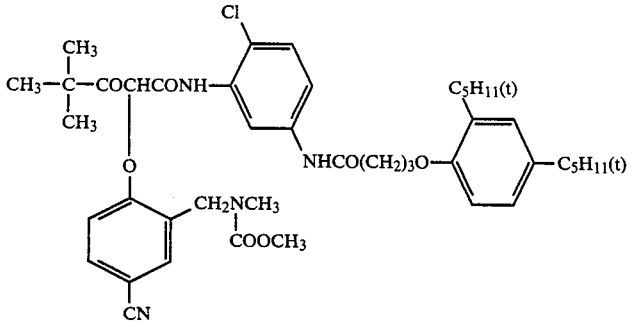
(Y-3)
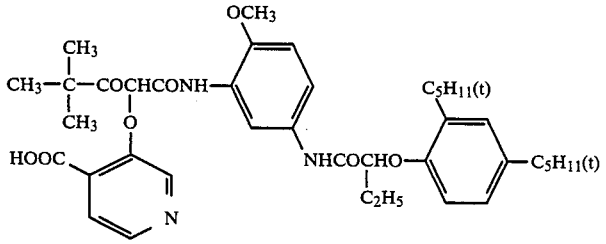
(Y-4)
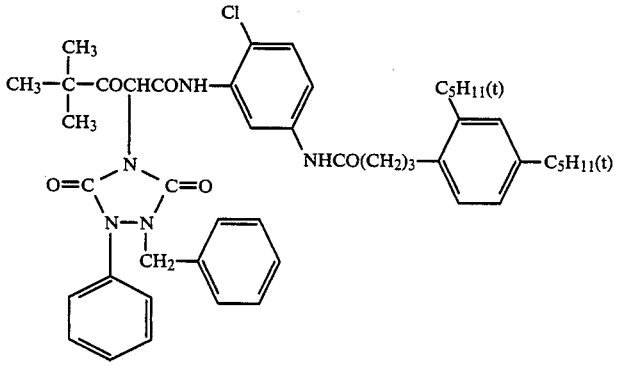
(Y-5)
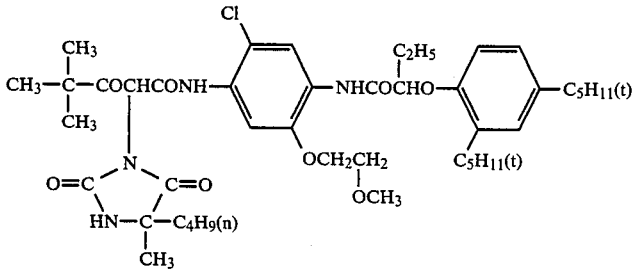
(Y-6)
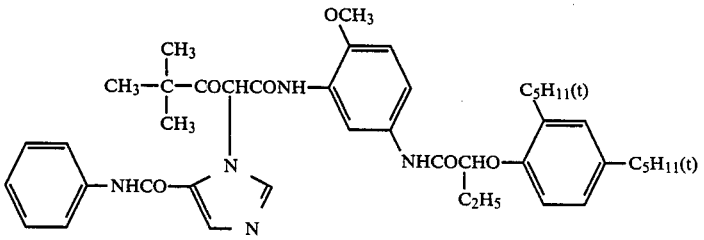

-continued
(Y-7)
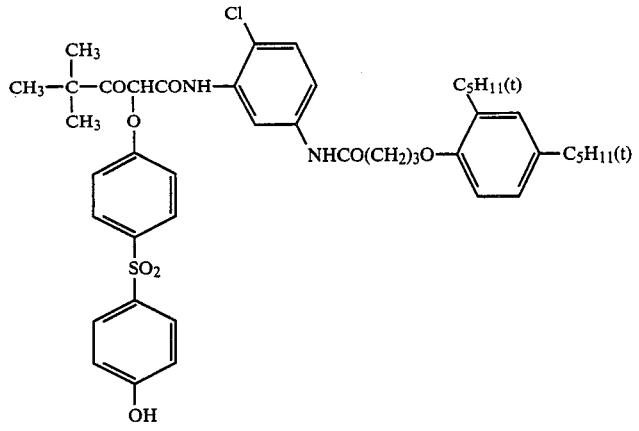
(Y-8)
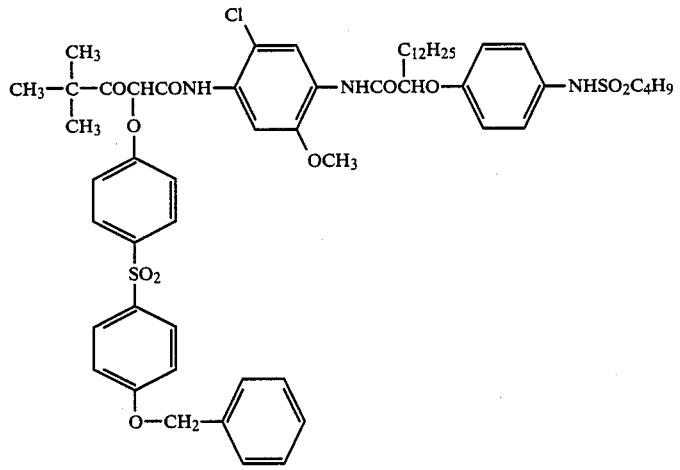
(Y-9)
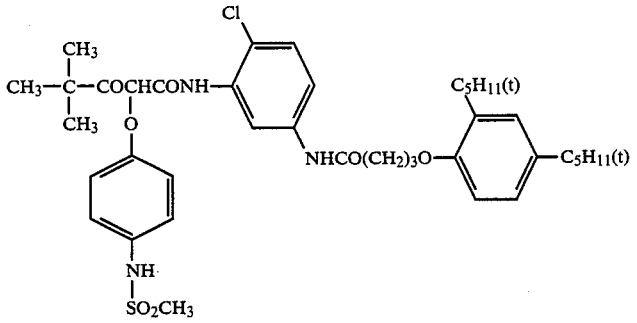
(Y-10)
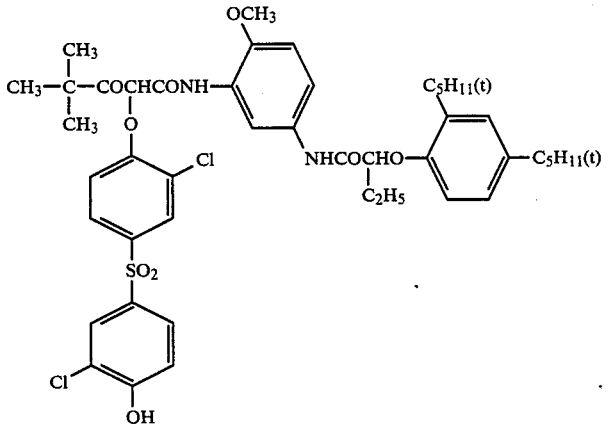

-continued
(Y-11)
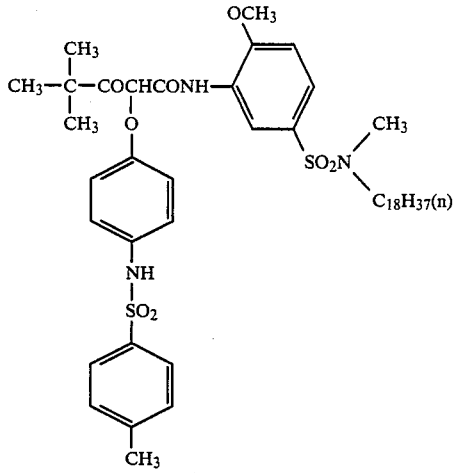
(Y-12)
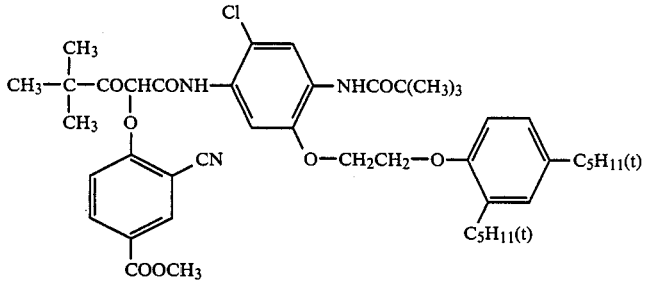
(Y-13)
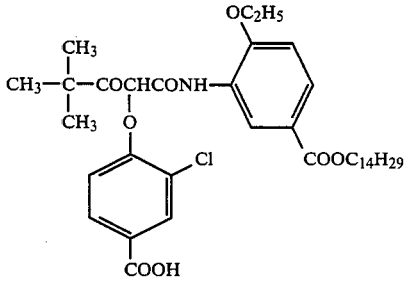
(Y-14)
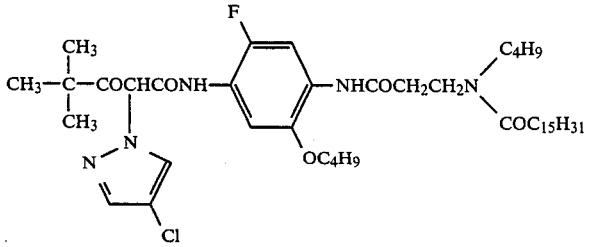
(Y-15)
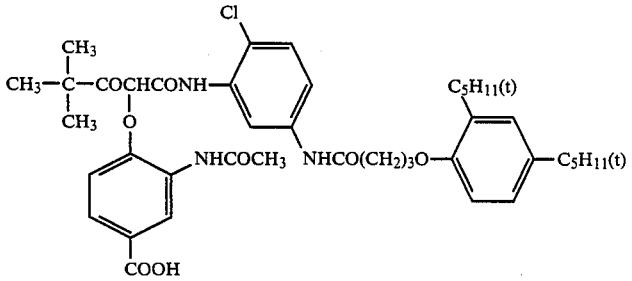

-continued
(Y-16)
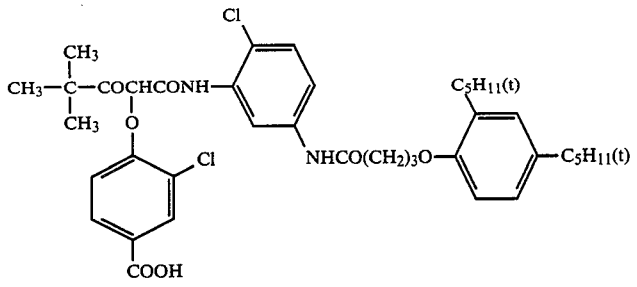
(Y-17)
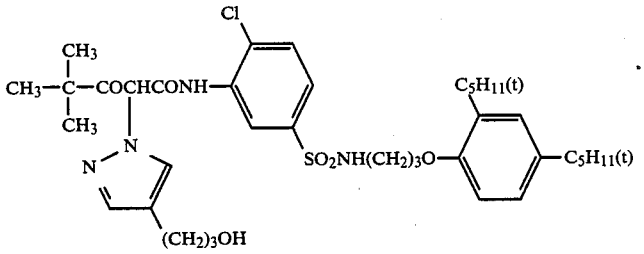
(Y-18)
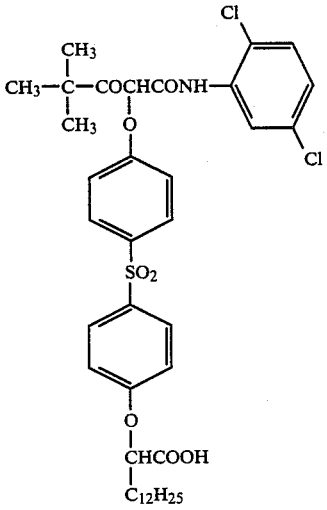
(Y-19)
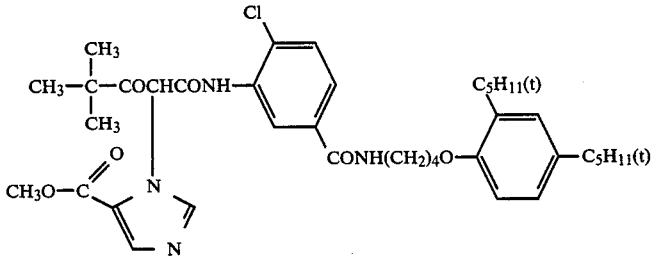
(Y-20)
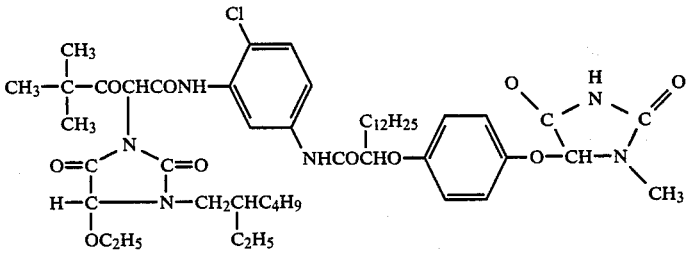

-continued
(Y-21)
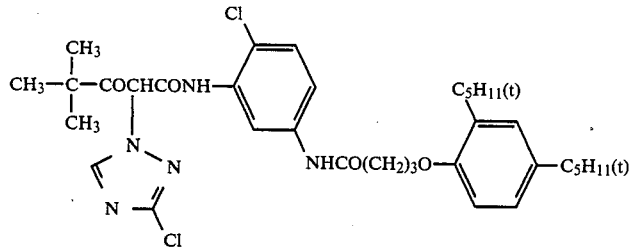
(Y-22)
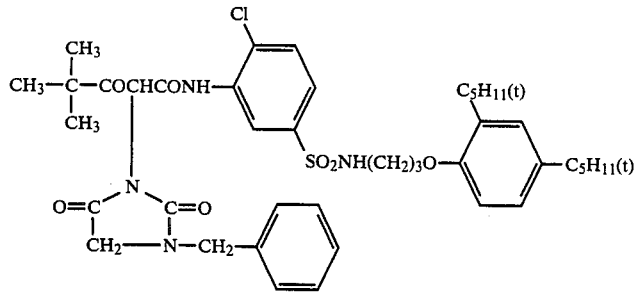
(Y-23)
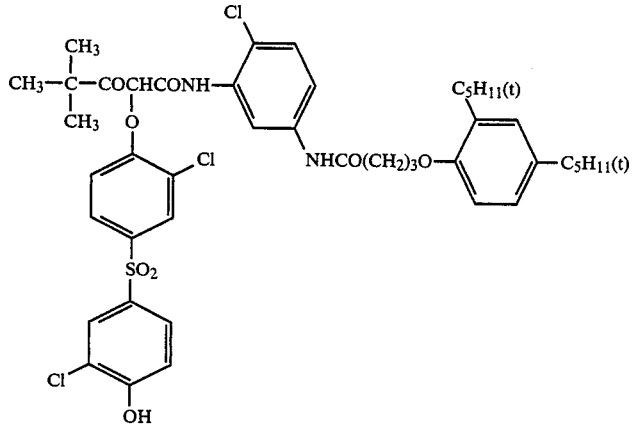
(Y-24)
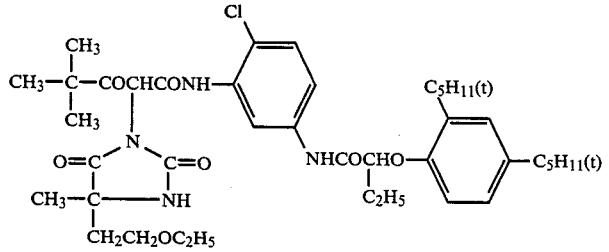
(Y-25)
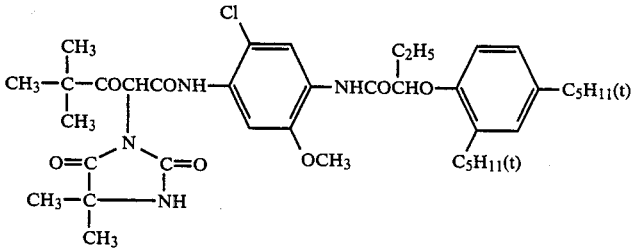

-continued
(Y-26)
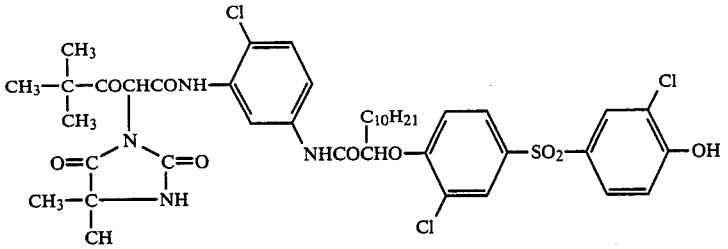
(Y-27)
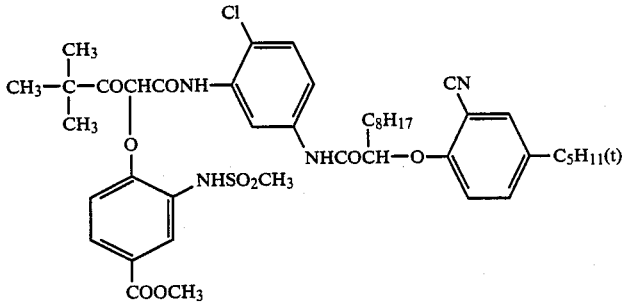
(Y-28)
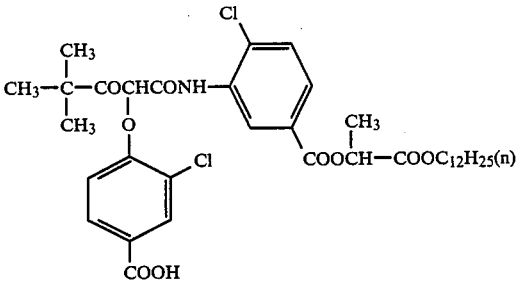
(Y-29)
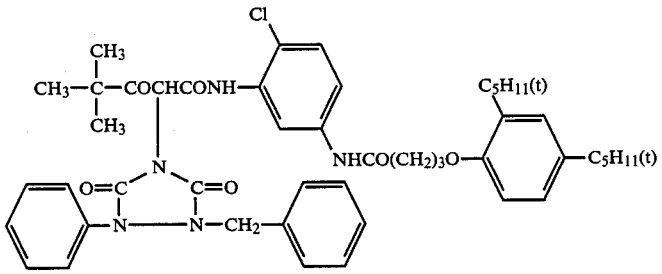
(Y-30)
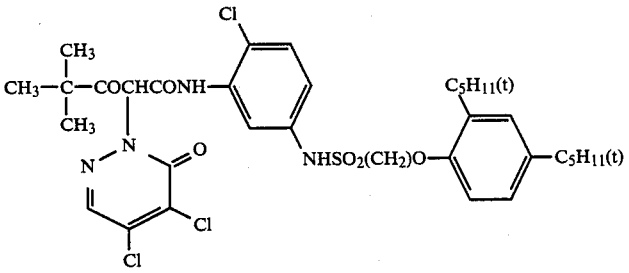
(Y-31)
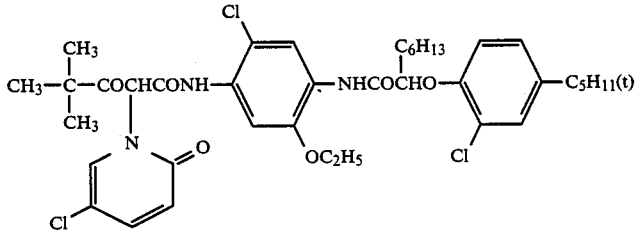

-continued
(Y-32)
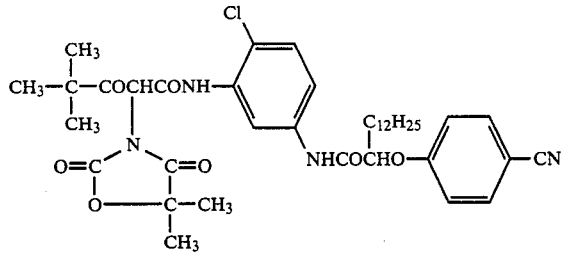
(Y-33)
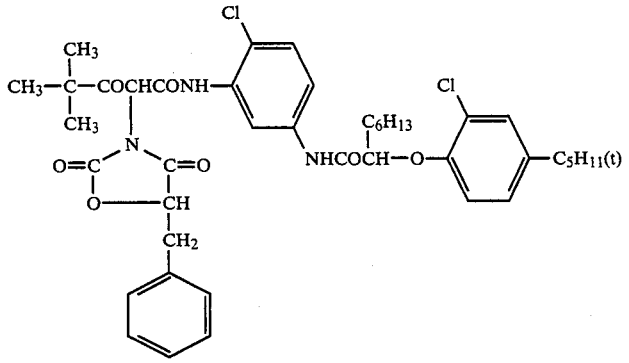
(Y-34)
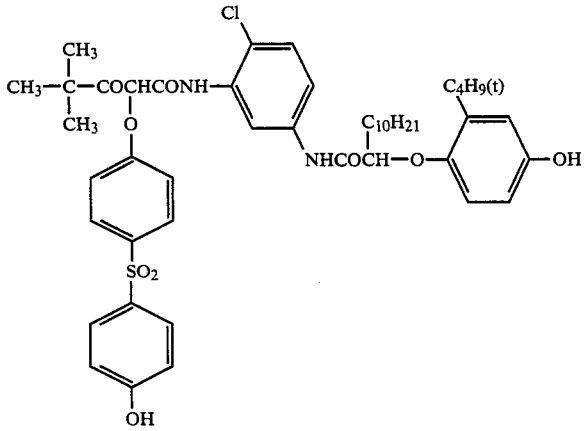
(Y-35)
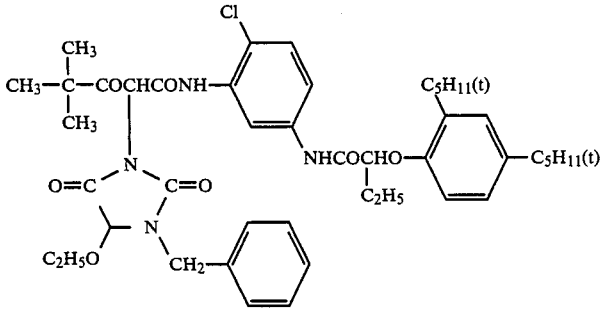
(Y-36)
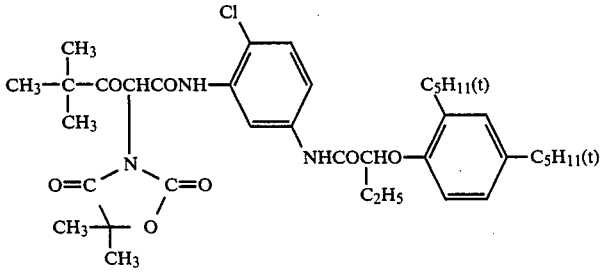

-continued
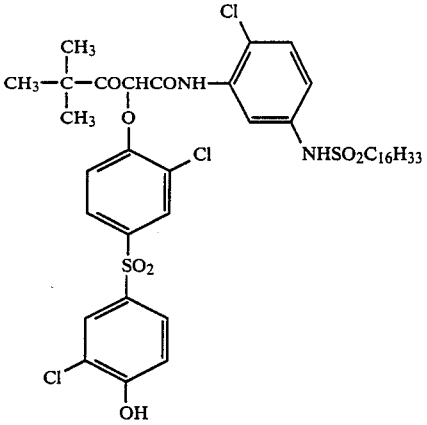
(Y-37)
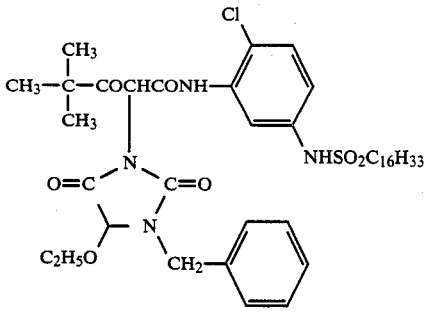
(Y-38)
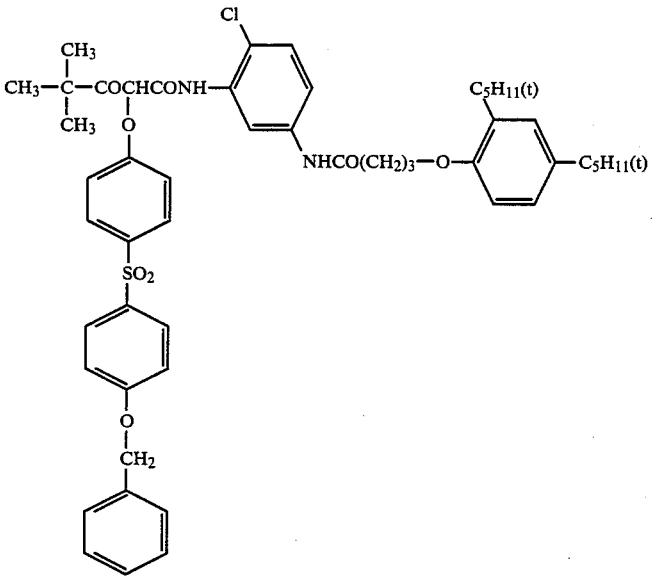
(Y-39)
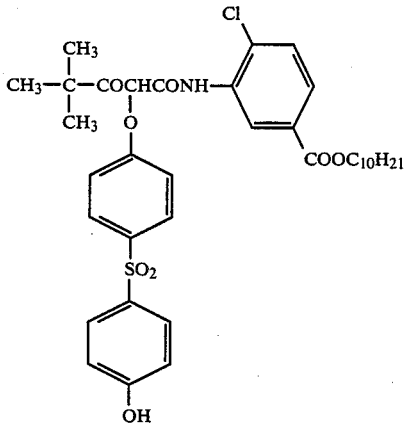
(Y-40)
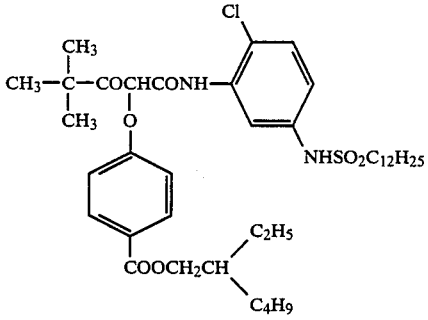
(Y-41)

-continued
(Y-42)
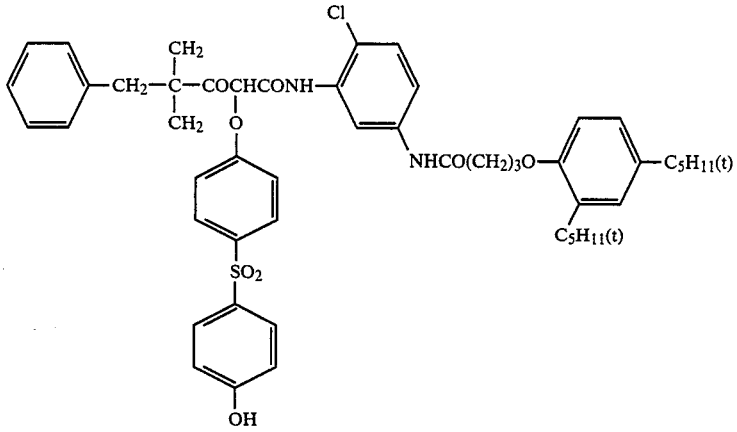
(Y-43)
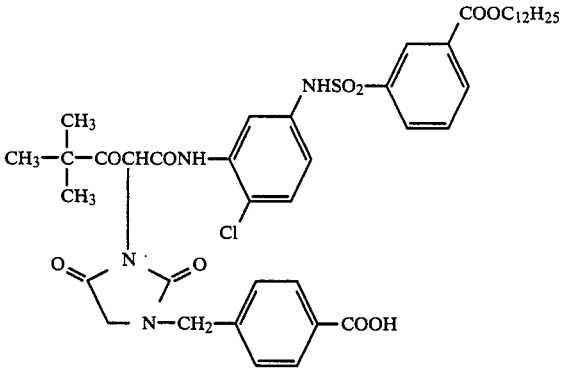
(Y-44)
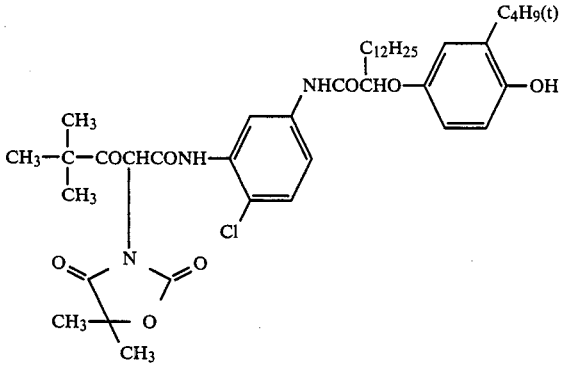
(Y-45)
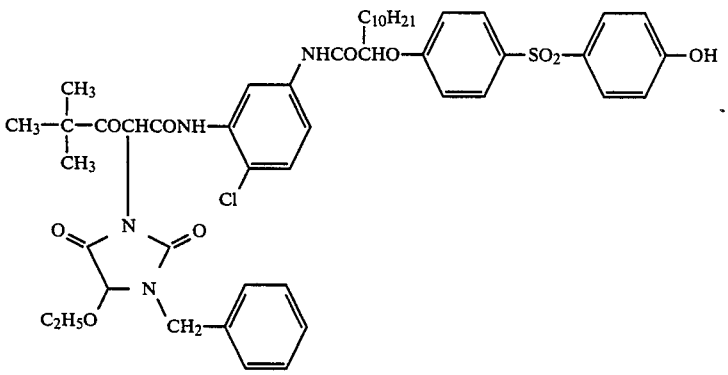

-continued

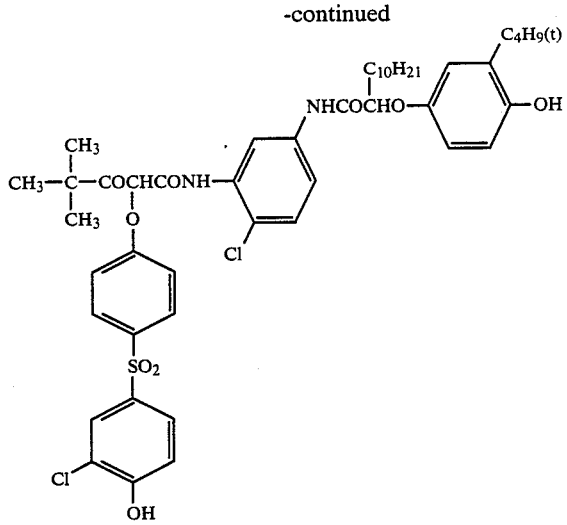

(Y-46)

Incorporation of the couplers according to the present invention into emulsion layers is preferably carried out by dissolving the coupler in a high-boiling organic solvent and/or a low-boiling organic solvent, dispersing the coupler solution in an aqueous solution of gelatin or other hydrophilic colloid in a homogenizer at a high speed of stirring, and adding the dispersion to an emulsion layer. In order to ensure improvements in color developability, it is particularly preferable to use at least one of high-boiling organic solvents represented by the above-described formulae (A), (B), (C), (D), and (E) and having a dielectric constant of 4.00 or more at 25° C. It is also preferable to disperse the coupler solution in the presence of an anionic or nonionic surface active agent. Examples of such surface active agents to be used include anionic surface active agents having at least a sulfonic group and a long-chain aliphatic group. More specifically,

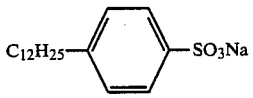

and

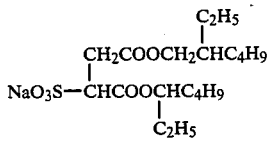

are preferably
used independently or in combination.

In formulae (A) to (E), substituents for the alkyl, cycloalkyl alkenyl, aryl, and heterocyclic group as represented by $W_1$, $W_2$, and $W_3$ include linking groups composed of one or more groups selected from

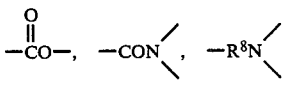

wherein $R^8$ represents a di- to hexavalent group obtained by removing a hydrogen atom from a phenyl group, and —O—.

The alkyl group as represented by $W_1$, $W_2$, $W_3$, or $W_4$ may be either straight chain or branched chain alkyl groups, including a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, etc.

Substituents acceptable for these alkyl groups include a halogen atom, a cycloalkyl group, an aryl group, and an ester group. Specific examples of the substituted alkyl group are halogen (F, Cl, Br)-substituted alkyl groups (e.g., $-C_2HF_4$, $-C_5H_3F_8$, $-C_9H_3F_{16}$, $-C_2H_4Cl$, $-C_3H_6Cl$, $-C_3H_5Cl_2$, $-C_3H_5ClBr$, $-C_3H_5Br_2$, etc.), cycloalkyl-substituted alkyl groups (e.g.,

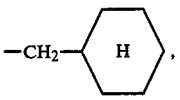

etc.), aryl-substituted alkyl groups (e.g.,

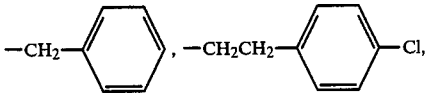

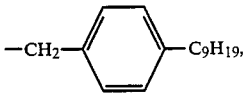

etc.), substituents forming dibasic acid esters (e.g.,

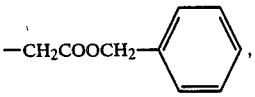

$-CH_2CH_2COOC_{12}H_{25}$, $-(CH_2)_4COOCH_2(CF_2)_4H$, $-(CH_2)_7COOC_4H_9$, $-(CH_2)_8COOC_4H_9$, etc.), substituents forming lactic esters, etc. (e.g.,

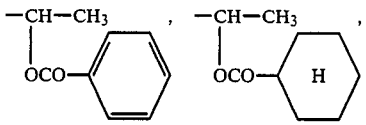

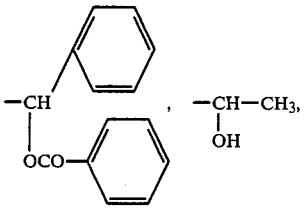

etc.), substituents forming citric esters, etc. (e.g.,

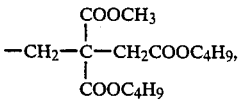

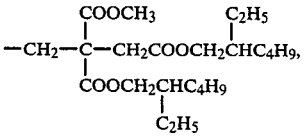

etc.), substituents forming malic esters, etc. (e.g., $-CH_2CH(OH)-COOC_6H_{13}$, etc.), substituents forming tartaric esters, etc. (e.g., $-CH(OH)CH(OH)COOC_8H_{17}$,

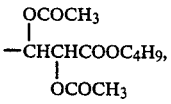

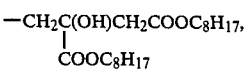

etc.), and the like.

In the formula (E), the condensed ring formed by $W_1$ and $W_2$ includes an oxirane ring, an oxorane ring, and an oxane ring.

The cycloalkyl group as represented by $W_1$, $W_2$, $W_3$, or $W_4$ includes

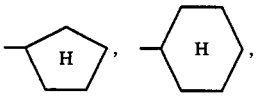

etc. The substituted cyclohexyl group as represented by $W_1$, $W_2$, $W_3$, or $W_4$ includes

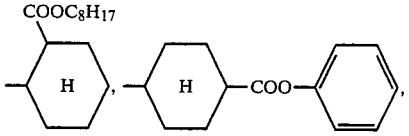

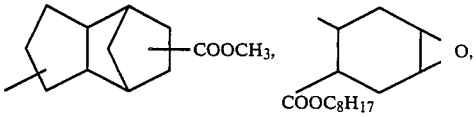

etc.

The aryl group as represented by $W_1$, $W_2$, $W_3$, or $W_4$ includes

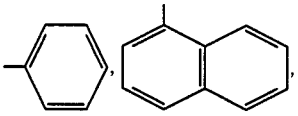

etc., and the substituted aryl group includes

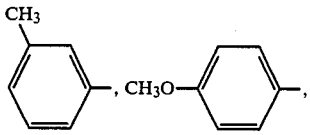

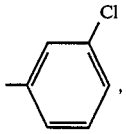

a substituted benzoic ester group, e.g.,

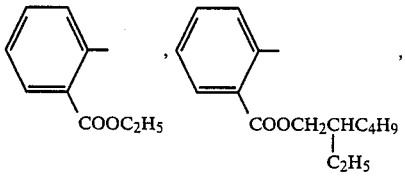

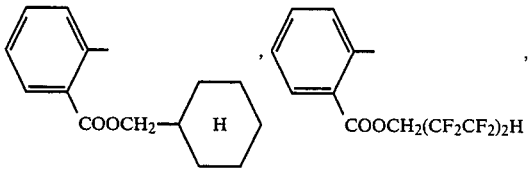

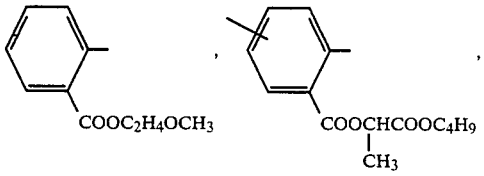

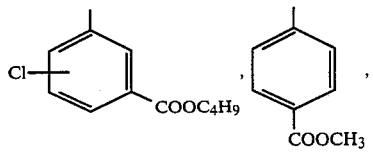

etc., a phthalic ester group, e.g.,

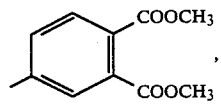

etc., an isophthalic ester group, a terephthalic ester group, a trimellitic ester group, etc.

The alkenyl group includes $-C_4H_7$, $-C_5H_9$, $-C_6H_{11}$, $-C_7H_{13}$, $-C_8-H_{15}$, $-C_{10}H_{19}$, $-C_{12}H_{23}$, $-C_{18}H_{35}$, etc., and the substituted alkenyl group includes an alkenyl group substituted with a halogen atom (e.g., F, Cl, Br, etc.), $-OC_8H_{17}$, $-OC_{12}H_{25}$,

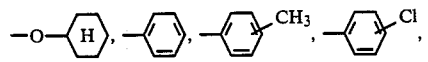

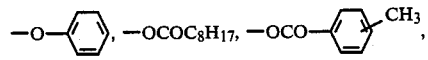

$-C_8H_{15}$, $-C_{12}H_{23}$, etc., $-CH=CH-COOCH_2CHC_4H_9$,

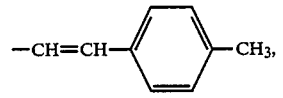

etc.

The heterocyclic group as represented by $W_1$, $W_2$, $W_3$, or $W_4$ includes

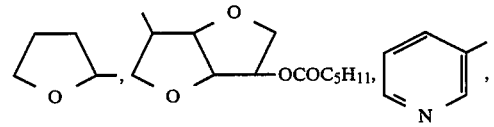

etc.

The high-boiling organic solvents which can be preferably used in the invention are those of formulae (A) to (E), more preferably those in which a total number of carbon atoms contained in $W_1$, $W_2$, $W_3$, and $W_4$ is about 8 or more, and having a dielectric constant of 4.00 or more, and more preferably 5.0 or more, at 25° C., and a viscosity of 20 cp or more at 25° C. By using high-boiling organic solvents having a dielectric constant and a viscosity of the above ranges, color developability can be improved surprisingly without impairing other characteristics, such as absorption of developed dyes. The reasons therefor are not clear, but it would be surmised that high-boiling organic solvents having a high dielectric constant show a large takeup of a color developing agent and that those having a medium viscosity weaken some adverse influences of couplers in oil droplets upon silver halides.

The amount of the high-boiling organic solvent of formulae (A) to (E) to be used is arbitrarily selected depending on the kind and amount of couplers used. It is usually preferable that a weight ratio of the high-boiling organic solvent to the coupler is within a range of from 0.05 to 20.

The high-boiling organic solvents of formulae of (A) to (E) according to the present invention may be used individually or in combinations thereof or, if desired, in combination with other conventionally known high-boiling organic solvents. Examples of the known high-boiling organic sovlents to be used in combination include phosphoric esters, e.g., tricresyl phosphate, tri-2-ethylhexyl phosphate, 7-methyloctyl phosphate, tricyclohexyl phosphate, etc., phenolic solvents, e.g., 2,5-di-t-amylphenol, 2,5-di-sec-amylphenol, etc., and the like.

Specific but nonlimitative examples of the high-boiling organic solvents represented by formulae (A) to (E) are shown below:

$O=P(OC_4H_9-\underline{n})_3$ (S-1)

$O=P(OCH_2CH_2CH(CH_3)CH_3)_3$ (S-2)

$O=P(OC_6H_{13}-\underline{n})_3$ (S-3)

(S-4)

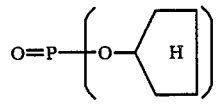

(S-5)

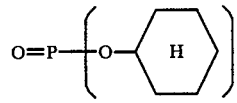

$O=P(OC_8H_{17}-\underline{n})_3$ (S-6)

(S-7)

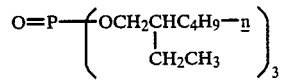

(S-8)

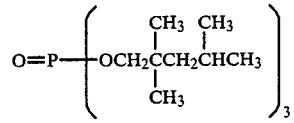

(S-9)

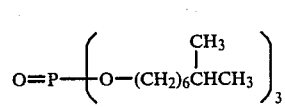

$O=P(OC_9H_{19}-\underline{n})_3$ (S-10)

(S-11)

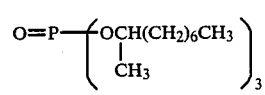

$O=P(OC_{10}H_{21}-\underline{n})_3$ (S-12)

-continued
(S-13)
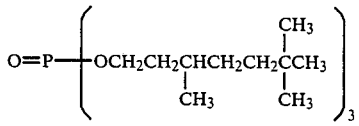
(S-14)
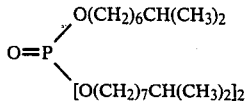
(S-15)
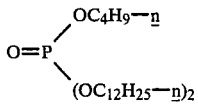
(S-16)
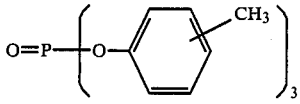
(S-17)
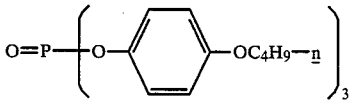
(S-18)
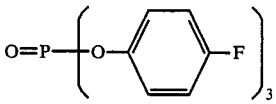
(S-19)
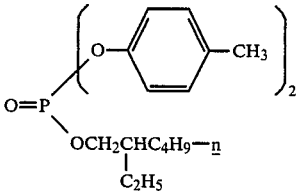
(S-20)
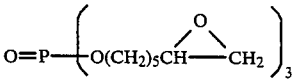
(S-21)
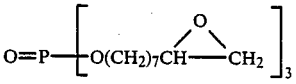
(S-22)
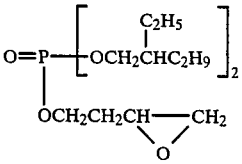
(S-23)
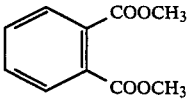
(S-24)
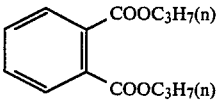
-continued
(S-25)
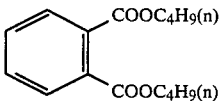
(S-26)
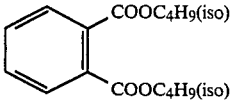
(S-27)
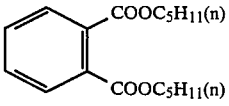
(S-28)
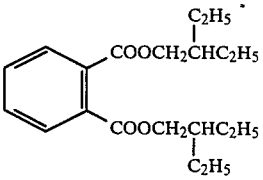
(S-29)
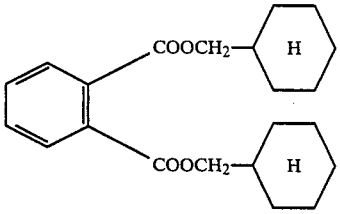
(S-30)
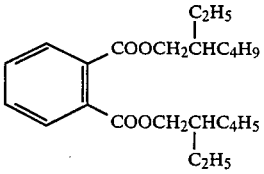
(S-31)
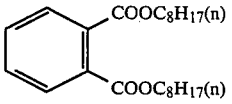
(S-32)
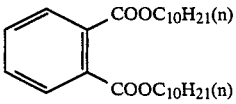
(S-33)
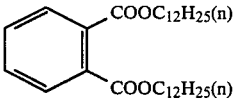
(S-34)
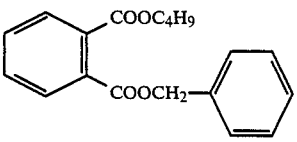
(S-35)
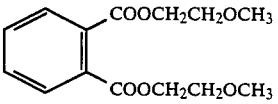

-continued
(S-36)
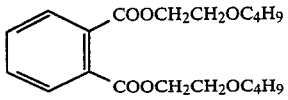
(S-37)
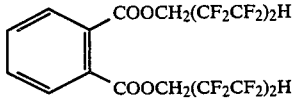
(S-38)
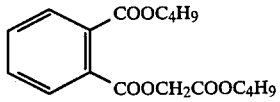
(S-39)
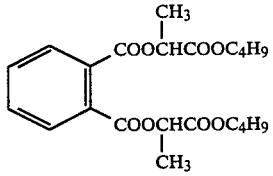
(S-40)
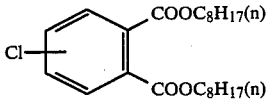
(S-41)
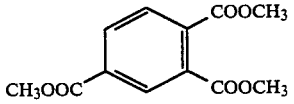
(S-42)
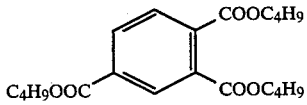
(S-43)
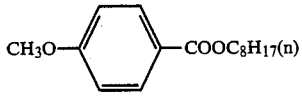
(S-44)
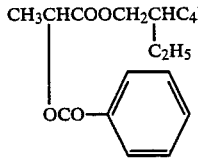
(S-45)
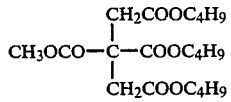
(S-46)
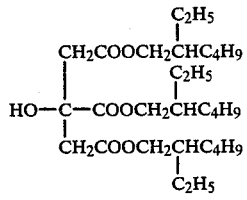
(S-47)
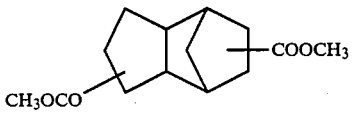
-continued
(S-48)
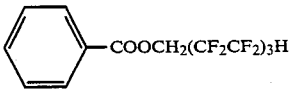
(S-49)
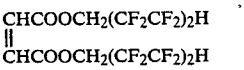
(S-50)
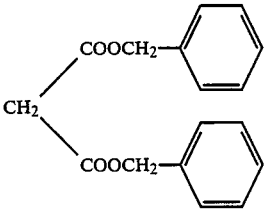
(S-51)
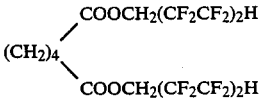
(S-52)
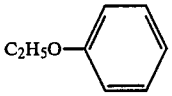
(S-53)
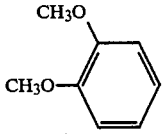
(S-54)
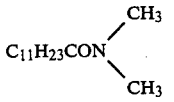
(S-55)
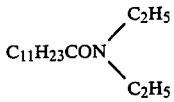
(S-56)
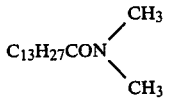
(S-57)
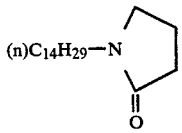
(S-58)
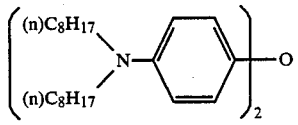
(S-59)
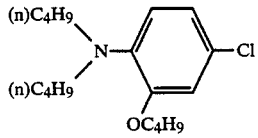

-continued (S-60)

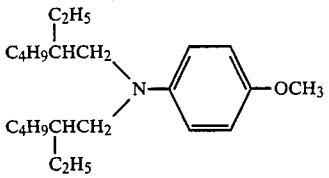

(S-61)

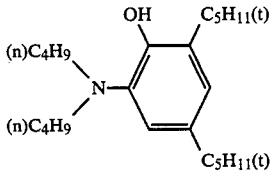

(S-62)

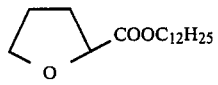

(S-63)

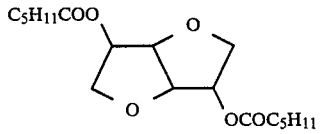

(S-64)

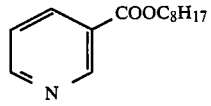

(S-65)

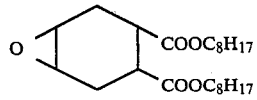

(S-66)

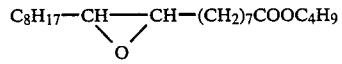

(S-67)

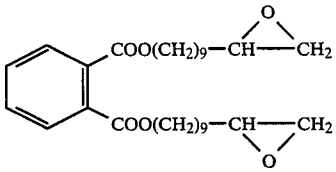

In addition to the couplers of formulae (I) to (V), the light-sensitive materials of the invention may contain other functional materials, such as colored couplers, DIR couplers, diffusible dye forming couplers, DIR hydroquinones, and the like.

The couplers according to the present invention can be added to light-sensitive materials in any optional amounts, but are usually used in an amount of from 0.01 to 10 mols, preferably from 0.1 to 1 mol, and more preferably from 0.2 to 0.5 mol, per mol of silver halide.

The light-sensitive materials of the ininvention can contain a ultraviolet absorbent in any optional layer. The ultraviolet absorbent is preferably incorporated to one or both of upper and lower layers adjacent to a layer containing the coupler of the present invention. Examples of the ultraviolet absorbents which can be used in the present invention are recited in *Research Disclosure,* No. 17643, VIII-C. Preferred among them are benzotriazole derivatives represented by formula (XVII)

(XVII)

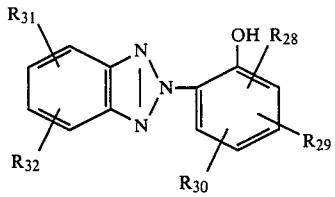

wherein $R_{28}$, $R_{29}$, $R_{30}$, $R_{31}$, and $R_{32}$ (which may be the same or different) each represents a hydrogen atom or a substituent; and $R_{31}$ and $R_{32}$ may be cyclized to form a 5- or 6-membered carbon ring. The substituent as represented by $R_{28}$, $R_{29}$, $R_{30}$, $R_{31}$, or $R_{32}$ is selected from those enumerated for the aromatic groups as represented by $R_1$. Of these groups, those which may have any substituent may be substituted with the substituents described for $R_1$.

The compounds represented by formula (XVII) can be used either individually or in combinations of two or more thereof. Typical examples of these compounds are shown below:

(UV-1)

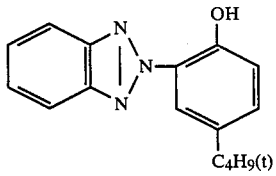

(UV-2)

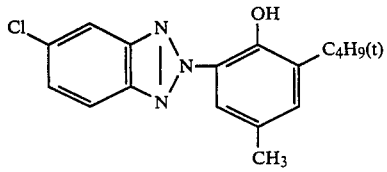

(UV-3)

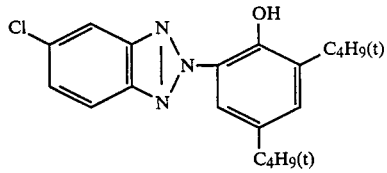

(UV-4)

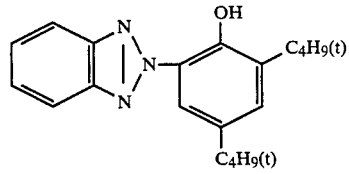

(UV-5)

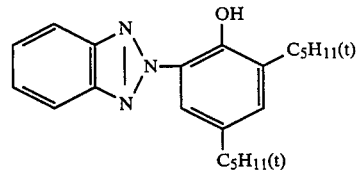

(UV-6)

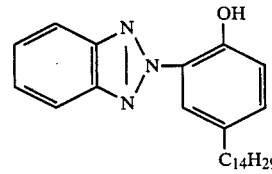

-continued (UV-7)

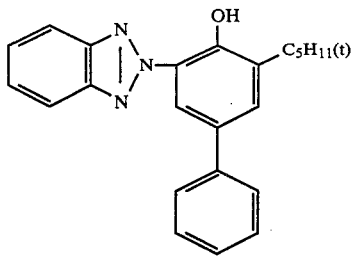

(UV-8)

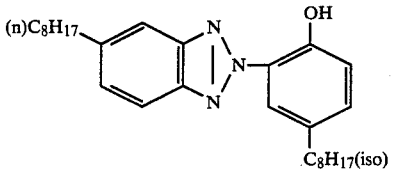

(UV-9)

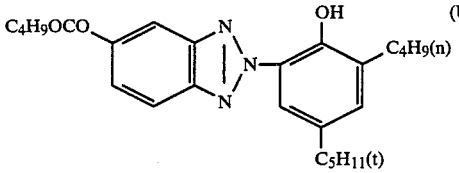

(UV-10)

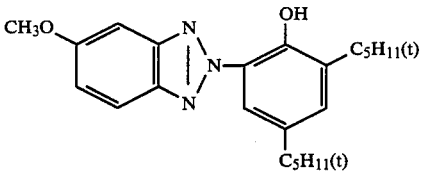

(UV-11)

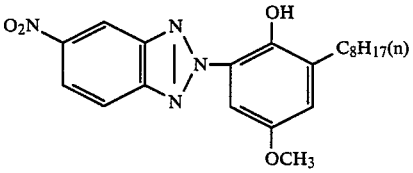

(UV-12)

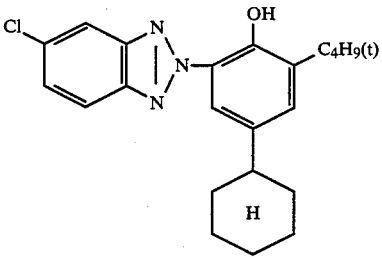

(UV-13)

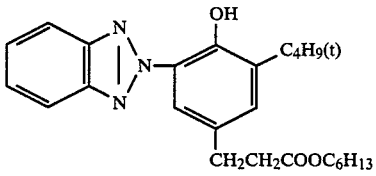

(UV-14)

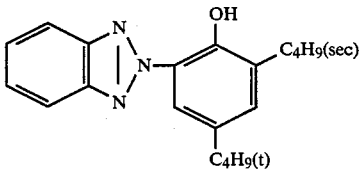

-continued (UV-15)

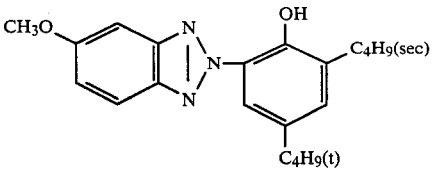

(UV-16)

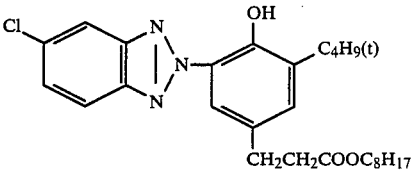

(UV-17)

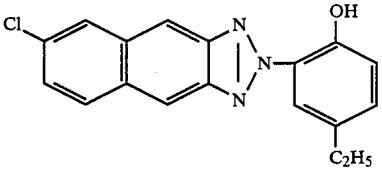

(UV-18)

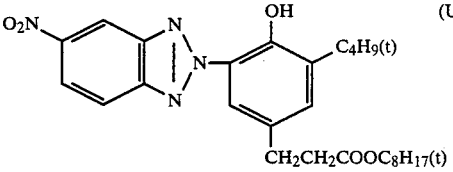

(UV-19)

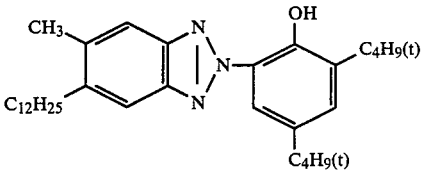

Methods for synthesizing the compounds of formula (XVII) and additional examples of the compounds (XVII) are described in Japanese Patent Publication No. 29620/69, Japanese Patent Application Nos. 151149/75 and 95233/79, U.S. Pat. No. 3,766,205, European Pat. No. 57,160, *Research Disclosure,* No. 22519 (1983), etc. High-molecular ultraviolet absorbents as described in Japanese Patent Application (OPI) Nos. 111942/83, 178351/83, 181041/83, 19945/84, and 23344/84 can also be used. A specific example of such high-molecular ultraviolet absorbents is given below as UV-20. Combinations of low-molecular ultraviolet absorbents and high-molecular ultraviolet absorbents may also be used.

(UV-20)

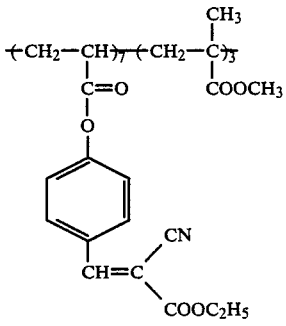

The above-described ultraviolet absorbent is dissolved in a high-boiling organic solvent and/or a low-boiling organic solvent, and the solution is dispersed in a hydrophilic colloid in the same manner as for couplers. The amount of the high-boiling organic solvent to be used is not particularly limited, but is usually up to 300% by weight based on the ultraviolet absorbent. Ultraviolet absorbents that are liquid at ambient temperatuer are used to advantage either individually or in combinations.

When the combination of couplers according to the present invention is combined with the aforesaid ultraviolet absorbent of formula (XVII), preservability, particularly fastness to light, of developed dye images, particularly cyan images, can be improved.

The ultraviolet absorbent is applied in an amount enough to impart light stability to cyan dye images. As too a large amount of the ultraviolet absorbent is likely to cause yellowing of unexposed areas (white background) of color photographic light-sensitive materials, the ultraviolet absorbent is usually coated in an amount ranging from $1\times10^{-4}$ to $2\times10^{-3}$ mol/m$^2$, and preferably from $5\times10^{-4}$ to $1.5\times10^{-3}$ mol/m$^2$.

In the case of ordinary color papers, the ultraviolet absorbent is incorporated in one or both, and preferably both, of the upper and lower layers adjacent to a cyan coupler-containing red-sensitive emulsion layer. When it is added to an intermediate layer between a green-sensitive layer and a red-sensitive layer, it may be co-emulsified together with a color mixing inhibitor. When it is added to a protective layer, another independent protective layer may be provided as an outermost layer. Such an outermost protective layer may contain a matting agent of an optional particle size, and the like.

In order to further improve preservability of developed dye images, particularly yellow, cyan, and magenta dye images, various organic type and metal complex type discoloration inhibitors can be used. The organic discoloration inhibitors include hydroquinones, gallic acid derivatives, p-alkoxyphenols, p-hydroxyphenols, etc. Examples of dye image stabilizers, stain inhbitors, or antioxidants are described in patents cited in *Research Disclosure,* No. 17643, VII-I to J. Examples of the metal complex type discoloration inhibitors are described in *Research Disclosure,* No. 15162, etc.

Heat- and light-features of yellow images can be improved by using a number of compounds belonging to phenols, hydroquinones, hydroxychromans, hydroxycoumarans, and hindered amines, and alkyl ethers, silyl ethers or hydrolyzable precursors thereof. Of these compounds, those represented by formulae (XVIII) and (XIX) shown below are particularly effective to improve fastness of yellow images to both light and heat. These compounds are effective to improve fastness of cyan images also.

Formula (XVIII) is represented by

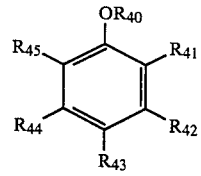

(XVIII)

wherein $R_{40}$ represents a hydrogen atom, a substituted or unsubstituted aliphatic group, a substituted or unsubstituted aromatic group, a substituted or unsubstituted heterocylic group, or a substituted silyl group of formula

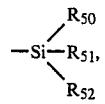

wherein $R_{50}$, $R_{51}$, and $R_{52}$ (which may be the same or different) each represents a substituted or unsubstituted aliphatic group, a substituted or unsubstituted aromatic group, a substituted or unsubstituted aliphatic oxy group, or a substituted or unsubstituted aromatic oxy group, wherein the substituent is selected from those acceptable for $R_1$; and $R_{41}$, $R_{42}$, $R_{43}$, $R_{44}$, and $R_{45}$ (which may be the same or different) each represents a hydrogen atom, an alkyl group, an aryl group, an alkoxy group, a hydroxyl group, an alkoxycarbonyl group, a mono- or dialkylamino group, an imino group, or an acylamino group.

Formula (XIX) is represented by

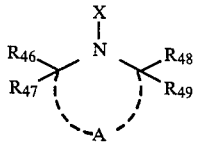

(XIX)

wherein $R_{46}$, $R_{47}$, $R_{48}$, and $R_{49}$ (which may be the same or different) each represents a hydrogen atom or an alkyl group; X represents a hydrogen atom, an aliphatic group, an acyl group, an aliphatic or aromatic sulfonyl group, an aliphatic or aromatic sulfinyl group, an oxy radical group, or a hydroxyl group; and A represents a non-metallic atomic group forming a 5-, 6-, or 7-membered ring.

Specific but nonlimitative examples of the compounds of formula (XVIII) or (XIX) are shown below:

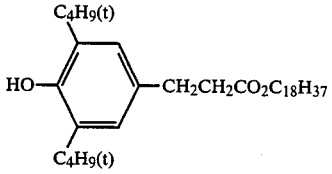

B-1

-continued
B-2
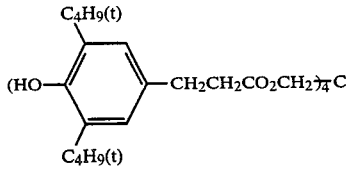
B-3
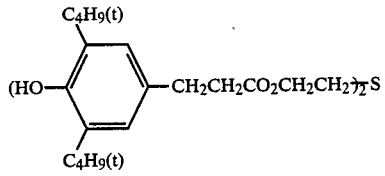
B-4
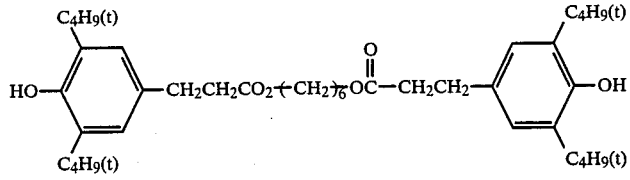
B-5
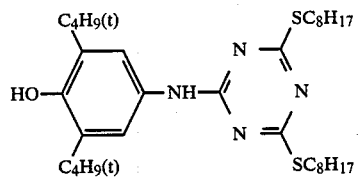
B-6
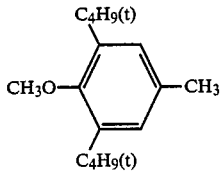
B-7
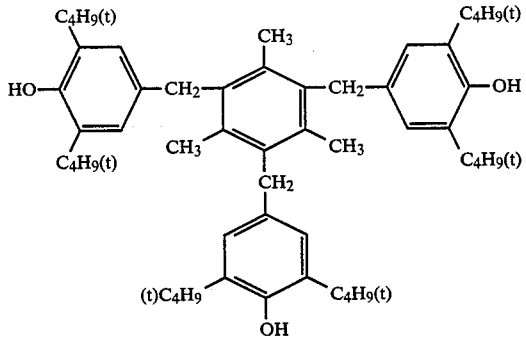
B-8
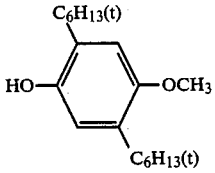
B-9
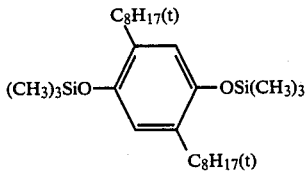

-continued
B-10
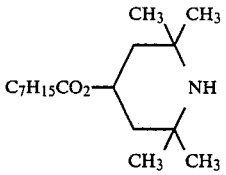
B-11
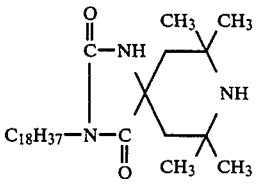
B-12
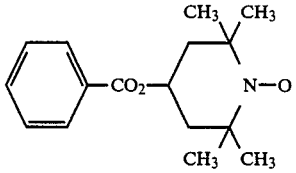
B-13
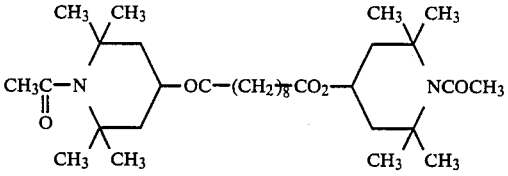
B-14
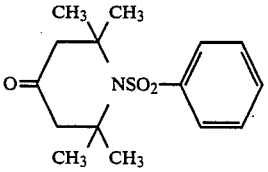
B-15
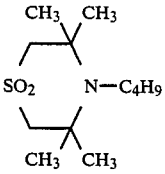
B-16
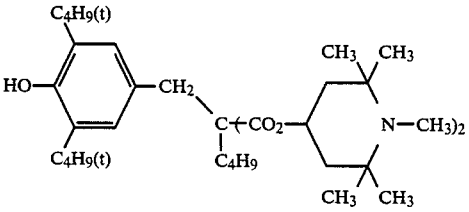
B-17
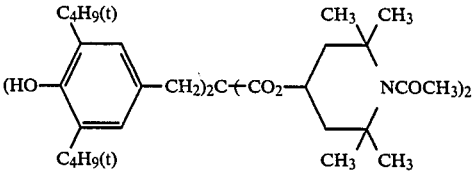
B-18
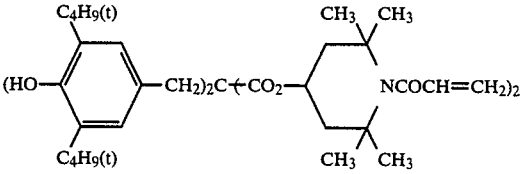

-continued

B-19

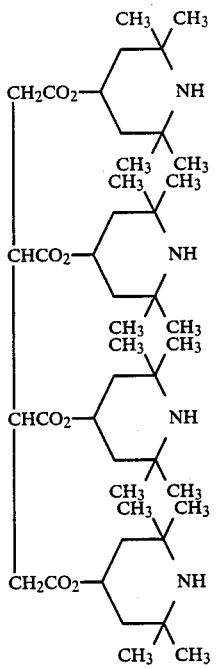

B-20

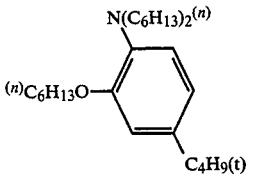

B-21

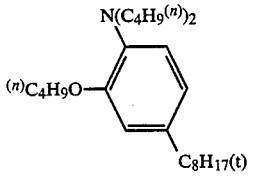

B-22

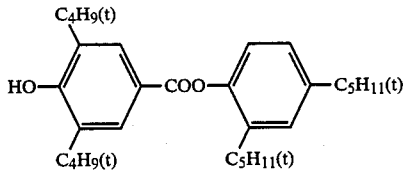

The methods for synthesizing the compounds of formulae (XVIII) and (XIX) as well as additional specific examples of these compounds are described in British Pat. Nos. 1,326,889, 1,354,313, and 1,410,846, U.S. Pat. Nos. 3,336,135 and 4,268,593, Japanese Patent Publication Nos. 1420/76 and 6623/77, and Japanese Patent Application (OPI) Nos. 114036/83 and 5246/84.

The compounds of formulae (XVIII) and (XIX) may be used individually or in combinations of two or more thereof or in combinations with other conventionally known discoloration inhibitors.

The amount of the compound of formula (XVIII) or (XIX) varies depending on the kind of the yellow coupler to be used, but usually ranges from 0.5 to 200% by weight, and preferably from 2 to 150% by weight, based on the yellow coupler. It is preferable that the compound of formula (XVIII) or (XIX) be co-emulsified together with the yellow coupler of formula (V).

While the aforesaid dye image stabilizers, stain inhibitors and antioxidants are also effective to improve preservability of magenta dyes obtained from the magenta couplers of formulae (III) and (IV), compounds represented by formulae (XX), (XXI), (XXI), (XXIII), (XXIX), and (XXV) shown below are particularly preferred for their effect to improve preservability of the magenta dyes.

Formula (XX) is represented

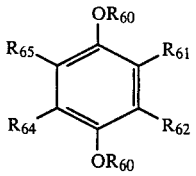

(XX)

wherein $R_{60}$ has the same meaning as $R_{40}$ in formula (XVIII); and $R_{61}$, $R_{62}$, $R_{64}$, and $R_{65}$ (which may be the same or different) each represents a hydrogen atom, an aliphatic group, an aromatic group, an acylamino group, a mono- or dialkylamino group, an aliphatic or aromatic thio group, an aliphatic or aromatic oxycarbonyl group, or —$OR_{60}$; $R_{60}$ and $R_{61}$ may be bonded together to form a 5- or 6-membered ring; and $R_{61}$ and $R_{62}$ may be bonded together to form a 5- or 6-membered ring.

Formula (XXI) is represented by

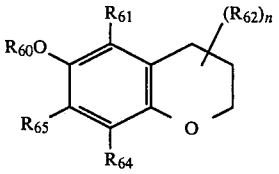

(XXI)

wherein $R_{60}$, $R_{61}$, $R_{62}$, $R_{64}$, and $R_{65}$ are as defined above; and n represents 0 or an integer of from 1 to 6.

Formula (XXII) is represented by

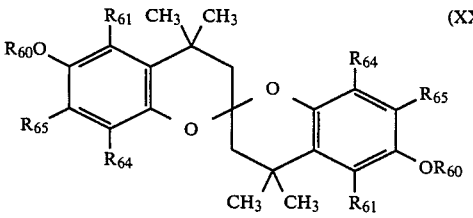

(XXII)

wherein $R_{60}$, $R_{61}$, $R_{64}$, and $R_{65}$ are as defined above.

Formula (XXIII) is represented by

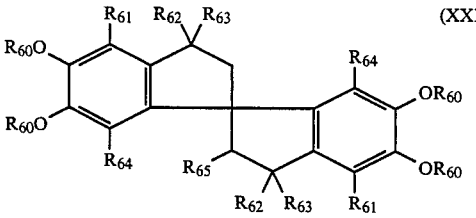

(XXIII)

wherein $R_{60}$, $R_{61}$, $R_{62}$, $R_{64}$, and $R_{65}$ are as defined above; and $R_{63}$ has the same meaning as $R_{60}$ to $R_{65}$.

Formula (XXIV) is represented by

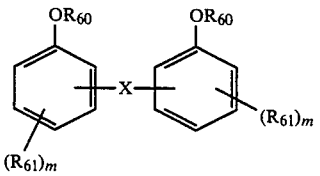

(XXIV)

wherein $R_{60}$ and $R_{61}$ are as defined above; X represents a divalent linking group; and m represents 0 or an integer of from 1 to 4.

Formula (XXV) is represented by

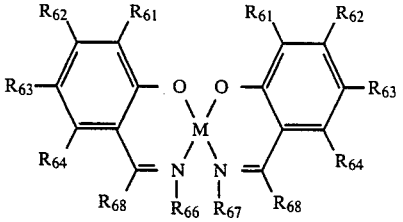

(XXV)

wherein $R_{61}$, $R_{62}$, $R_{63}$, and $R_{64}$ are as defined above; $R_{66}$ and $R_{67}$ (which may be the same or different) each represents a hydrogen atom, an aliphatic group, an aromatic group, or a hydroxyl group; $R_{68}$ represents a hydrogen atom, an aliphatic group, or an aromatic group; $R_{66}$ and $R_{67}$ may be taken together to form a 5- or 6-membered ring; and M represents Cu, Co, Ni, Pd, or Pt.

In formulae (XX) to (XXV), the aliphatic group or aromatic group as represented by $R_{61}$, $R_{62}$, $R_{63}$, $R_{64}$, $R_{65}$, $R_{66}$, $R_{67}$, or $R_{68}$ may be substituted with the substituents acceptable for $R_1$. When n or m is 2 or more, two or more groups $R_{62}$ or $R_{61}$ may be the same or different.

In formula (XXIV), typical example of X preferably include

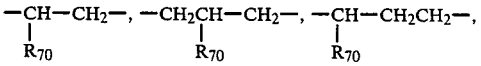

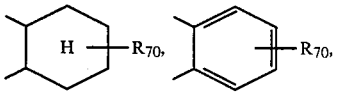

etc., wherein $R_{70}$ represents a hydrogen atom or an alkyl group. $R_{61}$ in formula (XXV) preferably represents a group capable of forming a hydrogen bond. At least one of $R_{62}$, $R_{63}$, and $R_{64}$ is preferably a hydrogen atom, a hydroxyl group, an alkyl group, or an alkoxy group. A total number of carbon atoms contained in $R_{61}$, $R_{62}$, $R_{63}$, $R_{64}$, $R_{65}$, $R_{66}$, $R_{67}$, and $R_{68}$ is preferably 4 or more.

Specific but nonlimitative examples of the compounds represented by formulae (XX) to (XXV) are shown below:

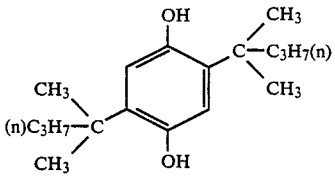

G-1

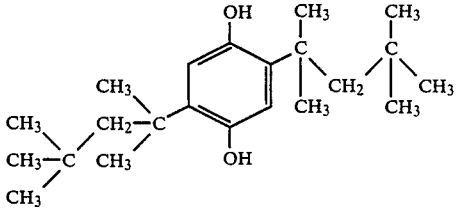

G-2

-continued
G-3
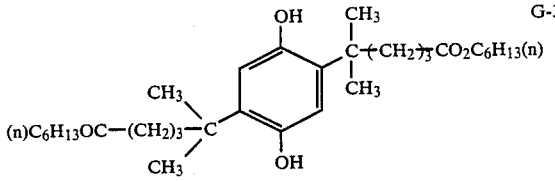
G-4
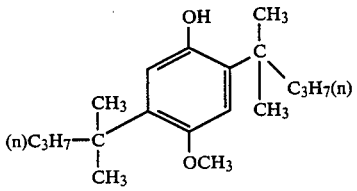
G-5
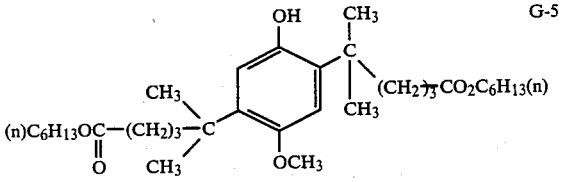
G-6
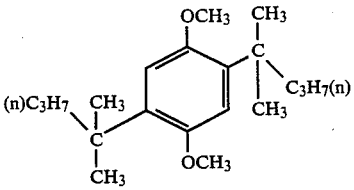
G-7
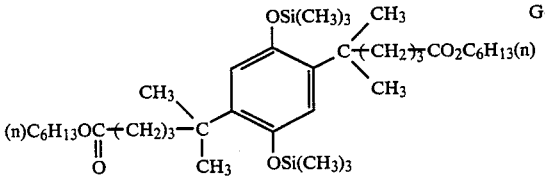
G-8
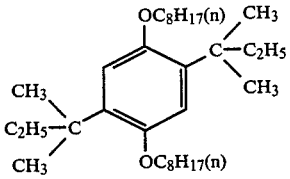
G-9
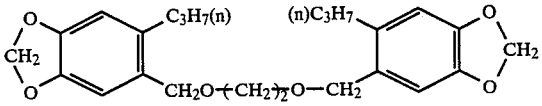
G-10
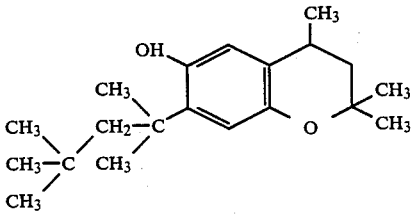
G-11
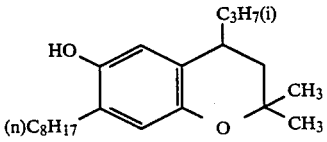
-continued
G-12
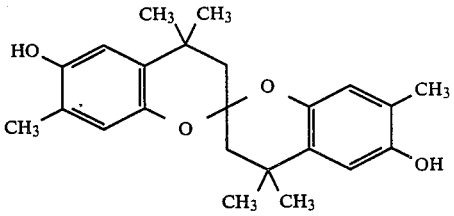
G-13
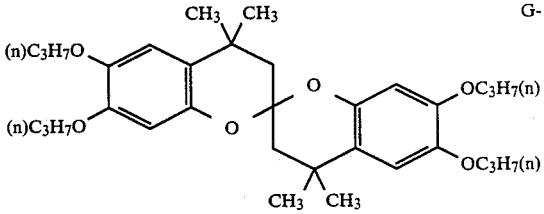
G-14
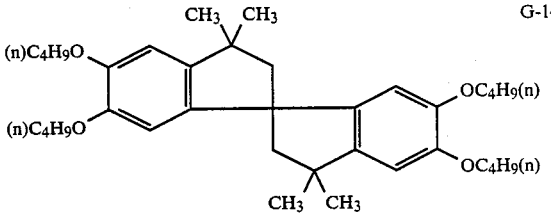
G-15
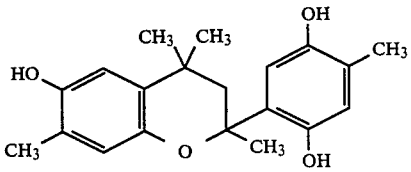
G-16
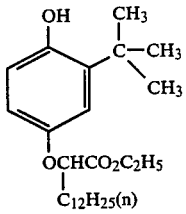
G-17
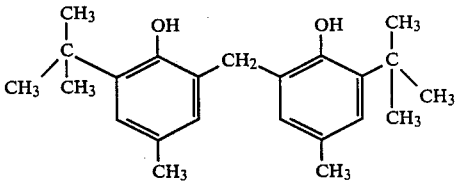
G-18
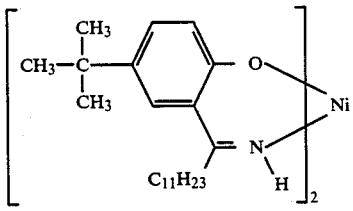

-continued

G-19

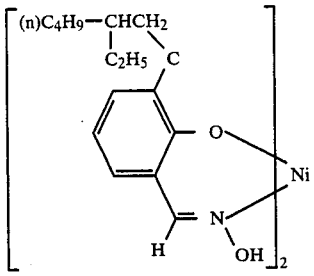

G-20

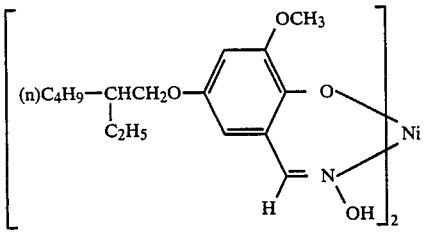

G-21

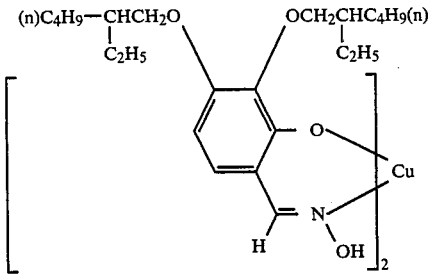

G-22

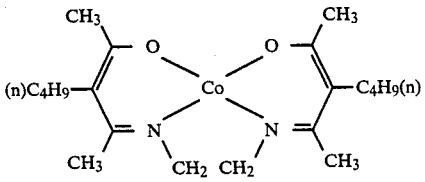

G-23

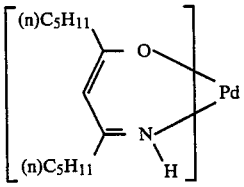

The methods of synthesis and additional specific examples of these compounds are described in U.S. Pat. Nos. 3,336,135, 3,432,300, 3,573,050, 3,574,627, 3,700,455, 3,764,337, 3,935,016, 3,982,944, 4,254,216, and 4,279,990, British Pat. Nos. 1,347,556, 2,062,888, 2,066,975, and 2,077,455, Japanese Patent Application (OPI) Nos. 97353/85, 152225/77, 17729/78, 20327/78, 145530/79, 6321/80, 21004/80, 24141/83, and 10539/84, and Japanese Patent Publication Nos. 31625/73 and 12337/79.

A reflective support which can be used in the present invention is a support which has heightened reflecting properties to make a dye image formed in a silver halide emulsion layer clearer. Such a reflective support includes a support having coated thereon a hydrophobic resin having dispersed therein a light reflecting substance, e.g., titanium oxide, zinc oxide, calcium carbonate, calcium sulfate, etc., and a support made of such a light reflecting substance-containing hydrophobic resin per se. Examples of the reflective support are baryta paper, polyethylene-coated paper, polypropylene-based synthetic paper, and transparent supports having a reflective layer or containing a reflective substance, such as a glass sheet, polyester films, e.g., polyethylene terephthalate, cellulose triacetate, cellulose nitrate, etc., polyamide films, polycarbonate films, polystyrene films, and the like. The support to be used can be selected appropriately from among them according to the end use. Photo-setting resins may also be used as support materials.

The processing steps, i.e., image formation process, according to the present invention will be described below.

According to the present invention, the color development processing is completed within a short processing time of 2 minutes and a half, and preferably in a processing time of from 30 to 130 seconds. The processing time herein referred to means a time of from the contact of a light-sensitive material with a color developing solution to the contact with a subsequent bath, and covers, therefore, the time for transfer between baths.

The color developing solution which can be used in this invention contains no substantial benzyl alcohol. The term "no substantial benzyl alcohol" as used herein means that the content of benzyl alcohol in the color developing solution should be less than 1.0 ml per liter. The developing solution preferably contains not more than 0.5 ml/l of benzyl alcohol, and more preferably contains no benzyl alcohol at all.

The color developing solution to be used preferably comprises an alkaline aqueous solution containing an aromatic primary amine color developing agent as a main component. The color developing agent includes p-phenylenediamine compounds to advantage, which typically include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides, phosphates, p-toluenesulfonates, tetraphenylborates or p-(t-octyl)-benzenesulfonates thereof, and the like. Among them, 3-methyl-4-amino-N-ethyl-N-β-hydroxyethylaniline and 3-methyl-4-amino-N-ethyl-N-β-methanesulfonamidoethylaniline, particularly 3-methyl-4-amino-N-ethyl-N-β-methanesulfonamidoethylaniline, are preferred.

Aminophenol derivatives may also be used as a developing agent, such as o- or p-aminophenol, 4-amino-2-methylphenol, 2-amino-3-methylphenol, 2-hydroxy-3-amino-1,4-dimethylbenzene, etc.

In addition, color developing agents described in L. F. A. Mason, *Photographic Processing Chemistry*, 226–229, Focal Press (1966), U.S. Pat. Nos. 2,193,015 and 2,592,364, and Japanese patent application (OPI) No. 64933/73 can also be employed. If necessary, these color developing agents may be used in combinations of two or more thereof.

The processing temperature for color developing preferably ranges from 30° to 50° C. From the standpoint of solution stability, etc., the color developing solution preferably has a pH of 12 or less, and more preferably 10.5 or less.

The color developing solution to be used in the invention can contain various development accelerators other than the substantial amount of benzyl alcohol. Usable development accelerators include various pyrimidium compounds, other cationic compounds, cationic dyes (e.g., phenosafranine), and neutral salts (e.g., thallium nitrate, potassium nitrate, etc.), as described, e.g., in U.S. Pat. No. 2,648,604, Japanese patent publication No. 9503/69, and U.S. Pat. Nos. 3,171,247; nonionic compounds, such as polyethylene glycol and derivatives thereof, polythioethers, etc., as described, e.g., in U.S. Pat. Nos. 2,533,990, 2,531,832, 2,950,970, and 2,577,127; thioether compounds as described in U.S. Pat. No. 3,201,242; and compounds described in Japanese patent application (OPI) Nos. 156934/83 and 220344/85.

In carrying out development in a short time as in the present invention, not only a means for acceleration of development but also a means for prevention of developer fog would be important subjects to consider. Antiggants which are preferably applicable to the present invention include alkali metal halides, e.g., potassium bromide, sodium bromide, potassium iodide, etc.; and organic antifoggants, such as nitrogen-containing heterocyclic compounds (e.g., benzotriazole, 6-nitrobenzimidazole, 5-nitrosoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine, etc.), mercapto-substituted heterocyclic compounds (e.g., 1-phenyl-5-mercaptotetrazole, 2-mercaptobenzimidazole, 2-mercaptobenzothiazole, etc.), and mercapto-substituted aromatic compounds (e.g., thiosalicylic acid, etc.). Preferred of these are halides. It does not matter if these antifoggants are eluted from color light-sensitive materials during processing and accumulated in the developer.

The color developing solution to be used in the invention can further contain various additives: pH buffering agents, e.g., alkali metal carbonates, borates, or phosphates, etc.; preservatives, e.g., hydroxylamine, triethanolamine, compounds described in West German patent publication (OLS) No. 2622950, sulfites, bisulfites, etc.; organic solvents, e.g., diethylene glycol, etc.; dye forming couplers; competing couplers; nucleating agents, e.g., sodium boron hydride, etc.; auxiliary developing agents, e.g., 1-phenyl-3-pyrazolidone, etc.; thickening agents; chelating agents, such as aminopolycarboxylic acids (e.g., ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, and the compounds described in Japanese patent application (OPI) No. 195845/83), 1-hydroxyethylidene-1,1'-diphosphonic acid, the organic phosphonic acids described in *Research Disclosure,* No. 18170 (May 1979), aminophosphonic acids (e.g., aminotris(methylenephosphonic acid), ethylenediamine-N,N,N',N'-tetramethylenephosphonic acid, etc.), and phosphonocarboxylic acids (e.g., those described in Japanese patent application (OPI) Nos. 102726/77, 42730/78, 121127/79, 4024/80, 4025/80, 126241/80, 65955/80, and 65956/80, and *Research Disclosure,* No. 18170 (May 1979); and the like.

If desired, the color development bath may be divided into two or more, and the first or the last bath is replenished with a color developer replenisher to thereby make reductions in developing time and amount of the replenisher.

After color development, silver halide color light-sensitive materials are usually subjected to bleaching. Bleaching may be carried out simultaneously with fixation (bleach-fix), or these two steps may be effected separately. Bleaching agents to be used include compounds of polyvalent metals, e.g., iron (III), cobalt (III), chromium (VI), copper (II), etc., peracids, quinones, nitroso compounds, etc. Examples of the bleaching agents are ferricyanides; bichromates; organic complex salts of iron (III) or cobalt (III), such as those formed with aminopolycarboxylic acids (e.g., ethylenediaminetetraacetic acid, diethylenetriaminepentaacetic acid, nitrilotriacetic acid, 1,3-diamino-2-propanoltetraacetic acid, etc.), or organic acids (e.g., citric acid, tartaric acid, malic acid, etc.); persulfates, manganates; nitrosophenol; etc. Particularly preferred among them are potassium ferricyanide, sodium(ethylenediaminetetraacetato)iron (III), ammonium(ethylenediaminetetraacetato)iron (III), ammonium(triethylenetetraminepentaacetato)iron (III), and persulfates. (Ethylenediaminetetraacetato)-iron (III) complex salts are useful in both an independent bleaching bath and a bleach-fixing monobath.

The bleaching bath or bleach-fixing bath may contain various accelerators, if desired. The accelerators to be used include a bromine ion, an iodine ion, as well as thiourea compounds as described in U.S. Pat. No. 3,706,561, Japanes patent publication Nos. 8506/70 and 26586/84, and Japanese patent application (OPI) Nos. 32735/78, 36233/78, and 37016/78; thiol compounds as described in Japanese patent application (OPI) Nos. 124424/78, 95631/78,57831/78, 32736/78, 65732/78, and 52534/79, and U.S. Pat. No. 3,893,858; heterocyclic compounds as described in Japanese patent application (OPI) Nos. 59644/74, 140129/75, 28426.78, 141623/78, 104232/78, and 35727/79; thioether compounds as described in Japanese patent application (OPI) Nos. 20832/77, 25064/80, and 26506/80; quaternary amines as described in Japanese patent application (OPI) No. 84440/83; thiocarbamoyl compounds as described in Japanese patent application (OPI) No. 42349/84; and the like.

Fixing agents to be used include thiosulfates, thiocyanates, thioether compounds, thioureas, a large amount of iodides, etc., with thiosulfates being widely employed. Preservatives for the bleach-fixing bath or fixing bath preferably include sulfites, bisulfites, and carbonyl-bisulfite addition products.

Bleach-fix or fixation is usually followed by washing with water. For the purpose of preventing sedimentation or saving water, a washing bath can contain various known compounds according to necessity. Such compounds include water softeners for preventing sedimentation, e.g., inorganic phosphoric acids, aminopolycarboxylic acids, organic phosphoric acids, etc.; bactericides or anti-molds for preventing growth of various bacteria, algae or fungi, hardeners, e.g., magnesium salts, aluminum salts, etc.; surface active agents for reducing a drying load or preventing unevenness, and the like. The compounds described in L. E. West, *Photo. Sci. and Eng.,* Vol. 9, No. 6 (1965) may also be added. In particular, addition of chelating agents and anti-molds is effective. Water saving can be achieved by carrying out washing in a multi-stage (e.g., 2 to 5 stages) countercurrent system.

The washing step may be followed by or replaced with a multi-stage countercurrent stabilization step as described in Japanese patent application (OPI) No.

8543/82. The stabilizing step requires from 2 to 9 vessels arranged in a countercurrent system. The stabilizing bath contains various additives for image stabilization, such as buffering agents for film pH-adjustment (e.g., borates, metaborates, borax, phosphates, carbonates, potassium hydroxide, sodium hydroxide, aqueous ammonia, monocarboxylic acids, dicarboxylic acids, polycarboxylic acids, etc.), and formalin. If desired, the stabilizing bath can further contain water softeners (e.g., inorganic or organic phosphoric acids, aminopolycarboxylic acids, aminopolyphosphonic acids, phosphonocarboxylic acids, etc.), bactericides (e.g., Proxel®, isothiazolone, 4-thiazolylbenzimidazole, halogenated phenolbenzotriazoles, etc.), surface active agents, fluorescent brightening agents, hardeners, etc.

The stabilizing bath may furthermore contain, as film pH adjustors after processing, various ammonium salts, e.g., ammonium chloride, ammonium nitrate, ammonium sulfate, ammonium phosphate, ammonium sulfite, ammonium thiosulfate, etc.

Silver halide emulsions which can be used in the present invention includes silver bromide, silver chlorobromide, silver chloride, silver iodobromide, and silver iodochlorobromide. The iodide content is preferably 2 mol% or less for the purpose of further accelerating the development. Silver chlorobromide emulsions containing 10 mol% or more of silver bromide are preferred. A silver bromide content exceeding 20 mol% but less than 90 mol% is preferred in order to obtain an emulsion having sufficient sensitivity without increasing fog. The use of silver chloride or silver chlorobromide having a silver chloride content of 90 mol% or more is particularly preferred because a high color density is obtained even when processed for a more shortened period.

Silver halide grains to be used may have a homogeneous phase, a heterogeneous phase comprising a core and an outer shell or a multi-phase structure having a fusion structure, or a mixture thereof.

The silver halide grains preferably have a mean grain size of from 0.1 to 2 μm, and more preferably from 0.15 to 1 μm, the mean grain size being a mean diameter of spherical or nearly spherical grains or a mean edge length of cubic grains, averaged based on the projected area. Grain size distribution may be either narrow or broad, but it is preferable to use a so-called mono-dispersed silver halide emulsion having not greater than 20%, and more preferably not greater than 15%, of a coefficient of variation of grain size (i.e., a quotient of a standard deviation of a size distribution curve divided by a mean grain size). In order to obtain desired gradation, two or more kinds of mono-dispersed silver halide emulsions (preferably those having a coefficient of variation within the above-recited range) being different in grain size can be mixed and coated as a single emulsion layer or they may be coated separately in two or more layers having substantially the same color sensitivity. Further, two or more kinds of poly-dispersed silver halide emulsions or a combination of a mono-dispersed emulsion and a poly-dispersed emulsion may be mixed or separately coated.

The silver halide grains may have a regular crystal form, e.g., a cube, an octahedron, a dodecahedron, a tetradecahedron, etc., or an irregular (e.g., spherical, tabular, etc.) crystal form, or a composite form thereof. In particular, a tabular gain emulsion containing at least 50%, based on the total projected area, of tabular grains having a ratio of length to thickness of 5 or more, and preferably 8 or more, can be employed. The emulsion may be a mixture of these various silver halide grains. The emulsion may be either of the surface latent image type which forms a latent image predominantly on the surface or of the internal latent image type which forms a latent image predominantly in the interior of grains.

The photographic emulsions to be used in the invention can be prepared by known methods as described, e.g., in P. Glafkides, *Chimie et Physique Photographique*, Paul Montel (1967), G. F. Duffin, *Photographic Emulsion Chemistry*, Focal Press (1966), V. L. Zelikman et al, *Making and Coating Photographic Emulsion*, Focal Press (1964), etc. In some detail, the emulsion can be prepared by any of the acid process, the neutral process, the ammonia process, and the like. The reaction between soluble silver salts and soluble halogen salts can be carried out by any of the single jet process, the double jet process, and a combination thereof. A so-called reverse mixing method, in which silver halide grains are formed in the presence of excess silver ions, may also be used. Further, a so-called controlled double jet method, in which a pAg of a liquid phase where silver halide grains are formed is maintained constant, can be adopted. According to this method, a silver halide emulsion having a regular crystal form and an almost uniform grain size can be obtained.

In addition, an emulsion prepared by a so-called conversion method which involves a step of converting silver halide grains formed to those having a smaller solubility product by the end of the grain formation step, or an emulsion having undergone such conversion after the end of the grain formation step can also be employed.

In the step of silver halide grain formation or physical ripening, a cadmium salt, a zinc salt, a lead salt, a thallium salt, an iridium salt or a complex salt thereof, a rhodium salt or a complex salt thereof, an iron salt or a complex salt thereof, etc. may be present in the system.

The silver halide emulsion thus prepared is usually subjected to physical ripening, desalting, and chemical ripening prior to coating.

In the precipitation, physical ripening, or chemical ripening, known silver halide solvents can be used. Examples of usable silver halide solvents are ammonia, potassium thiocyanate, and thioethers and thione compounds as described in U.S. Pat. No. 3,271,157, and Japanese patent application (OPI) Nos. 12360/76, 82408/78, 144319/78, 100717/79, and 155828/79. Removal of soluble silver salts from emulsions after physical ripening can be carried out by noodle washing, flocculation-sedimentation, or ultrafiltration.

Chemical sensitization of the silver halide emulsion can be performed by sulfur sensitization using active gelatin or a compound containing sulfur capable of reacting with silver (e.g., thiosulfates, thioureas, mercapto compounds, rhodanines, etc.); reduction sensitization using a reducing substance (e.g., stannous salts, amines, hydrazine derivatives, formamidinesulfinic acid, silane compounds, etc.); noble metal sensitization using a metal compound (e.g., complex salts of gold as well as metals of Group III of the Periodic Table, e.g., Pt, Ir, Pd, Rh, Fe, etc.); or a combination thereof. Sulfur sensitization is preferred.

The blue-sensitive, green-sensitive, or red-sensitive emulsion according to the present invention is obtained by spectrally sensitizing the respective layer with methine dyes or others so as to have the respective color sensitivity. Sensitizing dyes to be used include cyanine dyes, merocyanine dyes, complex cyanine dyes, complex merocyanine dyes, holopolar cyanine dyes, hemicyanine dyes, styryl dyes, and hemioxonol dyes. Particularly preferred are cyanine dyes, merocyanine dyes, and complex merocyanine dyes. Any of nuclei commonly utilized in cyanine dyes as a basic heterocyclic nucleus is applicable to these sensitizing dyes. Specific examples of the applicable nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; the above-described nucleus to which an alicyclic hydrocarbon ring is fused; and the above-described nucleus to which an aromatic hydrocarbon ring is fused, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may have a substituent on their carbon atoms.

To the merocyanine dyes or complex merocyanine dyes is applicable a 5- to 6-membered heterocyclic nucleus having a ketomethylene structure, e.g., a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc.

These sensitizing dyes may be used either individually or in combinations thereof. Combinations of sensitizing dyes are frequently used for the purpose of supersensitization. Typical examples of such combinations of sensitizing dyes are described in U.S. Pat. Nos. 2,688,545, 2,977,229, 3,397,060, 3,522,052, 3,527,641, 3,617,293, 3,628,964, 3,666,480, 3,672,898, 3,697,428, 3,703,377, 3,769,301, 3,814,609, 3,837,862, and 4,026,707, British Pat. Nos. 1,344,281 and 1,507,803, Japanese patent publication Nos. 4936/68 and 12375/78, and Japanese patent application (OPI) Nos. 110618/77 and 109925/77.

The silver halide emulsions may further contain, in combination with the sensitizing dyes, dyes which do not per se have spectral sensitizing activity, or substances which do not substantially absorb visible light, but which do show supersensitizing effects.

In order to avoid reduction of image sharpness, various anti-irradiation or anti-halation dyes can be employed. Typical examples of these dyes are described in Japanese patent publication Nos. 22069/64, 3504/68, 13168/68, 1419/76, 46607/76, 28085/78, 10059/80, 10060/80, 10061/80, 10187/80, and 10899/80, Japanese patent application (OPI) Nos. 145125/75 and 33104/80, U.S. Pat. Nos. 3,647,460, and British Pat. Nos. 1,338,799.

In order to prevent color mixing, an intermediate layer containing a color mixing inhibitor may be provided between light-sensitive layers being different in color sensitivity. Typical examples of the color mixing inhibitor include alkylhydroquinones described in U.S. Pat. Nos. 2,360,290, 2,419,613, 2,403,721, 3,960,570, and 3,700,453, Japanese Patent Application (OPI) Nos. 106329/74 and 156438/75, U.S. Pat. Nos. 2,728,659, 2,732,300, and 3,243,294, and Japanese Patent Application (OPI) Nos. 9528/78, 55121/78, 29637/79, and 55339/85; hydroquinone sulfonates described in U.S. Pat. No. 2,701,197 and Japanese Patent Application (OPI) No. 172040/85; aminohydroquinones described in Japanese Patent Application (OPI) No. 202465/84 and Japanese Patent Application Nos. 165511/85 and 296088/85; hydroquinones having electron-attractive substituents described in Japanese Patent Application (OPI) Nos. 43521/80, 109344/81, and 22237/82; and the like. In addition to these hydroquinone compounds, gallic acid amides, sulfonamidophenols, etc. may also be used.

The present invention will now be illustrated in greater detail with reference to the following examples, but it should be understood that the present invention is not limited thereto. In these examples, all the percents are given by weight unless otherwise indicated.

EXAMPLE 1

A paper support laminated with polyethylene on both sides thereof was coated with the following layers in the order listed to prepare a multi-layer color paper. The polyethylene layer on the side to be coated had dispersed therein titanium dioxide as a white pigment and ultramarine as a bruish dye.

| | |
|---|---|
| **1st Layer (Blue-Sensitive Layer):** | |
| Siver chlorobromide emulsion (silver bromide: 80 mol %) | 0.30 g of Ag/m$^2$ |
| Gelatin | 1.86 g/m$^2$ |
| Yellow Coupler (Y-35) | 0.82 g/m$^2$ |
| Dye Image Stabilizer (B-18) | 0.19 g/m$^2$ |
| Solvent (S-25) | 0.34 ml/m$^2$ |
| **2nd Layer (Color Mixing Preventing Layer:** | |
| Gelatin | 0.99 g/m$^2$ |
| Color Mixing Inhibitor (G-2) | 0.08 g/m$^2$ |
| **3rd Layer (Green-Sensitive Layer):** | |
| Silver chlorobromide emulsion (silver bromide: 75 mol %) | 0.16 g of Ag/m$^2$ |
| Gelatin | 1.80 g/m$^2$ |
| Magenta Coupler (M-23) | 0.34 g/m$^2$ |
| Dye Image Stabilizer (G-13) | 0.20 g/m$^2$ |
| Solvent (S-7:S-16 = 2:1 by weight) | 0.68 ml/m$^2$ |
| **4th Layer (Ultraviolet Absorbing Layer):** | |
| Gelatin | 1.60 g/m$^2$ |
| Ultraviolet Absorbent (UV-3:UV-14: UV-16 = 1:5:3 by mol) | 0.62 g/m$^2$ |
| Color Mixing Inhibitor (G-2) | 0.05 g/m$^2$ |
| Solvent (S-9) | 0.26 ml/m$^2$ |
| **5th Layer (Red-Sensitive Layer):** | |
| Silver chlorobromide emulsion (silver bromide: 70 mol %) | 0.26 g of Ag/m$^2$ |
| Gelatin | 0.98 g/m$^2$ |
| Cyan Coupler (C-2:C-14 = 1:1 by mol) | 0.38 g/m$^2$ |
| Dye Image Stabilizer (UV-3:UV-1: UV-14 = 1:3:3 by mol) | 0.17 g/m$^2$ |
| Solvent (S-16) | 0.23 ml/m$^2$ |
| **6th Layer (Ultraviolet Absorbing Layer):** | |
| Gelatin | 0.54 g/m$^2$ |
| Ultraviolet Absorbent (UV-3:UV-14: UV-16 = 1:5:3 by mol) | 0.21 g/m$^2$ |
| Solvent (S-9) | 0.09 ml/m$^2$ |
| **7th Layer (Protective Layer):** | |
| Gelatin | 1.33 g/m$^2$ |
| Acryl-modified polyvinyl alcohol copolymer (degree of modification: 17%) | 0.17 g/m$^2$ |

Each of the coating compositions for the 1st to 7th layers was prepared as follows, taking that for the 1st layer as an instance:

In 27.2 ml of ethyl acetate and 7.9 ml of Solvent (S-25) were dissolved 19.1 g of Yellow Coupler (Y-35) and (4.4 g of Dye Image Stabilizer (B-18), and the resulting solution was emulsified and dispersed in 185 ml of a 10% aqueous gelatin solution containing 8 ml of 10% sodium dodecylbenzenesulfonate. Separately, a blue-sensitizing dye of formula shown below was added to a silver chlorobromide emulsion (silver bromide content: 80 mol%; silver content: 70 g/kg) in an amount of $7.0\times10^{-4}$ mol per mol of silver chlorobromide to prepare 90 g of a blue-sensitive emulsion. The above prepared coupler dispersion and the silver chlorobromide emulsion were mixed, and the gelatin concentration was adjusted so as to result in the above-recited composition of the 1st layer. As a gelatin hardener in each layer, a sodium salt of 1-hydroxy-3,5-dichloro-s-triazine was used.

Blue-Sensitizing Dye (for Blue-Sensitive Layer):

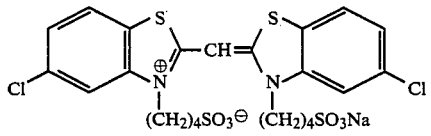

($7.0\times10^{-4}$ mol/mol of silver halide)

Green-Sensitizing Dye (for Green-Sensitive Layer):

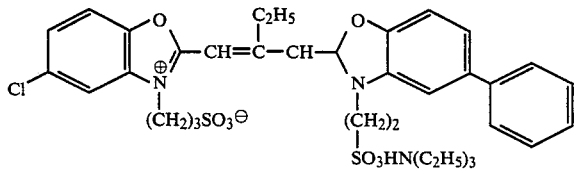

($4.0\times10^{-4}$ mol/mol of silver halide)

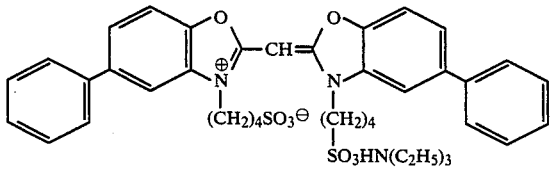

($7.0\times10^{-5}$ mol/mol of silver halide)

Red-Sensitizing Dye (for Red-Sensitive Layer):

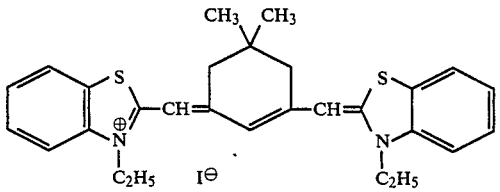

($1.0\times10^{-4}$ mol/mol of silver halide)

The anti-irradiation dye used in each emulsion layer was shown below:

For Green-Sensitive Layer:

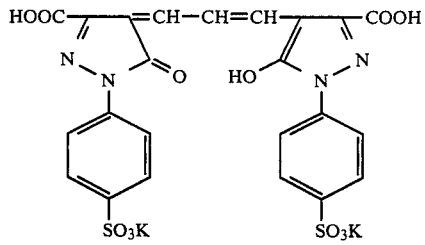

for Red-Sensitive Layer:

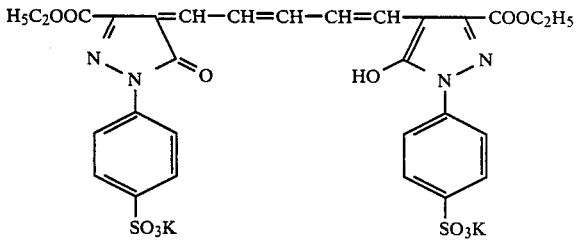

The above prepared sample was designated as Sample 101. Samples 102 to 113 were prepared in the same manner as for Sample 101 except that the kind and amount of the coupler and the amount of the silver halide emulsion to be used in the 1st, 3rd, or 5th layer were changed as shown in Table 1 below.

TABLE 1

| Sample No. | Layer | Component | Amount* ($g/m^2$) |
|---|---|---|---|
| 102 | 1st | Yellow Coupler (Y-23) | 0.91 |
| | | Silver chlorobromide emulsion (silver bromide: 80 mol %) | 0.30 |
| 103 | 3rd | Magenta Coupler (M-25) | 0.41 |
| | | Silver chlorobromide emulsion (silver bromide: 75 mol %) | 0.16 |
| 104 | 3rd | Magenta Coupler (M-1) | 0.35 |
| | | Silver chlorobromide emulsion (silver bromide: 75 mol %) | 0.24 |
| 105 | 3rd | Magenta Coupler (M-13) | 0.24 |
| | | Silver chlorobromide emulsion (silver bromide: 75 mol %) | 0.32 |
| 106 | 5th | Cyan Coupler (C-2) | 0.34 |
| | | Silver chlorobromide emulsion (silver bromide: 70 mol %) | 0.26 |
| 107 | 3rd | Magenta Coupler (M-1) | 0.35 |
| | | Silver chlorobromide emulsion (silver bromide: 75 mol %) | 0.24 |
| | 5th | Cyan Coupler (C-2) | 0.34 |
| | | Silver chlorobromide emulsion (silver bromide: 70 mol %) | 0.26 |
| 108 | 1rd | Yellow Coupler (Y-23) | 0.91 |
| | | Silver chlorobromide emulsion (silver bromide: 80 mol %) | 0.30 |
| | 3rd | Magenta Coupler (M-13) | 0.24 |
| | | Silver chlorobromide emulsion (silver bromide: 75 mol %) | 0.32 |
| 109 | 1st | Yellow Coupler (Y-23) | 0.91 |
| | | Silver chlorobromide emulsion (silver bromide: 80 mol %) | 0.30 |

TABLE 1-continued

| Sample No. | Layer | Component | Amount* ($g/m^2$) |
|---|---|---|---|
| | 3rd | Magenta Coupler (M-1) | 0.35 |
| | | Silver chlorobromide emulsion (silver bromide: 75 mol %) | 0.24 |
| 110 | 1st | Yellow Coupler (Y-23) | 0.91 |
| | | Silver chlorobromide emulsion (silver bromide: 80 mol %) | 0.30 |
| | 5th | Cyan Coupler (C-2) | 0.34 |
| | | Silver chlorobromide emulsion (silver bromide: 70 mol %) | 0.26 |
| 111 | 1st | yellow Coupler (Y-23) | 0.91 |
| | | Silver chlorobromide emulsion (silver bromide: 80 mol %) | 0.30 |
| | 3rd | Magenta Coupler (M-25) | 0.33 |
| | | Silver chlorobromide emulsion (silver bromide: 75 mol %) | 0.16 |
| | 5th | Cyan Coupler (C-2) | 0.34 |
| | | Silver chlorobromide emulsion (silver bromide: 70 mol %) | 0.26 |
| 112 | 1st | Yellow Coupler (Y-23) | 0.91 |
| | | Silver chlorobromide emulsion (Silver bromide: 80 mol %) | 0.30 |
| | 3rd | Magenta Coupler (M-1) | 0.35 |
| | | Silver chlorobromide emulsion (silver bromide: 75 mol %) | 0.24 |
| 112 | 5th | Cyan Coupler (C-2) | 0.34 |
| | | Silver chlorobromide emulsion (silver bromide: 70 mol %) | 0.26 |
| 113 | 1st | Yellow Coupler (a) | 0.58 |
| | | Silver chlorobromide emulsion (silver bromide: 80 mol %) | 0.60 |
| | 3rd | Magenta Coupler (b) | 0.33 |
| | | Silver chlorobromide emulsion (silver bromide: 75 mol %) | 0.32 |
| | 5th | Cyan Coupler (c) | 0.31 |
| | | Silver chlorobromide emulsion (silver bromide: 70 mol %) | 0.52 |

Note:
*The amount of the silver halide emulsion is expressed in a silver coverage.

Yellow Coupler (a):

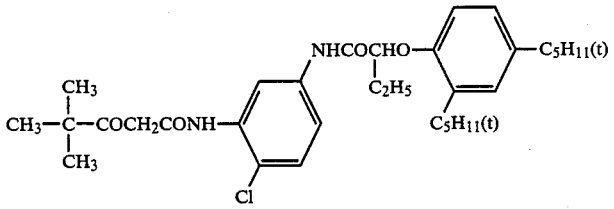

Magenta Coupler (b):

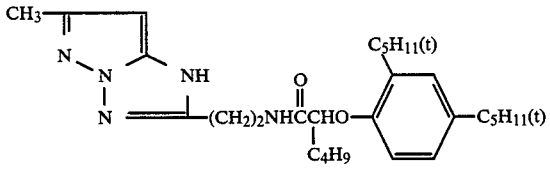

Cyan Coupler (c):

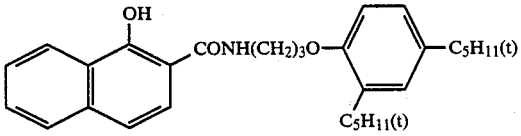

Each of Samples 101 to 113 was exposed to light for 0.5 second at an exposure of 250 CMS using an optical wedge for sensitometry through a blue (B), green (G), or red (R) filter by means of a sensitometer (FWH Model manufactured by Fuji Photo Film Co., Ltd.; color temperature: 3,200° K.). The exposed sample was subjected to Processing A or B according to the following procedure. Formulations of the processing solutions used are also described below. The procedure for Processing A and that for Processing B are equal except for using Developer A or Developer B, respectively.

Processing Procedure:

| Processing Step | Temperature | Time |
|---|---|---|
| Color Development | 38° C. | 1 to 3 min. |
| Bleach-Fixing | 33° C. | 1.5 min. |
| Washing | 28–35° C. | 3.0 min. |

Formulation of Developer (A):

| | |
|---|---|
| Trisodium nitrilotriacetate | 2.0 g |
| Benzyl alcohol | 15 ml |
| Diethylene glycol | 10 ml |
| Sodium sulfite | 2.0 g |
| Potassium bromide | 0.5 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| Sodium carbonate monohydrate | 30.0 g |
| Water to make | 1000 ml (pH = 10.1) |

Formulation of Developer (B):

| | |
|---|---|
| Trisodium nitrilotriacetate | 2.0 g |
| Sodium sulfite | 2.0 g |
| Potassium bromide | 0.5 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| Sodium carbonate monohydrate | 30.0 g |
| Water to make | 1000 ml (pH = 10.1) |

Formulation of Bleach-Fixing Bath:

| | |
|---|---|
| Ammonium thiosulfate (54%) | 150 ml |
| Sodium sulfite | 15 g |
| Ammonium (ethylenediaminetetra-acetato)iron (III) | 55 g |
| Disodium ethylenediaminetetra-acetate | 4 g |
| Water to make | 1000 ml (pH = 6.9) |

Photographic properties of the processed samples were evaluated in terms of relative sensitivity and maximum density ($D_{max}$). The relative sensitivity is a value relative to the sensitivity of each layer of the respective sample when processed according to Processing A for a developing time of 2 minutes, being taken as 100. The sensitivity is a relative value of a reciprocal of an exposure required for providing a density of a minimum density plus 0.5. The gradient is expressed in terms of a density difference between a sensitive point and a point higher than 0.5 in log E. The results obtained are shown in Table 2 below.

TABLE 2

| | | Processing A | | | | | | Processing B | | | | | |
|---|---|---|---|---|---|---|---|---|---|---|---|---|---|
| | | 1 min | | 2 min | | 3 min | | 1 min | | 2 min | | 3 min | |
| Sample No. | Layer | Relative Sensitivity | $D_{max}$ | Relative Sensitivity | $D_{max}$ | Relative Sensitivity | $D_{max}$ | Relative Sensitivity | $D_{max}$ | Relative Sensitivity | $D_{max}$ | Relative Sensitivity | $D_{max}$ |
| 101 | B | 58 | 1.98 | 100 | 2.09 | 120 | 2.12 | 62 | 2.00 | 95 | 2.10 | 115 | 2.11 |
| | G | 73 | 2.60 | 100 | 2.66 | 124 | 2.70 | 80 | 2.60 | 99 | 2.65 | 123 | 2.70 |
| | R | 81 | 2.83 | 100 | 2.83 | 127 | 2.81 | 81 | 2.82 | 98 | 2.82 | 124 | 2.83 |
| 102 | B | 59 | 1.99 | 100 | 2.10 | 120 | 2.11 | 68 | 2.03 | 99 | 2.11 | 114 | 2.11 |
| | G | 72 | 2.58 | 100 | 2.65 | 124 | 2.71 | 81 | 2.63 | 99 | 2.65 | 122 | 2.70 |
| | R | 80 | 2.82 | 100 | 2.82 | 128 | 2.83 | 81 | 2.83 | 97 | 2.83 | 125 | 2.82 |
| 103 | B | 59 | 2.00 | 100 | 2.09 | 121 | 2.12 | 63 | 2.02 | 95 | 2.11 | 114 | 2.11 |
| | G | 81 | 1.98 | 100 | 2.00 | 120 | 2.00 | 82 | 1.99 | 100 | 2.00 | 121 | 2.00 |
| | R | 81 | 2.81 | 100 | 2.82 | 128 | 2.82 | 82 | 2.83 | 98 | 2.83 | 124 | 2.83 |
| 104 | B | 59 | 1.99 | 100 | 2.10 | 121 | 2.11 | 63 | 2.01 | 96 | 2.10 | 114 | 2.10 |
| | G | 74 | 2.52 | 100 | 2.58 | 123 | 2.58 | 81 | 2.57 | 100 | 2.57 | 122 | 2.58 |
| | R | 81 | 2.83 | 100 | 2.82 | 128 | 2.82 | 82 | 2.82 | 98 | 2.83 | 124 | 2.82 |
| 105 | B | 58 | 1.98 | 100 | 2.11 | 120 | 2.12 | 63 | 2.02 | 96 | 2.11 | 114 | 2.10 |
| | G | 70 | 2.72 | 100 | 2.78 | 122 | 2.79 | 76 | 2.76 | 97 | 2.78 | 122 | 2.79 |
| | R | 81 | 2.81 | 100 | 2.82 | 126 | 2.82 | 83 | 2.83 | 97 | 2.82 | 124 | 2.82 |
| 106 | B | 58 | 1.98 | 100 | 2.10 | 120 | 2.11 | 63 | 2.02 | 96 | 2.11 | 115 | 2.11 |
| | G | 73 | 2.60 | 100 | 2.65 | 124 | 2.68 | 80 | 2.62 | 99 | 2.65 | 122 | 2.66 |
| | R | 85 | 2.75 | 100 | 2.79 | 126 | 2.80 | 88 | 2.78 | 99 | 2.80 | 123 | 2.80 |
| 107 | B | 59 | 2.00 | 100 | 2.10 | 121 | 2.11 | 68 | 2.03 | 99 | 2.10 | 114 | 2.11 |
| | G | 74 | 2.52 | 100 | 1.59 | 123 | 2.59 | 82 | 2.58 | 100 | 2.58 | 122 | 2.58 |
| | R | 85 | 2.75 | 100 | 2.79 | 126 | 2.79 | 88 | 2.78 | 99 | 2.78 | 123 | 2.79 |
| 108 | B | 59 | 2.00 | 100 | 2.11 | 120 | 2.11 | 68 | 2.03 | 99 | 2.11 | 114 | 2.10 |
| | G | 70 | 2.71 | 100 | 2.77 | 122 | 2.78 | 76 | 2.76 | 98 | 2.78 | 122 | 2.78 |
| | R | 81 | 2.83 | 100 | 2.82 | 127 | 2.82 | 81 | 2.82 | 98 | 2.82 | 124 | 2.82 |
| 109 | B | 59 | 1.98 | 100 | 2.09 | 120 | 2.10 | 68 | 2.04 | 99 | 2.10 | 114 | 2.11 |
| | G | 74 | 2.52 | 100 | 2.58 | 122 | 2.59 | 82 | 2.58 | 100 | 2.58 | 121 | 2.59 |
| | R | 81 | 2.83 | 100 | 2.82 | 127 | 2.83 | 81 | 2.82 | 98 | 2.82 | 2.83 | |
| | | | | | | | | | | | 124 | | |
| 110 | B | 59 | 1.98 | 100 | 2.08 | 121 | 2.11 | 68 | 2.03 | 99 | 2.11 | 113 | 2.11 |
| | G | 70 | 2.72 | 100 | 2.77 | 122 | 2.79 | 76 | 2.77 | 98 | 2.79 | 122 | 2.79 |
| | R | 81 | 2.82 | 100 | 2.82 | 127 | 2.83 | 81 | 2.81 | 98 | 2.82 | 123 | 2.82 |
| 111 | B | 60 | 2.00 | 100 | 2.09 | 120 | 2.10 | 68 | 2.04 | 99 | 2.10 | 114 | 2.11 |
| | G | 81 | 1.99 | 100 | 2.00 | 120 | 2.01 | 83 | 2.00 | 100 | 2.00 | 119 | 2.01 |
| | R | 85 | 2.75 | 100 | 2.80 | 125 | 2.80 | 88 | 2.79 | 100 | 2.80 | 122 | 2.80 |
| 112 | B | 59 | 1.99 | 100 | 2.09 | 121 | 2.11 | 68 | 2.03 | 99 | 2.10 | 114 | 2.10 |
| | G | 74 | 2.52 | 100 | 2.58 | 122 | 2.58 | 81 | 2.57 | 100 | 2.58 | 122 | 2.58 |
| | R | 85 | 2.75 | 100 | 2.79 | 126 | 2.80 | 88 | 2.79 | 100 | 2.80 | 122 | 2.80 |
| 113 | B | 50 | 1.38 | 100 | 1.87 | 138 | 2.10 | 21 | 0.84 | 74 | 1.51 | 121 | 1.95 |
| | G | 68 | 2.24 | 100 | 2.46 | 131 | 2.63 | 49 | 1.98 | 83 | 2.27 | 129 | 2.56 |
| | R | 71 | 2.17 | 100 | 2.43 | 129 | 2.66 | 58 | 2.03 | 86 | 2.32 | 128 | 2.59 |

It can be seen from Table 2 that the combinations of couplers according to the present invention show rapid progress of development even when processed with a color developing solution containing substantially no benzyl alcohol. To the contrary, Sample 113 using comparative couplers does not fulfil the object of the present invention due to serious delay in development when processed with a developing solution containing no benzyl alcohol.

EXAMPLE 2

A paper support laminated with polyethylene on both sides thereof was coated with the following 1st to 11th layer to prepare Sample 201. The polyethylene layer on the side to be coated had dispersed therein titanium white as a white pigment and a trace amount of ultramarine as a bluish dye.

| | |
|---|---|
| **1st Layer (Antihalation Layer):** | |
| Black colloidal silver | 0.01 g/m$^2$ |
| Gelatin | 0.2 g/m$^2$ |
| **2nd Layer (Low-Sensitive Red-Sensitive Layer):** | |
| Silver iodobromide emulsion (silver iodide: 3.5 mol %; mean grain size: 0.7 μm) spectrally sensitized with red sensitizing dyes (*1,*2) | 0.15 g of Ag/m$^2$ |
| Gelatin | 1.0 g/m$^2$ |

-continued

| | |
|---|---|
| Cyan Coupler (C-2) | 0.30 g/m$^2$ |
| Discoloration Inhibitor (UV-14) | 0.15 g/m$^2$ |
| Coupler Solvent (S-6 & S-31) | 0.06 g/m$^2$ |
| **3rd Layer (High-Sensitive Red-Sensitive Layer):** | |
| Silver iodobromide emulsion (silver iodide: 8.0 mol %; mean grain size: 0.7 μm) spectrally sensitized with red sensitizing dyes (*1,*2) | 0.10 g of Ag/m$^2$ |
| Gelatin | 0.50 g/m$^2$ |
| Cyan Coupler (C-2) | 0.10 g/m$^2$ |
| Discoloration Inhibitor (UV-14) | 0.05 g/m$^2$ |
| Coupler Solvent (S-6 & S-31) | 0.02 g/m$^2$ |
| **4th Layer (Intermediate Layer):** | |
| Yellow colloidal silver | 0.02 g/m$^2$ |
| Gelatin | 1.00 g/m$^2$ |
| Color mixing inhibitor (*7) | 0.08 g/m$^2$ |
| Color mixing inhibitor solvent (S-16) | 0.16 g/m$^2$ |
| Polyethyl acrylate latex | 0.40 g/m$^2$ |
| **5th Layer (Low-Sensitive Green-Sensitive Layer):** | |
| silver iodobromide emulsion (silver iodide: 2.5 mol %; mean grain size: 0.4 μm) spectrally sensitized with green sensitizing dye (*6) | 0.20 g of Ag/m$^2$ |
| Gelatin | 0.70 g/m$^2$ |
| Magenta Coupler (M-23) | 0.40 g/m$^2$ |
| Discoloration Inhibitor A (*5) | 0.05 g/m$^2$ |
| Discoloration Inhibitor B (*4) | 0.05 g/m$^2$ |
| Discoloration Inhibitor C (*3) | 0.02 g/m$^2$ |
| Coupler Solvent (S-6) | 0.40 g/m$^2$ |

-continued

| | |
|---|---|
| **6th Layer (High-Sensitive Green-Sensitive Layer):** | |
| Silver iodobromide emulsion (silver iodide: 35 mol %; mean grain size: 0.9 μm) spectrally sensitized with green sensitizing dye (*6) | 0.20 g of Ag/m$^2$ |
| Gelatin | 0.70 g/m$^2$ |
| Magenta Coupler (M-23) | 0.40 g/m$^2$ |
| Discoloration Inhibitor A | 0.05 g/m$^2$ |
| Discoloration Inhibitor B | 0.05 g/m$^2$ |
| Discoloration Inhibitor C | 0.02 g/m$^2$ |
| Coupler Solvent (S-6) | 0.40 g/m$^2$ |
| **7th Layer (Yellow Filter Layer):** | |
| Yellow colloidal silver | 0.20 g/m$^2$ |
| Gelatin | 1.00 g/m$^2$ |
| Color mixing inhibitor (*7) | 0.06 g/m$^2$ |
| Color mixing inhibitor solvent (S-16) | 0.24 g/m$^2$ |
| **8th Layer (Low-Sensitive Blue-Sensitive Layer):** | |
| Silver iodobromide emulsion (silver iodide: 2.5 mol %; mean grain size: 0.5 μm) spectrally sensitized with blue sensitizing dye (*8) | 0.15 g of Ag/m$^2$ |
| Gelatin | 0.50 g/m$^2$ |
| Yellow Coupler (Y-9) | 0.20 g/m$^2$ |
| Coupler Solvent (S-6) | 0.05 g/m$^2$ |
| **9th Layer (High-Sensitive Blue-Sensitive Layer):** | |
| Silver iodobromide emulsion (silver iodide: 2.5 mol %; mean grain size: 1.4 μm) spectrally sensitized with blue sensitizing dye (*8) | 0.20 g of Ag/m$^2$ |
| **10th Layer (Ultraviolet Absorbing Layer):** | |
| Geletin | 1.50 g/m$^2$ |
| Ultraviolet absorbent (*10) | 1.0 g/m$^2$ |
| Ultraviolet absorbent solvent (S-6) | 0.30 g/m$^2$ |
| Color mixing inhibitor (*9) | 0.08 g/m$^2$ |
| **11th Layer (Protective Layer):** | |
| Gelatin | 1.0 g/m$^2$ |

The compounds used in the sample preparation are as follows:
(*1) 5,5'-Dichloro-3,3'-di(3-sulfobutyl)-9-ethyl-thiacarbonylcyanine sodium salt
(*2) Triethylammonium 3-{2-{2-[3-(3-sulfopropyl)-naphtho(1,2-d)thiazolin-2-ylidenemethyl]-1-butenyl}-3-naphtho(1,2-d)thiazolino}propane-sulfonate
(*3) 2,4-Di-t-hexylhydroquinone
(*4) Di-(2-hydroxy-3-t-butyl-5-methylphenyl)-methane
(*5) 3,3,3',3'-Tetramethyl-5,6,5',6'-tetra-propoxy-1,1'-bisspiroindane
(*6) 5,5'-Diphenyl-9-ethyl-3,3'-disulfopropyloxy-carbocyanine sodium salt
(*7) 2,4-Di-t-octylhydroquinone
(*8) Triethylammonium 3-[2-(3-benzylrhodanin-5-ylidene)-3-benzoxazolinyl]propanesulfonate
(*9) 2,4-Di-sec-octylhydroquinone
(*10) 5-Chloro-2-(2-hydroxy-3-t-butyl-5-t-octyl)-phenylbenzotriazole Comparative Sample 202 was prepared in the same manner as for Sample 201 except that the cyan coupler in the 2nd and 3rd layers, the magenta coupler in the 5th and 6th layers, and the yellow coupler in the 8th and 9th layers were replaced with Cyan Coupler (c), Magenta Coupler (b), and Yellow Coupler (a) as used in Sample 113 of Example 1.

Each of Samples 201 and 202 was wedgewise exposed to light in a usual manner and processed according to Processing C shown below to obtain a color reversal image.

| Step | Temperature | Time |
|---|---|---|
| **Processing C:** | | |
| First Development (Black-and-White Development) | 38° C. | 1'15" |
| Washing | 38° C. | 2'15" |
| Reversal Exposure | ≧100 lux | ≧1" |
| Color Development | 38° C. | 1'30" |
| Washing | 38° C. | 45" |
| Bleach-Fixing | 38° C. | 2'00" |
| Washing | 38° C. | 2'15" |

Each of the processing solutions used in Processing C had the following formulation.

| | |
|---|---|
| **Formulation of First Developer:** | |
| Sodium nitrilo-N,N,N—trimethylene-sulfonate | 0.6 g |
| Pentasodium dietylenetriamine-pentaacetate | 4.0 g |
| Potassium sulfite | 30.0 g |
| Potassium thiocyanate | 1.2 g |
| Potassium carbonate | 35.0 g |
| Potassium hydroquinone monosulfonate | 25.0 g |
| Diethylene glycol | 15.0 ml |
| 1-Phenyl-4-hydroxymethyl-4-methyl-3-pyrazolidone | 2.0 g |
| Potassium bromide | 0.5 g |
| Potassium iodide | 5.0 mg |
| Water to make | 1000 ml |
| | (pH = 9.70) |
| **Formulation of Color Developer:** | |
| Benzyl alcohol | 15.0 ml |
| Diethylene glycol | 12.0 ml |
| 3,6-Dithia-1,8-octanediol | 0.2 g |
| Pentasodium nitrilo-N,N,N—tri-methylenephosphonate | 0.5 g |
| Pentasodium diethylenetriamine-pentaacetate | 2.0 g |
| Sodium sulfite | 2.0 g |
| Potassium carbonate | 25.0 g |
| Hydroxylamine sulfate | 3.0 g |
| N—Ethyl-N—(β-methanesulfonamido-ethyl)-3-methyl-4-aminoaniline sulfate | 5.0 g |
| Potassium bromide | 0.5 g |
| Potassium iodide | 1.0 mg |
| Water to make | 1000 ml |
| | (pH = 10.40) |
| **Formulation of Bleach-Fixing Bath:** | |
| 2-Mercapto-1,3,4-triazole | 1.0 g |
| Disodium ethylenediaminetetra-acetate dihydrate | 5.0 g |
| Ammonium (ethylenediaminetetra-acetato)iron (III) monohydrate | 80.0 g |
| Sodium sulfite | 15.0 g |
| Sodium thiosulfate (70% solution) | 160.0 ml |
| Glacial acetic acid | 5.0 ml |
| Water to make | 1000 ml |
| | (pH = 6.50) |

The same procedure as described above was repeated except that benzyl alcohol was excluded from the formulation of the color developer (hereinafter referred to as Processing D).

Each of the resulting reversal images was determined for maximum density ($D_{max}$) to red, green, or blue light. The results obtained are shown in Table 3.

TABLE 3

| Sample No. | Light | Processing C | Processing D |
|---|---|---|---|
| 201 | red | 3.34 | 3.32 |
| | green | 3.29 | 3.27 |
| | blue | 3.02 | 3.01 |
| 202 | red | 2.98 | 2.04 |
| | green | 2.97 | 2.15 |
| | blue | 2.52 | 1.86 |

It can be seen from Table 3 that the sample according to the present invention provides sufficient maximum densities irrespective of whether a color developer contains benzyl alcohol or not, while the comparative sample undergoes reduction in density particularly when processed according to Processing D in which no benzyl alcohol is used.

EXAMPLE 3

Samples 301 to 305 were prepared in the same manner as for Samples 109 to 113 of Example 1, respectively, except that: (i) The silver chlorobromide emulsion in the 1st layer (blue-sensitive layer) was replaced with the same silver amount of a cubic silver chlorobromide emulsion having a silver bromide content of 4 mol% and a mean grain size of 0.95 μm. (ii) The amount of the blue-sensitizing dye to be used in the 1st layer was decreased to $5.5\times10^{-4}$ mol per mol of silver. (iii) The silver chlorobromide emulsion in the 3rd layer (green-sensitive layer) was replaced with the same silver amount of a cubic silver chlorobromide emulsion having a silver bromide content of 57 mol% and a mean grain size of 0.55 μm. And, (iv) the silver chlorobromide emulsion in the 5th layer (red-sensitive layer) was replaced with the same silver amount of a cubic silver chlorobromide emulsion having a silver bromide content of 35 mol% and a mean grain size of 0.45 μm.

Samples 306 to 309 were prepared in the same manner as for Samples 301 to 304, respectively, except for replacing Yellow Coupler (Y-35) used in Samples 301 to 304 with Yellow Coupler (Y-36).

Each of Sampels 301 to 309 was exposed to light for 0.2 second at an exposure of 250 CMS using an optical wedge for sensitometry through a blue (B), green (G), or red (R) filter by means of a sensitometer (FWH Model manufactured by Fuji Photo Film Co., Ltd.; color temperature: 3,200° K.). The exposed sample was subjected to Processing E or F according to the following procedure. Formulations of the processing solutions used are also described below. The procedure for Processing E and that for Processing F are equal except for using Developer E or F, respectively.

| Processing Procedure: | | |
|---|---|---|
| Processing Step | Temperature | Time |
| Color Development | 35° C. | 45 to 100 sec |
| Bleach-Fixing | 35° C. | 45 sec |
| Washing | 28–35° C. | 90 sec |

| Formulation of Developer (E): | |
|---|---|
| Diethylenetriaminepentaacetic acid | 2.0 g |
| Benzyl alcohol | 15 ml |
| Diethylene glycol | 10 ml |
| Sodium sulfite | 2.0 g |
| Potassium bromide | 0.3 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| Sodium carbonate monohydrate | 40.0 g |
| Water to make | 1000 ml (pH = 10.4) |

| Formation of Developer (F): | |
|---|---|
| Diethylenetriaminepentaacetic acid | 2.0 g |
| Sodium sulfite | 2.0 g |
| Potassium bromide | 0.3 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| Sodium carbonate monohydrate | 40.0 g |
| Water to make | 1000 ml (pH = 10.4) |

| Formulation of Bleach-Fixing Bath: | |
|---|---|
| Ammonium thiosulfate (54% solution) | 150 ml |
| Sodium sulfite | 15 g |
| Ammonium (ethylenediaminetetra-acetato)iron (III) | 55 g |
| Disodium ethylenediaminetetraacetate | 4 g |
| Water to make | 1000 ml (pH = 6.9) |

Photographic properties of the processed samples were evaluated in the same manner as described in Example 1. The sensitivity of each layer of the respective sample when processed according to Processing E for a developing time of 100 seconds was taken as standard (100). The results obtained are shown in Table 4.

TABLE 4

| | | Processing E | | | | Processing F | | | |
|---|---|---|---|---|---|---|---|---|---|
| | | 45 sec. | | 100 sec. | | 45 sec. | | 100 sec. | |
| Sample No. | Layer | Relative Sensitivity | $D_{max}$ | Relative Sensitivity | $D_{max}$ | Relative Sensitivity | $D_{max}$ | Relative Sensitivity | $D_{max}$ |
| 301 | B | 51 | 2.02 | 100 | 2.17 | 46 | 2.02 | 81 | 2.11 |
| | G | 60 | 2.53 | 100 | 2.61 | 51 | 2.50 | 79 | 2.54 |
| | R | 61 | 2.90 | 100 | 2.91 | 43 | 2.80 | 66 | 2.81 |
| 302 | B | 56 | 1.98 | 100 | 2.13 | 46 | 1.98 | 83 | 2.08 |
| | G | 62 | 2.62 | 100 | 2.73 | 47 | 2.67 | 71 | 2.67 |
| | R | 58 | 2.96 | 100 | 2.99 | 40 | 2.85 | 62 | 2.85 |
| 303 | B | 56 | 2.01 | 100 | 2.14 | 47 | 2.00 | 83 | 2.07 |
| | G | 64 | 2.14 | 100 | 2.16 | 48 | 2.14 | 85 | 2.14 |
| | R | 59 | 2.94 | 100 | 2.98 | 42 | 2.83 | 63 | 2.84 |
| 304 | B | 51 | 2.02 | 100 | 2.17 | 45 | 2.00 | 81 | 2.10 |
| | G | 60 | 2.56 | 100 | 2.64 | 51 | 2.48 | 79 | 2.54 |
| | R | 59 | 2.94 | 100 | 2.97 | 44 | 2.83 | 66 | 2.84 |
| 305 | B | 36 | 1.93 | 100 | 2.02 | 30 | 1.14 | 62 | 1.65 |
| | G | 29 | 2.19 | 100 | 2.56 | 19 | 1.72 | 59 | 2.10 |
| | R | 34 | 2.14 | 100 | 2.39 | 27 | 1.93 | 55 | 2.10 |
| 306 | B | 51 | 2.03 | 100 | 2.16 | 43 | 2.01 | 79 | 2.09 |
| | G | 61 | 2.52 | 100 | 2.60 | 51 | 2.53 | 81 | 2.57 |
| | R | 60 | 2.83 | 100 | 2.90 | 43 | 2.78 | 68 | 2.80 |
| 307 | B | 50 | 2.00 | 100 | 2.12 | 44 | 1.99 | 81 | 2.07 |
| | G | 63 | 2.62 | 100 | 2.73 | 48 | 2.69 | 74 | 2.70 |
| | R | 59 | 2.96 | 100 | 2.97 | 42 | 2.81 | 63 | 2.84 |
| 308 | B | 50 | 1.99 | 100 | 2.10 | 43 | 1.98 | 81 | 2.07 |
| | G | 64 | 2.17 | 100 | 2.20 | 56 | 2.18 | 85 | 2.20 |
| | R | 59 | 2.96 | 100 | 2.98 | 43 | 2.84 | 65 | 2.84 |
| 309 | B | 50 | 2.01 | 100 | 2.15 | 43 | 1.99 | 79 | 2.10 |
| | G | 62 | 2.55 | 100 | 2.63 | 45 | 2.50 | 83 | 2.55 |

TABLE 4-continued

| Sample No. | Layer | Processing E 45 sec. Relative Sensitivity | Processing E 45 sec. $D_{max}$ | Processing E 100 sec. Relative Sensitivity | Processing E 100 sec. $D_{max}$ | Processing F 45 sec. Relative Sensitivity | Processing F 45 sec. $D_{max}$ | Processing F 100 sec. Relative Sensitivity | Processing F 100 sec. $D_{max}$ |
|---|---|---|---|---|---|---|---|---|---|
| | R | 58 | 2.94 | 100 | 2.99 | 43 | 2.83 | 66 | 2.83 |

As can be seen from Table 4, the combination of the couplers according to the present invention exhibits excellent performances when processed in a color developer containing no benzyl alcohol and, in particular, for a reduced developing time. To the contrary, the comparative combination of couplers shows low sensitivity and low color densities.

EXAMPLE 4

Samples 401 to 409 were prepared in the same manner as for Samples 301 to 309 of Example 3, respectively, except that the silver chlorobromide emulsion to be used in the 3rd layer (green-sensitive layer) was replaced with the same silver amount of a silver chlorobromide emulsion having a silver bromide content of 10 mol% and a mean grain size of 0.54 μm and that the silver chlorobromide emulsion to be used in the 5th layer (red-sensitive layer) was replaced with the same silver amount of a silver chlorobromide emulsion having a silver bromide content of 10 mol% and a mean grain size of 0.44 μm.

Each of the resulting samples was sensitometrically exposed to light in the same manner as in Example 3 and then processed in the same manner as in Example 3 except for using Color Developer (G) (Processing (G)) or Color Developer (H) (Processing (H)) having the following formulation.

Formulation of Developer (G):

-continued

| | |
|---|---|
| Diethylenetriaminepentaacetic acid | 2.0 g |
| Benzyl alcohol | 15 ml |
| Diethylene glycol | 10 ml |
| Sodium sulfite | 2.0 g |
| Potassium bromide | 0.15 g |
| Adenine | 0.03 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| Sodium carbonate monohydrate | 40.0 g |
| Water to make | 1000 ml (pH = 10.4) |

Formulation of Developer (H):

| | |
|---|---|
| Diethylenetriaminepentaacetic acid | 2.0 g |
| Sodium sulfite | 2.0 g |
| Potassium bromide | 0.15 g |
| Adenine | 0.03 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| Sodium carbonate monohydrate | 40.0 g |
| Water to make | 1000 ml (pH = 10.4) |

Photographic properties of the processed samples were evaluated in the same manner as described in Example 1. The sensitivity of each layer of the respective sample when processed according to Processing (G) for a developing time of 100 seconds was taken as standard (100). The results obtained are shown in Table 5 below.

TABLE 5

| Sample No. | Layer | Processing G 45 sec. Relative Sensitivity | Processing G 45 sec. $D_{max}$ | Processing G 100 sec. Relative Sensitivity | Processing G 100 sec. $D_{max}$ | Processing H 45 sec. Relative Sensitivity | Processing H 45 sec. $D_{max}$ | Processing H 100 sec. Relative Sensitivity | Processing H 100 sec. $D_{max}$ |
|---|---|---|---|---|---|---|---|---|---|
| 401 | B | 53 | 2.09 | 100 | 2.17 | 62 | 2.08 | 83 | 2.13 |
| | G | 83 | 2.56 | 100 | 2.60 | 66 | 2.52 | 78 | 2.56 |
| | R | 85 | 2.88 | 100 | 2.88 | 62 | 2.84 | 71 | 2.84 |
| 402 | B | 58 | 2.07 | 100 | 2.13 | 63 | 2.05 | 83 | 2.08 |
| | G | 93 | 2.62 | 100 | 2.64 | 65 | 2.60 | 67 | 2.62 |
| | R | 87 | 2.96 | 100 | 2.97 | 62 | 2.84 | 69 | 2.85 |
| 403 | B | 58 | 2.07 | 100 | 2.14 | 62 | 2.04 | 85 | 2.06 |
| | G | 87 | 2.11 | 100 | 2.12 | 74 | 2.10 | 83 | 2.12 |
| | R | 87 | 2.99 | 100 | 2.99 | 62 | 2.84 | 69 | 2.83 |
| 404 | B | 53 | 2.05 | 100 | 2.16 | 62 | 2.05 | 83 | 2.10 |
| | G | 81 | 2.59 | 100 | 2.65 | 66 | 2.51 | 79 | 2.56 |
| | R | 86 | 2.96 | 100 | 2.97 | 63 | 2.86 | 71 | 2.88 |
| 405 | B | 41 | 1.96 | 100 | 2.00 | 60 | 1.29 | 65 | 1.67 |
| | G | 50 | 2.33 | 100 | 2.68 | 31 | 1.94 | 62 | 2.30 |
| | R | 60 | 2.30 | 100 | 2.55 | 40 | 2.07 | 59 | 2.24 |
| 406 | B | 53 | 2.07 | 100 | 2.15 | 50 | 2.04 | 81 | 2.07 |
| | G | 83 | 2.56 | 100 | 2.61 | 66 | 2.60 | 79 | 2.62 |
| | R | 88 | 2.87 | 100 | 2.88 | 62 | 2.82 | 69 | 2.81 |
| 407 | B | 53 | 2.05 | 100 | 2.13 | 62 | 2.03 | 83 | 2.07 |
| | G | 92 | 2.58 | 100 | 2.61 | 65 | 2.60 | 69 | 2.61 |
| | R | 90 | 2.96 | 100 | 2.99 | 63 | 2.82 | 69 | 2.83 |
| 408 | B | 53 | 2.06 | 100 | 2.08 | 62 | 2.03 | 83 | 2.05 |
| | G | 87 | 2.14 | 100 | 2.15 | 72 | 2.15 | 83 | 2.15 |
| | R | 91 | 2.97 | 100 | 2.98 | 63 | 2.83 | 68 | 2.86 |
| 409 | B | 53 | 2.08 | 100 | 2.17 | 60 | 2.06 | 81 | 2.12 |
| | G | 87 | 2.58 | 100 | 2.61 | 68 | 2.54 | 78 | 2.60 |

TABLE 5-continued

| Sample No. | Layer | Processing G 45 sec. Relative Sensitivity | Processing G 45 sec. $D_{max}$ | Processing G 100 sec. Relative Sensitivity | Processing G 100 sec. $D_{max}$ | Processing H 45 sec. Relative Sensitivity | Processing H 45 sec. $D_{max}$ | Processing H 100 sec. Relative Sensitivity | Processing H 100 sec. $D_{max}$ |
|---|---|---|---|---|---|---|---|---|---|
| | R | 90 | 2.97 | 100 | 2.98 | 63 | 2.83 | 71 | 2.85 |

It is clear from the foregoing results that in the light-sensitive materials according to the present invention, a high density can be obtained even when processed in a further reduced developing time with a color developing solution containing no benzyl alcohol.

EXAMPLE 5

A paper support laminated with polyethylene on both sides thereof was coated with the following 1st to 7th layers in this order to prepare a multilayer color paper. The polyethylene layer on the side to be coated had dispersed therein titanium dioxide as a white pigment and ultramarine as a bluish dye.

| | |
|---|---|
| 1st Layer (Blue-Sensitive Layer): | |
| Silver chlorobromide emulsion (silver bromide: 1 mol %) | 0.26 g of Ag/m$^2$ |
| Gelatin | 1.83 g/m$^2$ |
| Yellow Coupler (Y-35) | 0.91 g/m$^2$ |
| Dye Image Stabilizer (B-18) | 0.19 g/m$^2$ |
| Solvent (S-25) | 0.36 ml/m$^2$ |
| 2nd Layer (Color Mixing Preventing Layer): | |
| Gelatin | 0.99 g/m$^2$ |
| Color Mixing Inhibitor (*a) | 0.08 g/m$^2$ |
| 3rd Layer (Green-Sensitive Layer): | |
| Silver chlorobromide emulsion (silver bromide: 1 mol %) | 0.15 g of Ag/m$^2$ |
| Gelatin | 1.80 g/m$^2$ |
| Magenta Coupler (M-31) | 0.38 g/m$^2$ |
| Dye Image Stabilizer (G-13) | 0.16 g/m$^2$ |
| Solvent (S-16) | 0.38 ml/m$^2$ |
| 4th Layer (Ultraviolet Absorbing Layer): | |
| Gelatin | 1.60 g/m$^2$ |
| Ultraviolet Absorbent (UV-3:UV-14: UV-16 = 1:5:3 by mol) | 0.62 g/m$^2$ |
| Color Mixing Inhibitor (G-2) | 0.05 g/m$^2$ |
| Solvent (S-9) | 0.26 ml/g$^2$ |
| 5th Layer (Red-Sensitive Layer): | |
| Silver chlorobromide emulsion (silver bromide: 1 mol %) | 0.22 g of Ag/m$^2$ |
| Gelatin | 0.90 g/m$^2$ |
| Cyan coupler (C-3) | 0.36 g/m$^2$ |
| Dye Image Stabilizer (UV-3:UV-1: UV-14 = 1:3:3 by mol) | 0.17 g/m$^2$ |
| Solvent (S-25) | 0.22 ml/m$^2$ |
| 6th Layer (Ultraviolet Absorbing Layer): | |
| Gelatin | 0.54 g/m$^2$ |
| Ultraviolet Absorbent (UV-3:UV-14: UV-16 = 1:5:3 by mol) | 0.21 g/m$^2$ |
| Solvent (S-9) | 0.09 ml/m$^2$ |
| 7th Layer (Protective Layer): | |
| Gelatin | 1.33 g/m$^2$ |

-continued

| | |
|---|---|
| Acryl-modified polyvinyl alcohol copolymer (degree of modification: 17%) | 0.17 g/m$^2$ |

Note: *a:

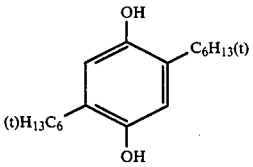

Each of the coating compositions was prepared in the same manner as described in Example 1 except for using the following spectral sensitizing dyes.

Blue-Sensitizing Dye (for Blue-Sensitive Layer):

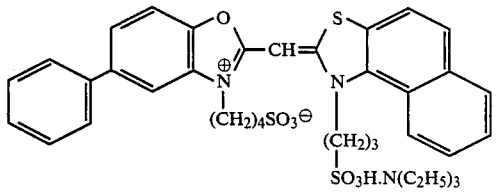

($7.0 \times 10^{-4}$ mol/mol of silver halide)

Green-Sensitizing Dye (for Green-Sensitive Layer):

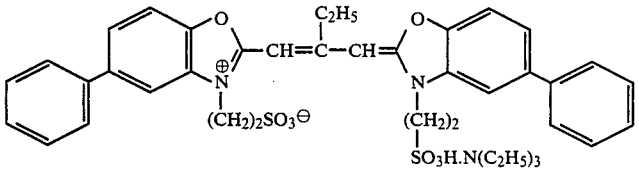

($4.0 \times 10^{-4}$ mol/mol of silver halide)

Red-Sensitizing Dye (for Red-Sensitive Layer):

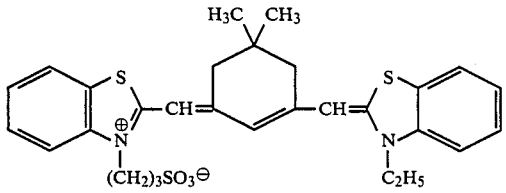

($1.0 \times 10^{-4}$ mol/mol of silver halide)

The above prepared sample was designated as Sample 501. Samples 502 to 510 and 512 were prepared. in the same manner as for Sample 501 except that the kind and amount of the coupler and the amount of the silver halide emulsion to be used in the 1st, 3rd, or 5th layer were changed as shown in Table 6.

TABLE 6

| Sample No. | 1st Layer Coupler | 1st Layer Coupler Amount (g/m²) | 1st Layer Silver Amount (g/m²) | 3rd Layer Coupler | 3rd Layer Coupler Amount (g/m²) | 3rd Layer Silver Amount (g/m²) | 5th Layer Coupler | 5th Layer Coupler Amount (g/m²) | 5th Layer Silver Amount (g/m²) |
|---|---|---|---|---|---|---|---|---|---|
| 502 | Y-36 | 0.72 | 0.31 | M-1 | 0.35 | 0.24 | C-1 | 0.33 | 0.26 |
| 503 | " | " | " | " | " | " | C-2 | 0.34 | " |
| 504 | " | " | " | " | " | " | C-25 | 0.44 | 0.27 |
| 505 | " | " | " | M-23 | 0.33 | 0.16 | C-2 | 0.34 | 0.26 |
| 506 | " | " | " | " | " | " | C-3 | 0.40 | 0.27 |
| 507 | " | " | " | " | " | " | C-27 | 0.42 | 0.28 |
| 508 | " | " | " | M-31 | 0.45 | 0.15 | C-1 | 0.33 | 0.26 |
| 509 | " | " | " | " | " | " | C-3 | 0.40 | 0.27 |
| 510 | " | " | " | " | " | " | C-29 | 0.38 | 0.27 |
| 512 | (a) | 0.58 | 0.60 | (b) | 0.33 | 0.32 | (c) | 0.31 | 0.52 |

Note: Couplers (a), (b), and (c) are the same as used in Example 1.

Separately, a paper support laminated with polyethylene on both sides thereof which had been subjected to corona discharge treatment was coated with the following 1st to 7th layer in this order to prepare Sample 511.

| | |
|---|---|
| 1st Layer (Blue-Sensitive Layer): | |
| Silver chlorobromide emulsion (silver bromide: 1 mol %) | 290 mg of Ag/m² |
| Yellow Coupler (*2a) | 600 mg/m² |
| Discoloration inhibitor (*2b) | 280 mg/m² |
| Solvent (S-30) | 30 mg/m² |
| Solvent (S-25) | 15 mg/m² |
| Gelatin | 1800 mg/m² |
| 2nd Layer (Color Mixing Preventing Layer): | |
| Silver bromide emulsion (primary; mean grain size: 0.05 μm | 10 mg of Ag/m² |
| Color Mixing Inhibitor (G-2) | 55 mg/m² |
| Solvent (S-30) | 30 mg/m² |
| Solvent (S-25) | 15 mg/m² |
| Gelatin | 800 mg/m² |
| 3rd Layer (Green-sensitive Layer): | |
| Silver chlorobromide emulsion (silver bromide: 1 mol %) | 305 mg of Ag/m² |
| Magenta Coupler (M-2) | 670 mg/m² |
| Discoloration Inhibitor (*2c) | 150 mg/m² |
| Discoloration Inhibitor (G-17) | 10 mg/m² |
| Solvent (S-30) | 200 mg/m² |
| Solvent (S-25) | 10 mg/m² |
| Gelatin | 1400 mg/m² |
| 4th Layer (Color Mixing Preventing Layer): | |
| Color mixing inhibitor (G-2) | 65 mg/m² |
| Ultraviolet Absorbent (UV-5) | 450 mg/m² |
| Ultraviolet Absorbent (UV-4) | 230 mg/m² |
| Solvent (S-30) | 50 mg/m² |
| Solvent (S-25) | 50 mg/m² |
| Gelatin | 1700 mg/m² |
| 5th Layer (Red-Sensitive Layer): | |
| Silver chlorobromide emulsion (silver bromide: 1 mol %) | 210 mg of Ag/m² |
| Cyan Coupler (C-18) | 260 mg/m² |
| Cyan Coupler (C-1) | 120 mg/m² |
| Discoloration Inhibitor (*2b) | 250 mg/m² |
| Solvent (S-30) | 160 mg/m² |
| Solvent (S-25 ) | 100 mg/m² |
| Gelatin | 1800 mg/m² |
| 6th Layer (Ultraviolet Absorbing Layer): | |
| Ultraviolet Absorbent (UV-5) | 260 mg/m³ |
| Ultraviolet Absorbent (UV-4) | 70 mg/m² |
| Solvent (S-30) | 300 mg/m² |
| Solvent (S-25) | 100 mg/m² |
| Gelatin | 700 mg/m² |
| 7th Layer (Protective Layer): | |

-continued

| | |
|---|---|
| Gelatin | 600 mg/m² |

Note:
*2a: Yellow Coupler

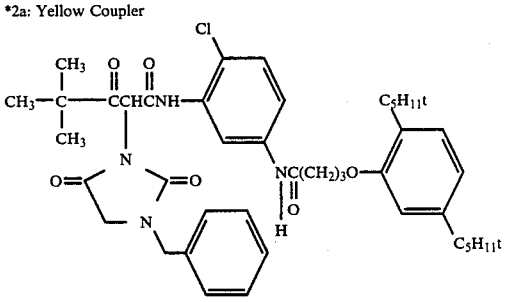

*2b: Discoloration Inhibitor 2,5-Di-t-amylphenyl-3,5-di-t-butylhydroxybenzoate
*2c: Discoloration Inhibitor 1,4-Di-t-amyl-2,5-dioctyloxybenzene Each of the coating compositions for the 1st to 7th layers was prepared as follows, taking that for the 1st layer as an example: A mixture comprising 200 g of Yellow Coupler, 93.3 g of Discoloration Inhibitor, 10 g of Solvent (S-30) and 5 g of Solvent (S-25) as high-boiling organic solvent, and 600 ml of ethyl acetate as an auxiliary solvent was heated at 60° C. to dissolve. The resulting solution was mixed with 3300 ml of a 5% aqueous solution of gelatin containing 330 ml of a 5% aqueous solution of Alkanol ®B (alkylnaphthalene sulfonate, produced by E. I. Du Pont), followed by emulsifying by means of a colloid mill to prepare a coupler dispersion. The ethyl acetate was removed from the dispersion by distillation under reduced pressure, and the residue was added to 1400 g of Emulsion (Ag content: 96.7 g; gelatin content: 170 g) to which a sensitizing dye for a blue-sensitive layer and 1-methyl-2-mercapto-5-acetylamino-1,3,4-triazole had been added. To the mixture was further added 2600 g of a 10% aqueous solution of gelatin to prepare a coating composition. The sensitizing dyes used are shown below.

Blue-Sensitizing Dye (for Blue-Sensitive Layer): Anhydro-5-methoxy-5'-methyl-3,3'-disulfopropylselenacyanine hydroxide Green-Sensitizing Dye (for Green-Sensitive Layer): Anhydro-9-ethyl-5,5'-diphenyl-3,3'-disulfoethyloxyacarbocyanine hydroxide Red-Sensitizing Dye (for Red-Sensitive Layer): 3,3'-Diethyl-5-methoxy-9,9'-(2,2-dimethyl-1,3-propano)-thiadicarbocyanine iodide An anti-irradiation dyes, dipotassium 4-(3-carboxy-5-hydroxy-4-{3-[3-carboxy-5-oxo-1-(4-sulfonatophenyl)-2-pyrazolin-4-ylidene]-1-propenyl}-1-pyrazolyl benzenesulfonate and tetrasodium N,N'-(4,8-dihydroxy- 9,10-dioxo-3,7-disulfonatoanthracene-1,5-diyl)bis-(aminomethanesulfonate) were used. 1,2-Bis(vinylsulfonyl)ethane was used as a hardening agent.

Each of Samples 501 to 512 was exposed to light for sensitometry under the same conditions as used in Example 1 and then subjected to Processing (I) using Color Developer (I) or Processing (J) using Color Developer (J) according to the following procedure. Formulations of the processing solutions used are also described below.

| Processing Procedure: | | |
|---|---|---|
| Processing Step | Temperature (°C.) | Time (sec) |
| Color Development | 35 | 45 |
| Bleach-Fixing | 35 | 45 |
| Rinsing 1 | 35 | 20 |
| Rinsing 2 | 35 | 20 |
| Rinsing 3 | 35 | 20 |
| Drying | 80 | 60 |

| Formulation of Developer (I): | |
|---|---|
| Pentasodium diethylenetriamine-pentaacetate | 2.0 g |
| Benzyl alcohol | 15 ml |
| Diethylene glycol | 10 ml |
| Sodium sulfite | 2.0 g |
| Potassium bromide | 0.01 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| Sodium carbonate monohydrate | 30.0 g |
| Fluorescent brightening agent (stilbene type) | 1.0 g |
| Water to make | 1000 ml (pH = 10.2) |

| Formulation of Developer (J): | |
|---|---|
| Triethanolamine | 10 g |
| N,N—Diethylhydroxylamine | 4 g |
| Fluorescent brightening agent (stilbene type) | 3.0 g |
| Sodium sulfite | 0.2 g |
| Potassium carbonate | 30 g |
| Disodium ethylenediaminetetra-acetate dihydrate | 2 g |
| Potassium bromide | 0.01 g |
| 4-Amino-3-methyl-N—ethyl-N—[β-(methanesulfonamido)ethyl]-p-phenylenediamine suflate | 5.0 g |
| Sodium chloride | 2.0 g |
| Water to make | 1000 ml (pH = 10.25) |

| Formulation of Bleach-Fixing Bath: | |
|---|---|
| Ammonium (ethylenediaminetetra-acetato)iron (III) dihydrate | 60 g |
| Disodium ethylenediaminetetra-acetate dihydrate | 4 g |
| Ammonium thiosulfate (70%) | 120 ml |
| Sodium sulfite | 16 g |
| Acetadelhyde-sulfurous acid adduct | 10 g |
| Glacial acetic acid | 7 g |
| Water to make | 1000 ml (pH = 5.5) |

| Formulation of Rinsing Bath: | |
|---|---|
| Disodium ethylenediaminetetra-acetate dihydrate | 0.4 g |
| Water to make | 1000 ml (pH = 7.0) |

The thus processed samples were evaluated for maximum density ($D_{max}$), minimum density ($D_{min}$), and relative sensitivity. The sensitivity of each sample when processed by Processing I was taken as standard (100). The results obtained are shown in Table 7.

TABLE 7

| | | Processing I | | | Processing J | | |
|---|---|---|---|---|---|---|---|
| Sample No. | Layer | $D_{min}$ | Relative Sensitivity | $D_{max}$ | $D_{min}$ | Relative Sensitivity | $D_{max}$ |
| 501 | B | 0.07 | 100 | 2.12 | 0.06 | 95 | 2.13 |
| | G | 0.10 | 100 | 2.70 | 0.09 | 99 | 2.69 |
| | R | 0.11 | 100 | 2.81 | 0.10 | 98 | 2.80 |
| 502 | B | 0.08 | 100 | 2.11 | 0.07 | 95 | 2.11 |
| | G | 0.10 | 100 | 2.71 | 0.09 | 100 | 2.77 |
| | R | 0.11 | 100 | 2.83 | 0.10 | 98 | 2.84 |
| 503 | B | 0.09 | 100 | 2.12 | 0.09 | 97 | 2.10 |
| | G | 0.10 | 100 | 2.58 | 0.10 | 99 | 2.49 |
| | R | 0.10 | 100 | 2.82 | 0.10 | 105 | 2.81 |
| 504 | B | 0.08 | 100 | 2.11 | 0.08 | 99 | 2.14 |
| | G | 0.10 | 100 | 2.58 | 0.09 | 101 | 2.60 |
| | R | 0.11 | 100 | 2.82 | 0.10 | 99 | 2.83 |
| 505 | B | 0.08 | 100 | 2.12 | 0.08 | 96 | 2.13 |
| | G | 0.09 | 100 | 2.79 | 0.09 | 97 | 2.81 |
| | R | 0.10 | 100 | 2.82 | 0.10 | 97 | 2.82 |
| 506 | B | 0.09 | 100 | 2.11 | 0.09 | 101 | 2.12 |
| | G | 0.10 | 100 | 2.68 | 0.10 | 99 | 2.70 |
| | R | 0.11 | 100 | 2.80 | 0.10 | 100 | 2.81 |
| 507 | B | 0.09 | 100 | 2.11 | 0.09 | 100 | 2.12 |
| | G | 0.11 | 100 | 2.78 | 0.11 | 100 | 2.79 |
| | R | 0.11 | 100 | 2.79 | 0.11 | 100 | 2.80 |
| 508 | B | 0.08 | 100 | 2.10 | 0.08 | 99 | 2.11 |
| | G | 0.09 | 100 | 2.79 | 0.10 | 98 | 2.80 |
| | R | 0.11 | 100 | 2.82 | 0.10 | 101 | 2.81 |
| 509 | B | 0.08 | 100 | 2.11 | 0.08 | 100 | 2.13 |
| | G | 0.09 | 100 | 2.68 | 0.09 | 100 | 2.70 |
| | R | 0.11 | 100 | 2.80 | 0.09 | 100 | 2.81 |
| 510 | B | 0.08 | 100 | 2.11 | 0.08 | 99 | 2.12 |
| | G | 0.09 | 100 | 2.81 | 0.09 | 99 | 2.77 |
| | R | 0.11 | 100 | 2.81 | 0.11 | 100 | 2.80 |
| 511 | B | 0.08 | 100 | 2.11 | 0.08 | 99 | 2.14 |
| | G | 0.09 | 100 | 2.87 | 0.09 | 106 | 2.90 |
| | R | 0.11 | 100 | 2.83 | 0.11 | 96 | 2.88 |
| 512 (comparison) | B | 0.08 | 100 | 2.10 | 0.06 | 74 | 1.51 |
| | G | 0.09 | 100 | 2.63 | 0.07 | 83 | 1.98 |
| | R | 0.10 | 100 | 2.66 | 0.07 | 86 | 2.03 |

It is apparent from Table 7 that the light-sensitive materials according to the present invention exhibit excellent color developing properties without undergoing serious fog formation even when processed in a reduced developing time with a color developing solution containing no benzyl alcohol; while the comparative sample shows considerable reduction in relative sensitivity and maximum density when processed under such conditions.

EXAMPLE 6

Samples 601 to 605 were prepared in the same manner as for Sample 501 to 504 and 507 of Example 5, respectively, except for using 0.24 g/m$^2$ of Magenta Coupler (M-13) and 0.32 g of Ag/m$^2$ of the silver chlorobromide emulsion (silver bromide: 1 mol%) in the 3rd layer.

Each of Samples 601 to 605 and Samples 502, 505, and 512 of Example 5 was exposed to light for sensitometry and development-processed in the same manner as described in Example 5 except for replacing Developer (J) with Developer (K) having the following formulation (the processing using Developer (K) is designated as Processing (K).

| Formulation of Developer (K): | |
|---|---|
| Polyethyleneimine | 2.3 g |
| Fluorescent brightening agent (4,4'-diaminostilbene type) | 3.0 g |
| Hydroxylamine sulfate | 0.2 g |

-continued

| | |
|---|---|
| Potassium carbonate | 30 g |
| Disodium ethylenediaminetetra-acetate dihydrate | 2.0 g |
| Potassium bromide | 0.01 g |
| 4-Amino-3-methyl-N—ethyl-N—[β-(methanesulfonamido)ethyl]-p-phenylenediamine sulfate | 5.0 g |
| Sodium chloride | 2.0 g |
| Water to make | 1000 ml (pH = 10.25) |

Photographic properties of the thus processed samples were evaluated in the same manner as in Example 5. The results obtained are shown in Table 8 below.

TABLE 8

| | | Processing I | | | Processing K | | |
|---|---|---|---|---|---|---|---|
| Sample No. | Layer | $D_{min}$ | Relative Sensitivity | $D_{max}$ | $D_{min}$ | Relative Sensitivity | $D_{max}$ |
| 601 | B | 0.07 | 100 | 2.13 | 0.06 | 97 | 2.14 |
| | G | 0.11 | 100 | 2.72 | 0.10 | 100 | 2.74 |
| | R | 0.11 | 100 | 2.81 | 0.10 | 98 | 2.80 |
| 602 | B | 0.08 | 100 | 2.11 | 0.07 | 96 | 2.13 |
| | G | 0.09 | 100 | 2.74 | 0.08 | 99 | 2.73 |
| | R | 0.11 | 100 | 2.83 | 0.10 | 99 | 2.85 |
| 603 | B | 0.09 | 100 | 2.12 | 0.06 | 99 | 2.14 |
| | G | 0.11 | 100 | 2.72 | 0.10 | 102 | 2.76 |
| | R | 0.10 | 100 | 2.82 | 0.09 | 106 | 2.84 |
| 604 | B | 0.08 | 100 | 2.11 | 0.06 | 102 | 2.16 |
| | G | 0.10 | 100 | 2.69 | 0.10 | 100 | 2.74 |
| | R | 0.11 | 100 | 2.82 | 0.10 | 100 | 2.90 |
| 605 | B | 0.09 | 100 | 2.11 | 0.06 | 103 | 2.11 |
| | G | 0.11 | 100 | 2.73 | 0.10 | 101 | 2.75 |
| | R | 0.11 | 100 | 2.79 | 0.10 | 106 | 2.80 |
| 502 | B | 0.08 | 100 | 2.11 | 0.09 | 97 | 2.13 |
| | G | 0.10 | 100 | 2.71 | 0.11 | 96 | 2.72 |
| | R | 0.11 | 100 | 2.83 | 0.13 | 101 | 2.84 |
| 505 | B | 0.08 | 100 | 2.12 | 0.06 | 98 | 2.15 |
| | G | 0.09 | 100 | 2.79 | 0.09 | 98 | 2.83 |
| | R | 0.10 | 100 | 2.82 | 0.09 | 99 | 2.84 |
| 512 | B | 0.08 | 100 | 2.10 | 0.06 | 75 | 1.53 |
| | G | 0.09 | 100 | 2.63 | 0.07 | 84 | 1.99 |
| | R | 0.10 | 100 | 2.66 | 0.07 | 87 | 2.05 |

As can be seen from Table 8, the samples in accordance with the present invention exhibit excellent color developing properties with less fog even when rapidly processed with a color developing solution containing no benzyl alcohol; whereas the comparative sample undergoes serious reduction in relative sensitivity and maximum density when processed under such conditions.

EXAMPLE 7

Sampels 701 to 709 were prepared in the same manner as for Sample 501 of Example 5 except that the kinds and amounts of the yellow, magenta, and cyan couplers used in Sample 501 were changed as shown in Table 9.

Each of Samples 701 to 709 and Sample 512 of Example 5 was exposed to light for sensitometry under the same conditions as in Example 1, and then subjected to Processing L, M, or N using Color Developer (L), (M), or (N), respectively, in accordance with the following procedure. Formulations of the processing solutions used are also shown below.

| Processing Procedure: | | |
|---|---|---|
| Processing Step | Temperature | Time |
| Color Development | 35° C. | 45 sec. |
| Bleach-Fixing | 35° C. | 45 sec. |
| Rinsing 1 | 35° C. | 20 sec. |
| Rinsing 2 | 35° C. | 20 sec. |
| Rinsing 3 | 35° C. | 20 sec. |
| Drying | 80° C. | 60 sec. |

-continued

| Formulation of Developer (L): | |
|---|---|
| Pentasodium diethylenetriamine-pentaacetate | 2.0 g |
| Benzyl alcohol | 15 ml |
| Diethylene glycol | 10 ml |
| Sodium sulfite | 2.0 g |
| Potassium bromide | 0.01 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| Sodium carbonate monohydrate | 30.0 g |
| Fluorescent brightening agent (stilbene type) | 1.0 g |
| Water to make | 1000 ml (pH = 10.2) |

| Formulation of Developer (M): | |
|---|---|
| Triethanolamine | 10 g |
| N,N—Diethylhydroxylamine | 4 g |
| Fluorescent brightening agent (4,4'-diaminostilbene type) | 3.0 g |
| Sodium sulfite | 0.2 g |
| Potassium carbonate | 30.0 g |
| Disodium ethylenediaminetetra-acetate dihydrate | 2 g |
| Potassium bromide | 0.01 g |
| 4-Amino-3-methyl-N—ethyl-N—[β-(methanesulfonamido)ethyl]-p-phenylenediamine sulfate | 5.0 g |
| Sodium chloride | 2.0 g |
| Water to make | 1000 ml (pH = 10.25) |

| Formulation of Developer (N): | |
|---|---|
| Triethanolamine | 10 g |
| N,N—Diethylhydroxylamine | 4 g |
| Fluoresecent brightening agent (4,4'-diaminostilbene type) | 3.0 g |
| Sodium sulfite | 2.0 g |
| Potassium carbonate | 30 g |
| Disodium ethylenediaminetetra-acetate dihydrate | 2 g |
| Potassium bromide | 0.01 g |
| 4-Amino-3-methyl-N—ethyl-N—[β-(methanesulfonamido)ethyl]-p-phenylenediamine sulfate | 5.0 g |
| Sodium chloride | 2.0 g |
| Water to make | 1000 ml (pH = 10.25) |

| Formulation of Bleach-Fixing Bath: | |
|---|---|
| Ammonium (ethylenediaminetetra-acetato)iron(III) dihydrate | 60 g |
| Disodium ethylenediaminetetra-acetrate dihydrate | 4 g |
| Ammonium thiosulfate (70%) | 120 ml |
| Sodium sulfite | 16 g |
| Acetaldehyde-sulfurous acid adduct | 10 g |
| Glacial acetic acid | 7 g |
| Water to make | 1000 ml (pH = 5.5) |

| Formulation of Rinsing Bath: | |
|---|---|
| Disodium ethylenediaminetetra-acetate dihydrate | 0.4 g |
| Water to make | 1000 ml (pH = 7.0) |

TABLE 9

| | 1st Layer | | 2nd Layer | | 3rd Layer | |
|---|---|---|---|---|---|---|
| Sample No. | Coupler | Coupler Amount (g/m²) | Coupler | Coupler Amount (g/m²) | Coupler | Coupler Amount (g/m²) |
| 701 | Y-43 | 0.83 | M-40 | 0.43 | C-36 | 0.45 |
| 702 | " | " | " | " | C-38 | 0.48 |

TABLE 9-continued

| Sample No. | 1st Layer Coupler | 1st Layer Coupler Amount (g/m²) | 2nd Layer Coupler | 2nd Layer Coupler Amount (g/m²) | 3rd Layer Coupler | 3rd Layer Coupler Amount (g/m²) |
|---|---|---|---|---|---|---|
| 703 | " | " | " | " | C-39 | 0.42 |
| 704 | Y-46 | " | " | " | C-36 | 0.45 |
| 705 | " | " | " | " | C-38 | 0.48 |
| 706 | " | " | " | " | C-39 | 0.42 |
| 707 | Y-43 | " | M-42 | 0.34 | C-36 | 0.45 |
| 708 | " | " | " | " | C-38 | 0.48 |
| 709 | " | " | " | " | C-39 | 0.42 |

Photographic properties of the thus processed samples were evaluated in the same manner as in Example 5. The sensitivity of the sample when processed by Processing (L) was taken as standard (100). The results obtained are shown in Table 10.

TABLE 10

| Sample No. | Layer | Processing (L) $D_{min}$ | Processing (L) Relative Sensitivity | Processing (L) $D_{max}$ | Processing (M) $D_{min}$ | Processing (M) Relative Sensitivity | Processing (M) $D_{max}$ | Processing (N) $D_{min}$ | Processing (N) Relative Sensitivity | Processing (N) $D_{max}$ |
|---|---|---|---|---|---|---|---|---|---|---|
| 701 | B | 0.09 | 100 | 2.05 | 0.09 | 103 | 2.13 | 0.09 | 101 | 2.09 |
| | G | 0.10 | 100 | 2.65 | 0.09 | 102 | 2.73 | 0.09 | 101 | 2.70 |
| | R | 0.11 | 100 | 2.75 | 0.10 | 101 | 2.80 | 0.10 | 101 | 2.80 |
| 702 | B | 0.09 | 100 | 2.08 | 0.08 | 104 | 2.15 | 0.09 | 102 | 2.09 |
| | G | 0.09 | 100 | 2.70 | 0.09 | 103 | 2.75 | 0.09 | 99 | 2.73 |
| | R | 0.11 | 100 | 2.83 | 0.10 | 102 | 2.89 | 0.10 | 100 | 2.83 |
| 703 | B | 0.08 | 100 | 2.07 | 0.08 | 103 | 2.12 | 0.09 | 100 | 2.0 |
| | G | 0.10 | 100 | 2.68 | 0.09 | 103 | 2.70 | 0.09 | 100 | 2.70 |
| | R | 0.11 | 100 | 2.72 | 0.11 | 102 | 2.79 | 0.11 | 101 | 2.75 |
| 704 | B | 0.09 | 100 | 2.14 | 0.08 | 102 | 2.18 | 0.08 | 100 | 2.15 |
| | G | 0.11 | 100 | 2.65 | 0.10 | 101 | 2.72 | 0.09 | 100 | 2.70 |
| | R | 0.11 | 100 | 2.77 | 0.11 | 101 | 2.81 | 0.11 | 101 | 2.80 |
| 705 | B | 0.08 | 100 | 2.12 | 0.08 | 100 | 2.14 | 0.08 | 101 | 2.13 |
| | G | 0.10 | 100 | 2.69 | 0.10 | 100 | 2.73 | 0.09 | 102 | 2.73 |
| | R | 0.10 | 100 | 2.85 | 0.10 | 100 | 2.89 | 0.10 | 100 | 2.85 |
| 706 | B | 0.08 | 100 | 2.15 | 0.09 | 100 | 2.17 | 0.09 | 99 | 2.15 |
| | G | 0.10 | 100 | 2.69 | 0.09 | 100 | 2.73 | 0.09 | 100 | 2.72 |
| | R | 0.11 | 100 | 2.73 | 0.11 | 102 | 2.79 | 0.10 | 100 | 2.76 |
| 707 | B | 0.09 | 100 | 2.05 | 0.09 | 105 | 2.12 | 0.09 | 101 | 2.09 |
| | G | 0.11 | 100 | 2.55 | 0.10 | 94 | 2.60 | 0.10 | 92 | 2.59 |
| | R | 0.10 | 100 | 2.76 | 0.10 | 101 | 2.81 | 0.10 | 100 | 2.77 |
| 708 | B | 0.09 | 100 | 2.09 | 0.09 | 103 | 2.12 | 0.09 | 101 | 2.09 |
| | G | 0.10 | 100 | 2.53 | 0.10 | 94 | 2.60 | 0.09 | 93 | 2.60 |
| | R | 0.11 | 100 | 2.84 | 0.10 | 101 | 2.88 | 0.10 | 100 | 2.88 |
| 709 | B | 0.09 | 100 | 2.07 | 0.10 | 104 | 2.14 | 0.09 | 100 | 2.08 |
| | G | 0.10 | 100 | 2.59 | 0.10 | 93 | 2.82 | 0.09 | 90 | 2.60 |
| | R | 0.11 | 100 | 2.77 | 0.11 | 100 | 2.79 | 0.11 | 99 | 2.78 |
| 512 | B | 0.08 | 100 | 2.10 | 0.06 | 74 | 2.51 | 0.06 | 60 | 1.38 |
| | G | 0.09 | 100 | 2.63 | 0.07 | 83 | 2.98 | 0.07 | 79 | 1.79 |
| | R | 0.10 | 100 | 2.66 | 0.07 | 86 | 2.03 | 0.07 | 80 | 1.92 |

It can be seen from Table 10 that the comparative sample undergoes marked reduction in relative sensitivity and maximum density when rapidly processed with a color developing solution containing no benzyl alcohol. To the contrary, the samples according to the present invention, in which couplers containing at least one of a carboxylic acid group, a sulfonamido group, a sulfamoyl group, a phenyl group, and a substituted phenyl group in their nondiffisible group or split-off group are used, do not suffer from such reduction in relative sensitivity or maximum density or fog formation even when rapidly processed without using benzyl alcohol, thus exhibiting excellent color developing properties.

On further review of the foregoing results, with respect to the magenta coupler, when Coupler (M-42) fallen within formula (IV-2) and Coupler (M-40) fallen within formula (IV-3) are compared, it can be understood that Coupler (M-40) fallen within formula (IV-3) is more excellent in adaptability for rapid processing with a color developing solution without using benzyl alcohol, i.e., Processings M and N.

EXAMPLE 8

Each of Samples 501 and 512 as prepared in Example 5 and Samples 707 to 709 as prepared in Example 7 was exposed to light for 0.5 second at an exposure of 250 CMS using an optical wedge for sensitometry through a blue (B), green (G), or red (R) filter by means of a sensitometer (FWH Model manufactured by Fuji Photo Film Co., Ltd.; color temperature: 3,200° K.) The exposed sample was subjected to Processing O or P according to the following procedure. Formulations of the processing solutions used are also described below. The procedure for Processing O and that for Processing P are equal except for using Developer (O) or Developer (P), respectively.

Processing Procedure:

| Processing Step | Temperature | Time |
|---|---|---|
| Color Development | 35° C. | 45 sec. |
| Bleach-Fixing | 30–35° C. | 45 sec. |
| Washing (1) | 30–35° C. | 20 sec. |
| Washing (2) | 30–35° C. | 20 sec. |
| Washing (3) | 30–35° C. | 20 sec. |
| Washing (4) | 30–35° C. | 30 sec. |
| Drying | 70–80° C. | 60 sec. |

The washing was carried out in a countercurrent manner of three tanks by the direction of Washing (4) to Washing (1).

| Formulation of Color Developer | Developer (O) | Developer (P) |
|---|---|---|
| Water | 800 ml | 800 ml |
| Benzyl alcohol | 12 ml | — |
| Diethylene glycol | 10 ml | — |
| Ethylenediamine-N,N,N',N'—tetramethylene sulfonic acid | 1.5 g | 1.5 g |
| Glutamic acid | 6.0 g | 6.0 g |

-continued

| Processing Procedure: | | |
|---|---|---|
| Sodium chloride | 1.4 g | 1.4 g |
| Potassium carbonate | 25 g | 25 g |
| N—Ethyl-N—(β-methanesulfonamidoethyl)-3-methyl-4-aminoaniline sulfate | 5.0 g | 5.0 g |
| N,N—diethylhydroxylamine | 4.2 g | 4.2 g |
| Fluorescent brightening agent (4,4'-diaminostilbene type) | 2.0 g | 2.0 g |
| Water to make | 1000 ml | 1000 ml |
| pH (at 25° C.) | 10.10 | 10.10 |
| Formulation of Bleach-Fixing Bath: | | |
| Water | | 400 ml |
| Ammonium thiosulfate (70%) | | 100 ml |
| Sodium sulfite | | 18 g |
| Ammonium (ethylenediaminetetraaceto)iron (III) | | 55 g |
| Disodium ethylenediaminetetraacetate | | 3 g |
| Ammonium bromide | | 40 g |
| Glacial acetic acid | | 8 g |
| Water to make | | 1000 ml |
| pH (at 25° C.) | | 5.5 |
| Formulating of Washing Solution: | | |
| Ion-exchanged water (containing not more than 3 ppm of each of calcium and magnesium) | | |

Each of the thus processed samples was subjected to preservation testing at a temperature of 80° C. and at a relative humidity of 70% for 50 days. Where the density of yellow ($D_Y$), magenta ($D_G$), or cyan ($D_R$) of each sample had been 1.0 before the testing, the change in density as well as the change in $D_B$ in the fog density (Dmin) region were evaluated. The results obtained are shown in Table 11 below.

TABLE 11

| Sample No. | Layer | Coupler | Color Developer (O) Change in Density | Color Developer (O) $D_B$** | Color Developer (P) Change in Density* | Color Developer (P) $D_B$** |
|---|---|---|---|---|---|---|
| 501 | B | Y-35 | 80 | 0.19/0.11 | 85 | 0.16/0.11 |
| | G | M-31 | 95 | | 98 | |
| | R | C-3 | 74 | | 78 | |
| 502 | B | Y-36 | 83 | 0.52/0.11 | 88 | 0.42/0.11 |
| | G | M-1 | 91 | | 95 | |
| | R | C-1 | 71 | | 75 | |
| 503 | B | Y-36 | 83 | 0.51/0.11 | 87 | 0.41/0.11 |
| G | M-1 | 91 | | 95 | | |
| R | C-2 | 73 | | 77 | | |
| 504 | B | Y-36 | 83 | 0.51/0.11 | 88 | 0.40/0.11 |
| | G | M-1 | 91 | | 95 | |
| | R | C-25 | 76 | | 81 | |
| 505 | B | Y-36 | 82 | 0.18/0.11 | 87 | 0.15/0.11 |
| | G | M-23 | 96 | | 99 | |
| | R | C-2 | 73 | | 77 | |
| 506 | B | Y-36 | 82 | 0.18/0.11 | 86 | 0.15/0.11 |
| | G | M-23 | 96 | | 99 | |
| | R | C-3 | 73 | | 77 | |
| 507 | B | Y-36 | 83 | 0.18/0.11 | 87 | 0.15/0.11 |
| | G | M-23 | 96 | | 99 | |
| | R | C-27 | 76 | | 81 | |
| 508 | B | Y-36 | 83 | 0.19/0.11 | 88 | 0.16/0.11 |
| | G | M-31 | 94 | | 98 | |
| | R | C-1 | 72 | | 76 | |
| 509 | B | Y-36 | 83 | 0.19/0.11 | 87 | 0.16/0.11 |
| | G | M-31 | 95 | | 98 | |
| | R | C-3 | 74 | | 78 | |
| 510 | B | Y-36 | 83 | 0.19/0.11 | 87 | 0.16/0.11 |
| | G | M-31 | 94 | | 98 | |
| | R | C-29 | 77 | | 82 | |
| 511 | B | 2a*** | 78 | 0.58/0.11 | 83 | 0.49/0.11 |
| | G | M-2 | 90 | | 94 | |
| | R | C-1 & C-18 | 74 | | 78 | |
| 707 | B | Y-43 | 77 | 0.20/0.11 | 83 | 0.16/0.11 |
| | G | M-42 | 93 | | 96 | |
| | R | C-36 | 76 | | 81 | |
| 708 | B | Y-43 | 77 | 0.19/0.11 | 82 | 0.16/0.11 |
| | G | M-42 | 93 | | 96 | |

TABLE 11-continued

| Sample No. | Layer | Coupler | Color Developer (O) Change in Density | Color Developer (O) $D_B$** | Color Developer (P) Change in Density* | Color Developer (P) $D_B$** |
|---|---|---|---|---|---|---|
| | R | C-38 | 77 | | 81 | |
| 709 | B | Y-43 | 78 | 0.19/0.11 | 82 | 0.16/0.11 |
| | G | M-42 | 93 | | 97 | |
| | R | C-39 | 78 | | 83 | |
| 512 | B | | 71 | 0.26/0.11 | 78 | 0.20/0.11 |
| | G | (see Table 6) | 90 | | 95 | |
| | R | | 63 | | 70 | |

*Relative value when the initial density (1.0) before the testing was taken as standard (100).

**Degree of yellow density (Dy) after the testing to that before the testing in the fogged portion.

***Yellow Coupler

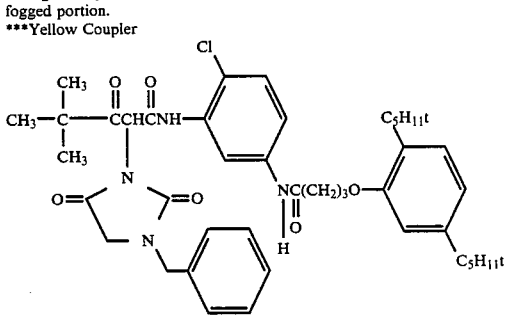

It can be understood from Table 11 that in the rapid processing, an image obtained by processing with a color developing solution containing no benzyl alcohol is superior in fastness to humidity and heat to that obtained by processing with a color developing solution containing benzyl alcohol. Further, the former is excellent in image preservability such that yellow staining in the Dmin portion is less. Probably, this is because the carried amount of a developing agent, etc. in a color developing solution by benzyl alcohol and the removal of unnecessary substances such as the developing agent in subsequent processings are insufficient.

Next, using each of Samples 507 and 510 as prepared in Example 5, a print was prepared from a color negative film photographed with a Macbeth color lettering chart while adopting a neutral gray and then evaluated in terms of color reproducibility. As a result, Sample 507 exhibited good color reproducibility such that red chroma in red patch and blue chroma in blue patch were high though the former showed a slight tendency to purple, and Sample 510 exhibited very good color reproducibility such that chromas in red, blue, magenta, and cyan were high.

Thus, it can be understood that the method of color image formation according to the present invention gives rise to excellent color formation less in fog, excellent color image preservability less in staining in the white portion (i.e., less in yellow staining), and good color reproducibility with high chroma.

As described above, the present invention makes it possible to substantially eliminate benzyl alcohol from a developing solution to thereby alleviate a pollution load, reduce the time and labor for the preparation of a developing solution, and prevent density reduction due to formation of a leuco compound from a cyan dye. The present invention further makes it possible to rapidly process a large number of color prints having improved color reproducibility, thereby markedly increasing productivity. According to the present invention, even when development processing is carried out in a reduced time using a color developing solution containing substantially no benzyl alcohol, the resulting color image does not undergo great reduction of color density and has low fog. Further, with respect to image preservability, when rapid processing with a color developing solution containing substantially no benzyl alcohol according to the present invention is applied, the amount of residual processing chemicals is reduced whereby good image preservability reveals.

While the invention has been described in detail and with reference to specific embodiments thereof, it will be apparent to one skilled in the art that various changes and modifications can be made therein without departing from the spirit and scope thereof.

What is claimed is:

1. A method for forming a color image, which comprises imagewise exposing a multi-layer silver halide color photographic material comprising a reflective support having provided thereon at least three silver halide emulsion layers different in color sensitivity, each of which separately contains at least one of couplers represented by formula (I)

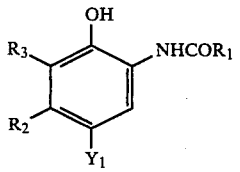

(I)

wherein $R_1$ represents an aliphatic group, an aromatic group, a heterocyclic group, an aromatic amino group, or a heterocyclic amino group; $R_2$ represents an aliphatic group; $R_3$ represents a hydrogen atom, a halogen atom, an aliphatic group, an aliphatic oxy group, or an acylamino group; or $R_2$ and $R_3$ are taken together to form a 5- or 7-membered ring; $Y_1$ represents a halogen atom, or a group capable of being split off upon coupling with an oxidation product of a developing agent; and $R_1$, $R_2$, or $Y_1$ may form a polymer including a dimer, and couplers represented by formula (II)

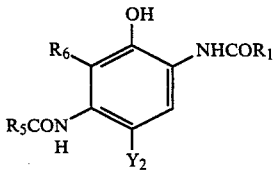

(II)

wherein $R_4$ and $R_5$ each represents an aliphatic group, an aromatic group, a heterocyclic group, an aromatic amino group, or a heterocyclic amino group; $R_6$ represents a hydrogen atom, a halogen atom, an aliphatic group, an aliphatic oxy group, or an acylamino group; or $R_5$ and $R_6$ are taken together to form a 5- or 7-membered ring; $Y_2$ represents a halogen atom, or a group capable of being split off upon coupling with an oxidation product of a developing agent; and $R_4$, $R_5$, $R_6$, or $Y_2$ may form a polymer including a dimer; at least one of couplers represented by formula (III)

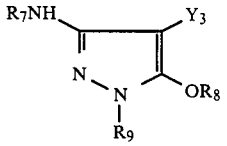

(III)

wherein $R_7$ and $R_9$ each represents a substituted or unsubstituted phenyl group; $R_8$ represents a hydrogen atom, an aliphatic or aromatic acyl group, or an aliphatic or aromatic sulfonyl group; $Y_3$ represents a hydrogen atom, or a group capable of being split off upon coupling with an oxidation product of a developing agent; and $R_7$, $R_8$, $R_9$, or $Y_3$ may form a polymer including a dimer, and couplers represented by formula (IV)

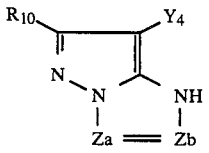

(IV)

wherein $R_{10}$ represents a hydrogen atom or a substituent; $Y_4$ represents a halogen atom, or a group capable of being split off upon coupling with an oxidation product of a developing agent; Za and Zb each represents a methine group, a substituted methine group, or =N—; or $R_{10}$, Za, Zb, or $Y_4$ may form a polymer including a dimer; and at least one of couplers represented by formula (V)

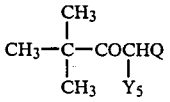

(V)

wherein $Y_5$ represents a group capable of being split off upon coupling with an oxidation product of a developing agent; and Q represents a substituted or unsubstituted N-phenyl-carbamoyl group; or $Y_5$ or Q may form a polymer including a dimer, and processing the exposed material with a color developing solution [containing substantially no benzyl alcohol] for a period of not more than 2 minutes, wherein said silver halide emulsions each contains silver chlorobromide having a silver chloride content of 90 mol% or more and the color developing solution is free from benzyl alcohol.

2. A method as in claim 1, wherein the couplers are dispersed in the presence of at least one of high-boiling organic solvents represented by formula (A)

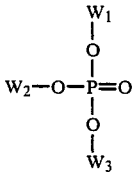

(A)

wherein $W_1$, $W_2$, and $W_3$ each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group, high-boiling organic solvents represented by formula (B)

$W_1—COO—W_2$ TM (B)

wherein $W_1$ and $W_2$ are as defined above, high-boiling organic solvents represented by formula (C)

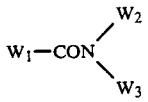

(C)

wherein $W_1$, $W_2$, and $W_3$ are as defined above, high-boiling organic solents represented by formula (D)

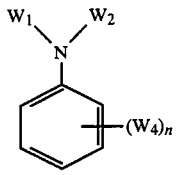

(D)

wherein $W_1$ and $W_2$ are as defined above; $W_4$ represents $W_1$, $OW_1$, or S-$W_1$; and n represents an integer of from 1 to 5, and high-boiling organic solvents represented by formula (E)

$W_1—O—W_2$ (E)

wherein $W_1$ and $W_2$ are as defined above, or $W_1$ and $W_2$ are taken together to form a condensed ring, and said high-boiling organic solvents represented by formulae (A) to (E) have a dielectric constant of 4.00 or more as measured at 25° C. and 10 KHz.

3. A method as in claim 1, wherein at least one of the couplers represented by formula (I) to (V) contains, in a nondiffusing group or split-off group thereof, at least one of a free carboxyl group, a carboxyl group in the form of a salt, a substituted or unsubstituted sulfonamido group, a substituted or unsubstituted sulfamoyl group, and a substituted or unsubstituted hydroxyphenyl group.

4. A method as in claim 2, wherein said high-boiling organic solvents represented by formulae (A) to (E) have a dielectric constant of 5.0 or more as measured at 25° C. and 10 HHz and a viscosity of 20 cp or more as measured at 25° C.

5. A method as in claim 1, wherein the color photographic material comprises a reflective support having thereon a blue-sensitive silver halide emulsion layer associated with at least one of couplers represented by formula (V), a green-sensitive silver halide emulsion layer associated with at least one of couplers represented by formula (IV), and a red-sensitive silver halide emulsion layer associated with at least one of couplers represented by formula (I) or (II).

6. A method as in claim 1, wherein the color photographic material comprises a reflective support having thereon a blue-sensitive silver halide emulsion layer associated with at least one of couplers represented by formula (V), a green-sensitive silver halide emulsion layer associated with at least one of couplers represented by formula (III) or (IV), and a red-sensitive silver halide emulsion layer associated with at least one of couplers represented by formula (II) wherein $R_5$ and $R_6$ are taken together to form a 5- to 7-membered ring.

7. A method as in claim 5, wherein the coupler represented by formula (IV) is selected from the members consisting of formulae (IV-1), (IV-2), (IV-3), and (IV-4):

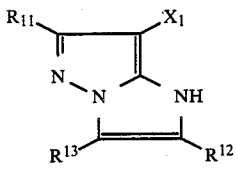

(IV-1)

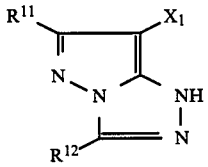

(IV-2)

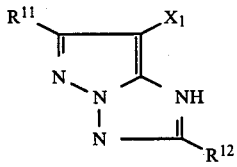

(IV-3)

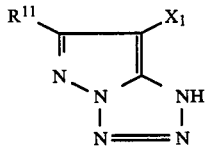

(IV-4)

wherein $R^{11}$, $R^{12}$, and $R^{13}$ each represents a hydrogen atom; a halogen atom; a cyano group; $R_1'$, $R_1'O$—, $R_1'C(=O)$—, $R_1'CO(=O)$—

$R_1'SO$—, $R_1'$—$SO_2$—, $R_1'SO_2NH$—, $R_1'C(=O)NH$—, $R_1'NH$—, $R_1'$—S—,

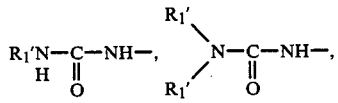

or $R_1'OC(=O)NH$—, wherein $R_1'$ represents an aliphatic, aromatic, or heterocyclic group; a silyl group; a silyloxy group; a silylamino group; an imino group; a carbamoyl group; a sulfamoyl group; or a sulfamoylamino group; $X_1$ has the same meaning as $Y_4$ as recited in claim 1; and $R^{11}$, $R^{12}$, $R^{13}$, or $X_1$ may be a divalent group, at which a bis-compound is formed, or a linking group via which a polymer chain and a coupler nucleus are linked.

8. A method as in claim 7, wherein the coupler is represented by formula (IV-3).

9. A method as in claim 8, wherein the coupler represented by formula (IV) is selected from the members consisting of formulae (IV-1), (IV-2), (IV-3), and (IV:4):

(IV-4):

(IV-1)

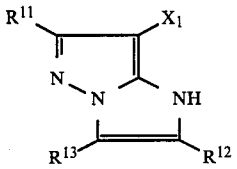

(IV-2)

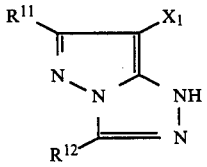

(IV-3)

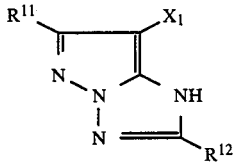

(IV-4)

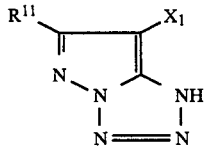

wherein $R^{11}$, $R^{12}$, and $R^{13}$ each represents a hydrogen atom; a halogen atom; a cyano group; $R_1'$, $R_1'O$—, $R_1'\underset{\underset{O}{\|}}{C}$—, $R_1'\underset{\underset{O}{\|}}{CO}$—

$R_1'SO$—, $R_1'$—$SO_2$—, $R_{1'SO2}NH$—, $R_1'\underset{\underset{O}{\|}}{C}NH$—

$R_1'NH$—, $R_1'$—S—, $R_1'\underset{\underset{H}{|}}{N}-\underset{\underset{O}{\|}}{C}-NH$—, $(R_1')_2N-\underset{\underset{O}{\|}}{C}-NH$— or $R_1'O\underset{\underset{O}{\|}}{C}NH$— wherein $R_1'$ represents an aliphatic, aromatic, or heterocyclic group; a silyl group; a silyloxy group; a silylamino group; an imino group; a carbamoyl group; a sulfamoyl group; or a sulfamoylamino group; $X_1$ has the same meaning as $Y_4$ as recited in claim 1; and $R^{11}$, $R^{12}$, $R^{13}$, or $X_1$ may be a divalent group, at which a bis-compound is formed, or a linking group via which a polymer chain and a coupler nucleus are linked.

10. A method as in claim 9, wherein the coupler is represented by formula (IV-3).

11. A method as in claim 1, wherein the silver halide has a regular crystal form.

12. A method as in claim 11, wherein the silver halide is cubic.

13. A method as in claim 1, wherein the silver halide predominantly forms a latent image on the surface thereof upon exposure to light.

14. A method as in claim 1, wherein the color photographic material further contains benzotriazole derivatives represented by formula (XVII):

(XVII)

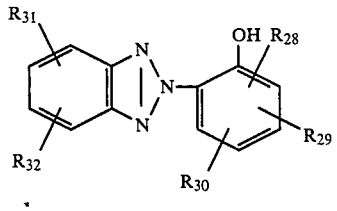

wherein $R_{28}$, $R_{29}$, $R_{30}$, $R_{31}$, and $R_{32}$, which may be the same or different, each represents a hydrogen atom or a substituent; and $R_{31}$ and $R_{32}$ may be cyclized to form a 5- or 6-membered carbon ring.

15. A method as in claim 1, wherein the color photographic material further contains at least one dye-image stabilizing compound represented by formulae (XVIII) and (XIX):

(XVIII)

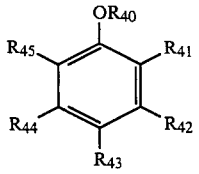

wherein $R_{40}$ represents a hydrogen atom, a substituted or unsubstituted aliphatic group, a substituted or unsubstituted aromatic group, a substituted or unsubstituted heterocyclic group, or a substituted silyl group of formula $$-Si(R_{50})(R_{51})(R_{52}),$$

wherein $R_{50}$, $R_{51}$, and $R_{52}$, which may be the same or different, each represents a substituted or unsubstituted aliphatic group, a substituted or unsubstituted aromatic group, a substituted or unsubstituted aliphatic oxy group, or a substituted or unsubstituted aromatic oxy group; and $R_{41}$, $R_{42}$, $R_{43}$, $R_{44}$, and $R_{45}$, which may be the same or different, each represents a hydrogen atom, an alkyl group, an aryl group, an alkoxy group, a hydroxyl group, an alkoxycarbonyl group, a mono- or dialkylamino group, an imino group, or an acylamino group;

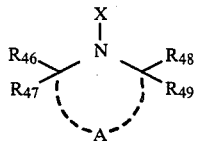

(XIX)

wherein $R_{46}$, $R_{47}$, $R_{48}$, and $R_{49}$, which may be the same or different, each represents a hydrogen atom or an alkyl group; X represents a hydrogen atom, an aliphatic group, an acyl group, an aliphatic or aromatic sulfonyl group, an aliphatic or aromatic sulfinyl group, an oxy radical group, or a hydroxyl group; and A represents a non-metallic atomic group forming a 5-, 6-, or 7-membered ring.

16. A method as in claim 1, wherein the color photographic material further contains at least one compound represented by formulae (XX), (XXI), (XXII), (XXIII), (XXIV), and (XXV):

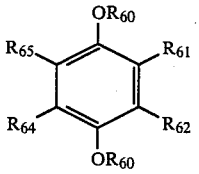

(XX)

wherein $R_{60}$ represents a hydrogen atom, a substituted or unsubstituted aliphatic group, a substituted or unsubstituted aromatic group, a substituted or unsubstituted heterocyclic group, or a substituted silyl group of formula

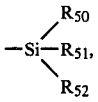

wherein $R_{50}$, $R_{51}$, and $R_{52}$, which may be the same or different, each represents a substituted or unsubstituted aliphatic group, a substituted or unsubstituted aromatic group, a substituted or unsubstituted aliphatic oxy group, or a substituted or unsubstituted aromatic oxy group; and $R_{61}$, $R_{62}$, $R_{64}$, and $R_{65}$, which may be the same or different, each represents a hydrogen atom, an aliphatic group, an aromatic group, an acylamino group, a mono- or dialkylamino group, an aliphatic or aromatic thio group, an aliphatic or aromatic oxycarbonyl group, or —$OR_{60}$; $R_{60}$ and $R_{61}$ may be bonded togeher to form a 5- or 6-membered ring; and $R_{61}$ and $R_{62}$ may be bonded together to form a 5- or 6-membered ring;

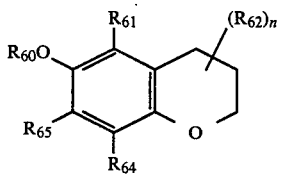

(XXI)

wherein $R_{60}$, $R_{61}$, $R_{62}$, $R_{64}$, and $R_{65}$ are as defined above; and n represents 0 or an integer of from 1 to 6;

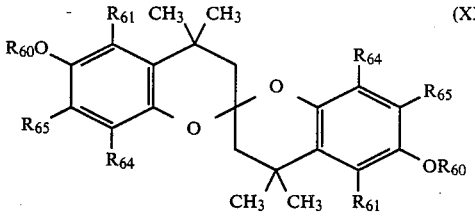

(XXII)

wherein $R_{60}$, $R_{61}$, $R_{64}$, and $R_{65}$ are defined above;

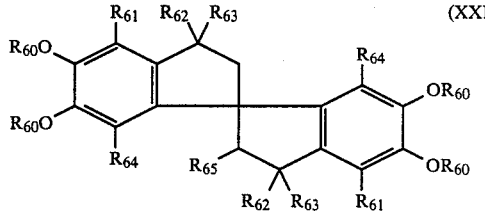

(XXIII)

wherein $R_{60}$, $R_{61}$, $R_{62}$, $R_{64}$, and $R_{65}$ are as defined above; and $R_{63}$ has the same meaning as $R_{60}$ to $R_{65}$;

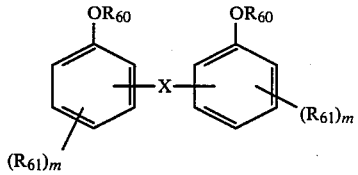

(XXIV)

wherein $R_{60}$ and $R_{61}$ are as defined above; X represents a divalent linking group; and m represents 0 or an integer of from 1 to 4;

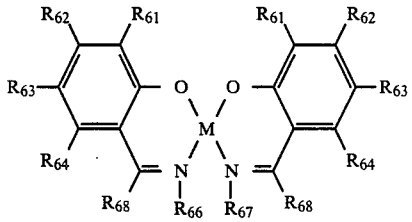

(XXV)

wherein $R_{61}$, $R_{62}$, $R_{63}$, and $R_{64}$ are as defined above; $R_{66}$ and $R_{67}$, which may be the same or different, each represents a hydrogen atom, an aliphatic group, an aromatic group, or a hydroxyl group; $R_{68}$ represents a hydrogen atom, an aliphatic group, or an aromatic group; $R_{66}$ and $R_{67}$ may be taken together to form a 5- or 6-membered ring; and M represents Cu, Co, Ni, Pd, or Pt.

17. A method as in claim 1, wherein the silver halide emulsion is a mono-dispersed silver halide emulsion having a coefficient of variation of grain size of not greater than 20%.

18. A method as in claim 17, wherein the silver halide emulsion is a mono-dispersed silver halide emulsion having a coefficient of variation of grain size of not greater than 15%.

19. A method as in claim 1, wherein an aromatic primary amine compound is used as a color developing agent.

20. A method as in claim 19, wherein the aromatic primary amine compound is a p-phenylenediamine derivative.

21. A method as in claim 20, wherein the p-phenylenediamine derivative is 3-methyl-4-amino-N-ethyl-N-β-hydroxyethylaniline or 3-methyl-4-amino-N-ethyl-N-methanesulfonamidoethylaniline.

22. A method as in claim 21, wherein the p-phenylenediamine derivative is 3-methyl-4-amino-N-ethyl-N-β-methanesulfonamidoethylaniline.

* * * * *